US009016903B2

(12) United States Patent
Mahalingam et al.

(10) Patent No.: US 9,016,903 B2
(45) Date of Patent: Apr. 28, 2015

(54) THERMAL MANAGEMENT OF LED-BASED ILLUMINATION DEVICES WITH SYNTHETIC JET EJECTORS

(71) Applicant: Nuventix, Inc., Austin, TX (US)

(72) Inventors: Raghavendran Mahalingam, Austin, TX (US); Samuel Neil Heffington, Austin, TX (US); Stephen P. Darbin, Austin, TX (US); Daniel N. Grimm, Round Rock, TX (US)

(73) Assignee: Nuventix, Inc., Austin, TX (US)

( * ) Notice: Subject to any disclaimer, the term of this patent is extended or adjusted under 35 U.S.C. 154(b) by 95 days.

(21) Appl. No.: 13/969,976

(22) Filed: Aug. 19, 2013

(65) Prior Publication Data

US 2014/0029272 A1 Jan. 30, 2014

Related U.S. Application Data

(63) Continuation of application No. 13/470,523, filed on May 14, 2012, now Pat. No. 8,777,456, which is a continuation-in-part of application No. 12/902,295, filed on Oct. 12, 2010, now Pat. No. 8,579,476, which is a continuation-in-part of application No. 12/503,181, filed on Jul. 15, 2009, now abandoned.

(60) Provisional application No. 61/486,838, filed on May 17, 2011, provisional application No. 61/134,984, filed on Jul. 15, 2008.

(51) Int. Cl.

| | |
|---|---|
| ***F21V 29/00*** | (2006.01) |
| ***F21K 99/00*** | (2010.01) |
| ***F21V 3/00*** | (2006.01) |
| *F21Y 101/02* | (2006.01) |
| *F21V 3/02* | (2006.01) |
| *F21Y 111/00* | (2006.01) |
| *F21Y 113/00* | (2006.01) |
| *F21V 29/02* | (2006.01) |

(52) U.S. Cl.

CPC . *F21V 29/00* (2013.01); *F21K 9/00* (2013.01); *F21V 3/00* (2013.01); *F21Y 2101/02* (2013.01); *F21V 29/2206* (2013.01); *F21V 29/2293* (2013.01); *F21V 29/262* (2013.01); *F21V 29/40* (2013.01); *F21K 9/135* (2013.01); *F21V 3/005* (2013.01); *F21V 3/02* (2013.01); *F21Y 2111/007* (2013.01); *F21Y 2113/005* (2013.01); *F21V 29/2262* (2013.01); *F21V 29/004* (2013.01); *F21V 29/02* (2013.01)

(58) Field of Classification Search

CPC ... F21V 29/004; F21V 29/02; F21V 29/2293; F21V 29/00; F21V 29/20; F21V 29/2206; F21V 29/2262; F21K 9/00; F21K 9/135

See application file for complete search history.

(56) References Cited

U.S. PATENT DOCUMENTS 5,688,042 A 11/1997 Madadi et al.
5,758,823 A 6/1998 Glezer et al.

(Continued)

*Primary Examiner* — Bao Q Truong

(74) *Attorney, Agent, or Firm* — Wolf, Greenfield & Sacks, P.C.

(57) ABSTRACT

An illumination device 1701 is provided which includes a light emitting portion 1703; an LED 1715 disposed within said light emitting portion; a threaded connector module 1705 adapted to rotatingly engage said illumination device to a source of electricity; a heat sink 1759 disposed between said light emitting portion and said connector module; and a synthetic jet ejector 1709 disposed between said light emitting portion and said connector module.

21 Claims, 49 Drawing Sheets

(56) References Cited

U.S. PATENT DOCUMENTS

| | | | | |
|---|---|---|---|---|
| 5,894,990 | A | 4/1999 | Glezer et al. | |
| 5,966,286 | A | 10/1999 | O'Connor et al. | |
| 5,988,522 | A | 11/1999 | Glezer et al. | |
| 6,123,145 | A | 9/2000 | Glezer et al. | |
| 6,588,497 | B1 | 7/2003 | Glezer et al. | |
| 7,252,140 | B2 | 8/2007 | Glezer et al. | |
| 7,401,945 | B2 | 7/2008 | Zhang | |
| 7,568,817 | B2 | 8/2009 | Lee et al. | |
| 7,606,029 | B2 | 10/2009 | Mahalingam et al. | |
| 7,607,470 | B2 | 10/2009 | Glezer et al. | |
| 7,637,636 | B2 | 12/2009 | Zheng et al. | |
| 7,760,499 | B1 | 7/2010 | Darbin et al. | |
| 7,768,779 | B2 | 8/2010 | Heffington et al. | |
| 7,784,972 | B2 | 8/2010 | Heffington et al. | |
| 7,819,556 | B2 | 10/2010 | Heffington et al. | |
| 7,932,535 | B2 | 4/2011 | Mahalingam et al. | |
| 8,030,886 | B2 | 10/2011 | Mahalingam et al. | |
| 8,035,966 | B2 | 10/2011 | Reichenbach et al. | |
| 8,066,410 | B2 | 11/2011 | Booth et al. | |
| 8,069,910 | B2 | 12/2011 | Beltran | |
| 8,136,576 | B2 | 3/2012 | Grimm | |
| 8,272,851 | B2 | 9/2012 | Lucas | |
| 8,290,724 | B2 | 10/2012 | Darbin et al. | |
| 8,299,691 | B2 | 10/2012 | Grimm | |
| 8,317,358 | B2 | 11/2012 | Chou | |
| 8,388,142 | B2 | 3/2013 | Jones et al. | |
| 8,430,644 | B2 | 4/2013 | Mahalingam et al. | |
| 8,579,476 | B2 * | 11/2013 | Mahalingam et al. | 362/373 |
| 8,646,701 | B2 | 2/2014 | Grimm et al. | |
| 8,672,648 | B2 | 3/2014 | Glezer et al. | |
| 8,770,765 | B2 | 7/2014 | Jones et al. | |
| 8,772,987 | B2 | 7/2014 | Grimm et al. | |
| 8,777,456 | B2 * | 7/2014 | Mahalingam et al. | 362/294 |
| 8,845,138 | B2 | 9/2014 | Booth et al. | |

* cited by examiner

THERMAL MANAGEMENT OF LED-BASED ILLUMINATION DEVICES WITH SYNTHETIC JET EJECTORS

CROSS-REFERENCE TO RELATED APPLICATIONS

The present application is a continuation of U.S. Ser. No. 13/470,523, entitled "THERMAL MANAGEMENT OF LED-BASED ILLUMINATION DEVICES WITH SYNTHETIC JET EJECTORS" (Mahalingam et al.), filed May 14, 2012, now U.S. Pat. No. 8,777,456, and which is incorporated herein by reference in its entirety, which is a continuation-in-part application of U.S. Ser. No. 12/902,295, entitled "THERMAL MANAGEMENT OF LED-BASED ILLUMINATION DEVICES WITH SYNTHETIC JET EJECTORS" (Mahalingam et al.), filed Oct. 12, 2010, now U.S. Pat. No. 8,579,476, and which is incorporated herein by reference in its entirety, and which is a continuation-in-part of U.S. Ser. No. 12/503,181, now abandoned, entitled "THERMAL MANAGEMENT OF LED-BASED ILLUMINATION DEVICES WITH SYNTHETIC JET EJECTORS" (Heffington et al.), filed on Jul. 15, 2009, and which is incorporated herein by reference in its entirety, and which claims priority to U.S. Ser. No. 61/134,984, entitled "THERMAL MANAGEMENT OF LED-BASED ILLUMINATION DEVICES WITH SYNTHETIC JET EJECTORS" (Heffington et al.), filed on Jul. 15, 2008, and which is incorporated herein by reference in its entirety. U.S. Ser. No. 13/470,523 also claims priority to U.S. Ser. No. 61/486,838, entitled "COOLING CONCEPTS" (Noska et al.), filed on May 17, 2011, and which is incorporated herein by reference in its entirety.

FIELD OF THE DISCLOSURE

The present disclosure relates generally to the thermal management of illumination devices, and more particularly to the thermal management of LED-based illumination devices through the use of synthetic jet ejectors.

BACKGROUND OF THE DISCLOSURE

A variety of thermal management devices are known to the art, including conventional fan based systems, piezoelectric systems, and synthetic jet ejectors. The latter type of system has emerged as a highly efficient and versatile solution, especially in applications where thermal management is required at the local level.

Various examples of synthetic jet ejectors are known to the art. Earlier examples are described in U.S. Pat. No. 5,758,823 (Glezer et al.), entitled "Synthetic Jet Actuator and Applications Thereof"; U.S. Pat. No. 5,894,990 (Glezer et al.), entitled "Synthetic Jet Actuator and Applications Thereof"; U.S. Pat. No. 5,988,522 (Glezer et al.), entitled Synthetic Jet Actuators for Modifying the Direction of Fluid Flows"; U.S. Pat. No. 6,056,204 (Glezer et al.), entitled "Synthetic Jet Actuators for Mixing Applications"; U.S. Pat. No. 6,123,145 (Glezer et al.), entitled "Synthetic Jet Actuators for Cooling Heated Bodies and Environments"; and U.S. Pat. No. 6,588,497 (Glezer et al.), entitled "System and Method for Thermal Management by Synthetic Jet Ejector Channel Cooling Techniques.

Further advances have been made in the art of synthetic jet ejectors, both with respect to synthetic jet ejector technology in general and with respect to the applications of this technology. Some examples of these advances are described in U.S. Pat. No. 7,252,140 (Glezer et al.), entitled "Apparatus and Method for Enhanced Heat Transfer"; U.S. Pat. No. 7,606,029 (Mahalingam et al.), entitled "Thermal Management System for Distributed Heat Sources"; U.S. Pat. No. 7,607,470 (Glezer et al.), entitled "Synthetic Jet Heat Pipe Thermal Management System"; U.S. Pat. No. 7,760,499 (Darbin et al.), entitled "Thermal Management System for Card Cages"; U.S. Pat. No. 7,768,779 (Heffington et al.), entitled "Synthetic Jet Ejector with Viewing Window and Temporal Aliasing"; U.S. Pat. No. 7,784,972 (Heffington et al.), entitled "Thermal Management System for LED Array"; U.S. Pat. No. 7,819,556 (Heffington et al.), entitled "Thermal Management System for LED Array"; U.S. Pat. No. 7,932,535 (Mahalingam et al.), entitled "Synthetic Jet Cooling System for LED Module"; U.S. Pat. No. 8,030,886 (Mahalingam et al.), entitled "Thermal Management of Batteries Using Synthetic Jets"; U.S. Pat. No. 8,035,966 (Reichenbach et al.), entitled "Electronics Package for Synthetic Jet Ejectors"; U.S. Pat. No. 8,006,410 (Booth et al.), entitled "Light Fixture with Multiple LEDs and Synthetic Jet Thermal Management System"; U.S. Pat. No. 8,069,910 (Beltran et al.), entitled "Acoustic Resonator for Synthetic Jet Generation for Thermal Management"; and U.S. Pat. No. 8,136,576 (Grimm), entitled "Vibration Isolation System for Synthetic Jet Devices".

In addition to the foregoing, other advances have been made in the art of synthetic jet ejectors, both with respect to synthetic jet ejector technology in general and with respect to the applications of this technology. Some examples of these advances are described in U.S. 20100263838 (Mahalingam et al.), entitled "Synthetic Jet Ejector for Augmentation of Pumped Liquid Loop Cooling and Enhancement of Pool and Flow Boiling"; U.S. 20100039012 (Grimm), entitled "Advanced Synjet Cooler Design For LED Light Modules"; U.S. 20100033071 (Heffington et al.), entitled "Thermal Management of LED Illumination Devices"; U.S. 20090141065 (Darbin et al.), entitled "Method and Apparatus for Controlling Diaphragm Displacement in Synthetic Jet Actuators"; U.S. 20090109625 (Booth et al.), entitled Light Fixture with Multiple LEDs and Synthetic Jet Thermal Management System"; U.S. 20090084866 (Grimm et al.), entitled Vibration Balanced Synthetic Jet Ejector"; U.S. 20080219007 (Heffington et al.), entitled "Thermal Management System for LED Array"; U.S. 20080151541 (Heffington et al.), entitled "Thermal Management System for LED Array"; U.S. 20080043061 (Glezer et al.), entitled "Methods for Reducing the Non-Linear Behavior of Actuators Used for Synthetic Jets"; U.S. 20080009187 (Grimm et al.), entitled "Moldable Housing design for Synthetic Jet Ejector"; U.S. 20070096118 (Mahalingam et al.), entitled "Synthetic Jet Cooling System for LED Module"; U.S. 20070023169 (Mahalingam et al.), entitled "Synthetic Jet Ejector for Augmentation of Pumped Liquid Loop Cooling and Enhancement of Pool and Flow Boiling"; U.S. 20070119573 (Mahalingam et al.), entitled "Synthetic Jet Ejector for the Thermal Management of PCI Cards"; U.S. 20070119575 (Glezer et al.), entitled "Synthetic Jet Heat Pipe Thermal Management System"; U.S. 20070127210 (Mahalingam et al.), entitled "Thermal Management System for Distributed Heat Sources"; and U.S. 20070141453 (Mahalingam et al.), entitled "Thermal Management of Batteries using Synthetic Jets".

SUMMARY OF DISCLOSURE

In one aspect, an illumination device is provided which comprises (a) a light emitting portion; (b) an LED disposed within said light emitting portion; (c) a threaded connector module adapted to rotatingly engage said illumination device to a source of electricity; (d) a heat sink disposed between said light emitting portion and said connector module; and (e) a synthetic jet ejector disposed between said light emitting portion and said connector module.

In another aspect, an illumination device is provided which comprises (a) a housing having an LED disposed therein, wherein said housing is transmissive to light generated by said LED; (b) a threaded connector module which rotatingly engages a complimentary shaped electrical socket; (c) a heat sink disposed between said housing and said connector module, wherein said heat sink comprises a plurality of fins; and (d) a synthetic jet ejector which directs a synthetic jet into a channel formed by a pair of adjacent fins, wherein said synthetic jet ejector is disposed between said housing and said connector module.

DETAILED DESCRIPTION

Prior to describing the devices and methodologies described herein, a brief explanation of a typical synthetic jet ejector, and the manner in which it operates to create a synthetic jet, may be useful.

Figure 47:
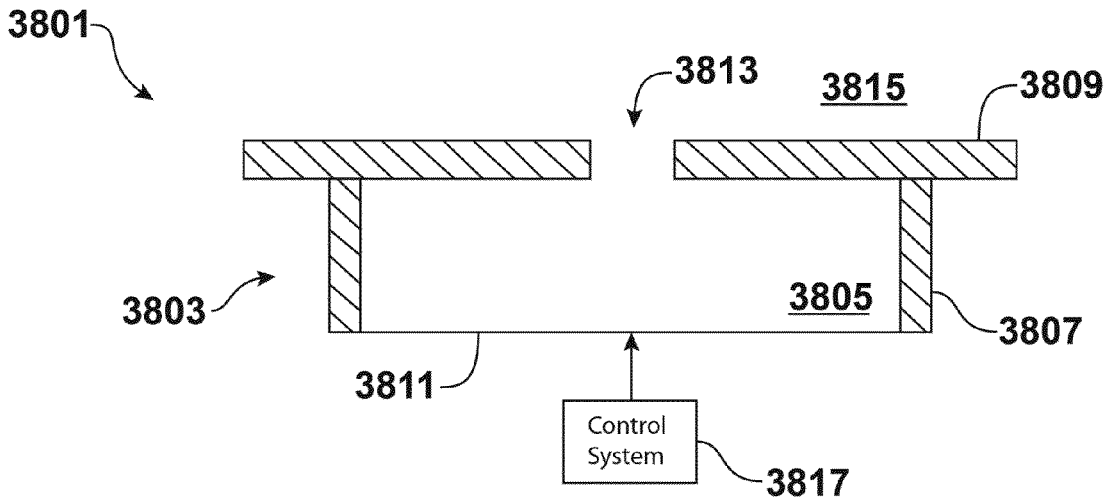
FIG. 47 is a schematic cross-sectional side view of a zero net mass flux synthetic jet actuator with a control system.
Figure 48:
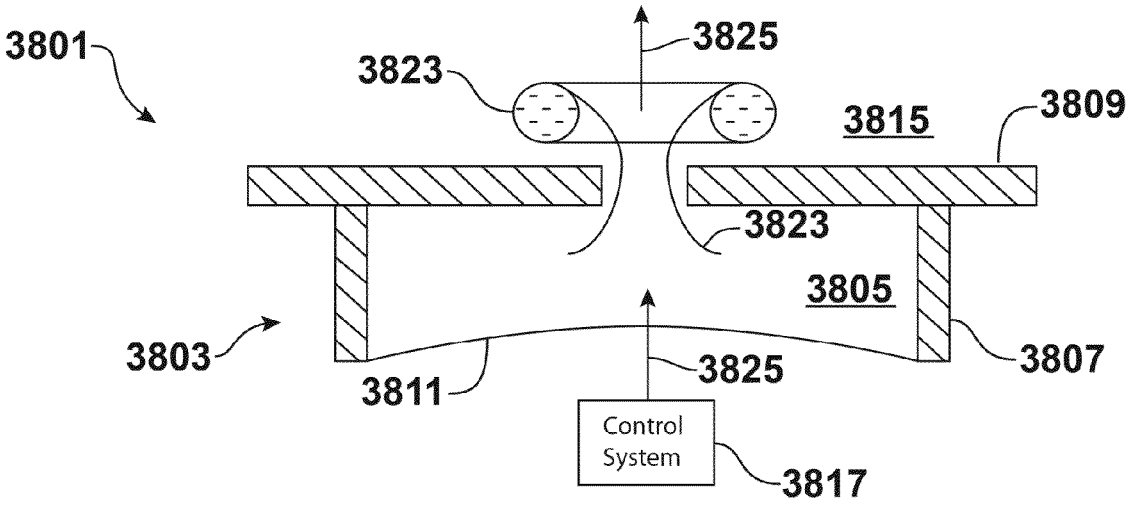
FIG. 48 is a schematic cross-sectional side view of the synthetic jet actuator of FIG. 1 depicting the jet as the control system causes the diaphragm to travel inward, toward the orifice.
Figure 49:
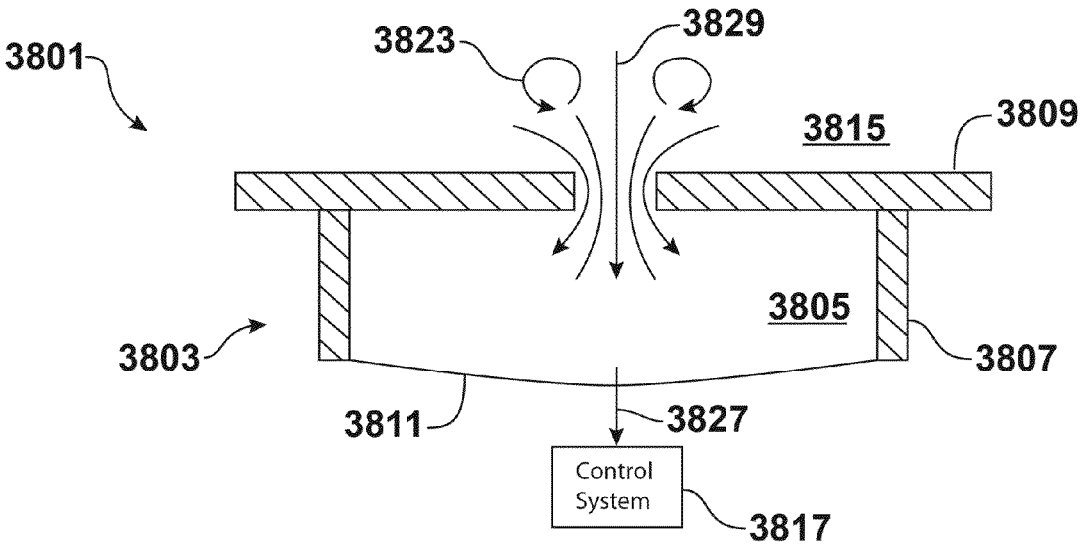
FIG. 49 is a schematic cross-sectional side view of the synthetic jet actuator of FIG. 1 depicting the jet as the control system causes the diaphragm to travel outward, away from the orifice.

The formation of a synthetic jet may be appreciated with respect to FIGS. 47 to 49. FIG. 47 depicts a synthetic jet ejector 3801 comprising a housing 3803 which defines and encloses an internal chamber 3805. The housing 3803 and chamber 3805 may take virtually any geometric configuration, but for purposes of discussion and understanding, the housing 3803 is shown in cross-section in FIG. 47 to have a rigid side wall 3807, a rigid front wall 3809, and a rear diaphragm 3811 that is flexible to an extent to permit movement of the diaphragm 3811 inwardly and outwardly relative to the chamber 3805. The front wall 3809 has an orifice 3813 therein (see FIG. 47) which may be of any geometric shape. The orifice 3813 diametrically opposes the rear diaphragm 3811 and fluidically connects the internal chamber 3805 to an external environment having ambient fluid 3815.

The movement of the flexible diaphragm 3811 may be controlled by any suitable control system 3817. For example, the diaphragm may be moved by a voice coil actuator. The diaphragm 3811 may also be equipped with a metal layer, and a metal electrode may be disposed adjacent to, but spaced from, the metal layer so that the diaphragm 3811 can be moved via an electrical bias imposed between the electrode and the metal layer. Moreover, the generation of the electrical bias can be controlled by any suitable device, for example but not limited to, a computer, logic processor, or signal generator. The control system 3817 can cause the diaphragm 3811 to move periodically or to modulate in time-harmonic motion, thus forcing fluid in and out of the orifice 3809.

Alternatively, a piezoelectric actuator could be attached to the diaphragm 3811. The control system would, in that case, cause the piezoelectric actuator to vibrate and thereby move the diaphragm 3811 in time-harmonic motion. The method of causing the diaphragm 3811 to modulate is not particularly limited to any particular means or structure.

The operation of the synthetic jet ejector 3811 will now be described with reference to FIGS. 48 and 39. FIG. 48 depicts the synthetic jet ejector 3801 as the diaphragm 3811 is controlled to move inward into the chamber 3805, as depicted by arrow 3819. The chamber 3805 has its volume decreased and fluid is ejected through the orifice 3809. As the fluid exits the chamber 3805 through the orifice 3809, the flow separates at the (preferably sharp) orifice edges and creates vortex sheets 3821. These vortex sheets 3821 roll into vortices 3823 and begin to move away from the edges of the orifice 3809 in the direction indicated by arrow 3825.

FIG. 49 depicts the synthetic jet ejector 3801 as the diaphragm 3811 is controlled to move outward with respect to the chamber 3805, as depicted by arrow 3827. The chamber 3805 has its volume increased and ambient fluid 3815 rushes into the chamber 3805 as depicted by the set of arrows 3829. The diaphragm 3811 is controlled by the control system 3817 so that, when the diaphragm 3811 moves away from the chamber 3805, the vortices 3823 are already removed from the orifice edges and thus are not affected by the ambient fluid 3815 being drawn into the chamber 3805. Meanwhile, a jet of ambient fluid 3815 is synthesized by the vortices 3823, thus creating strong entrainment of ambient fluid drawn from large distances away from the orifice 3809.

While thermal management systems which utilize synthetic jets to enhance cooling have many desirable properties, further improvements in these devices are required to meet evolving challenges in the art. For example, many host devices which require thermal management continue to shrink in size. Hence, there is a need in the art to provide thermal management solutions based on synthetic jet ejectors which have reduced dimensions, without sacrificing functionality.

It has now been found that some of the foregoing needs may be met by a thermal management system having a synthetic jet ejector and a heat sink, and in which the synthetic jet ejector and heat sink are combined into a single unit. This may be accomplished, for example, by a thermal management system design which comprises (a) a heat sink comprising a central chamber and having a plurality of heat fins disposed about the perimeter of said central chamber; (b) a synthetic jet actuator disposed in said central chamber; (c) a first plurality of conduits adapted to direct a first plurality of synthetic jets in a first direction across the surfaces of said heat fins; and (d) a second plurality of conduits adapted to direct a second plurality of synthetic jets in a second direction across the surfaces of said heat fins; wherein said first and second directions are essentially orthogonal. Such a configuration may provide improved thermal performance, while also allowing the device to be smaller and to have more entrainment.

It has further been found that some of the foregoing needs may be met through the provision of a light source which comprises (a) an Edison socket; (b) a heat sink disposed adjacent to said socket; and (c) a synthetic jet actuator disposed at least partially within said heat sink or at least partially within said socket, wherein said socket has at least one nozzle defined therein which is adapted to direct at least one synthetic jet across a surface of said heat sink. Currently, the Edison socket serves two functions, namely to make electrical contact to the main power and to house some electronics. In the design disclosed herein, however, some internal volume of the Edison socket is utilized to form synthetic jet nozzles for cooling the heat sink. Hence, the resulting Edison socket has built in nozzles for directing airflow over the heat sink.

It has also been found that some of the foregoing needs may be met through the provision of a heat sink as the synthetic jet actuator support structure. In order to reduce size and cost, if possible, it is advantageous to combine the function of multiple components of a synthetic jet actuator into one integrated component. Many existing synthetic jet actuators have various plastic support structures to support the diaphragm. It has now been found that these components may be designed as part of the heat sink, wherein the heat sink can be metal or can be injection molded with a thermally conductive polymeric composition. Alternatively, a similar end may be met by providing a metal substrate having a plurality of heat fins defined therein, and overmolding the metal substrate with a thermally conductive polymeric resin to form a heat sink containing a plurality of heat fins and having a first cavity defined therein which is in fluidic communication with the surfaces of said fins by way of a first set of channels.

It has further been found that some of the foregoing needs may be met with a thermal management system equipped with one or more diaphragms having a long surround with a small bend radius. Such a construction allows for a larger usable piston area and a smaller diameter assembly.

It has further been found that some of the foregoing needs may be met with an illumination device equipped with a translucent dome, an electrical connector and a heat sink disposed between the dome and the electrical connector. The heat sink is equipped with a synthetic jet ejector which ejects a first plurality of synthetic jets in a first direction along the surface of the illumination device, and a second plurality of synthetic jets in a second direction along the surface of the illumination device. The different directional movement of the jets allows for a circular airflow pattern around the illumination device. In some applications in which the illumination device is installed into a fixture, having jets formed to move air into the fixture may create thermal heating of the air and hence remove heat more efficiently from the illumination device.

It has also been found that some of the foregoing needs may be met with a heat sink design which allows for the compression fit assembly of a diaphragm to housing components. Such an assembly allows for a snap fit or threaded fit type of installation which eliminates the need for adhesives, overmolding or ultrasonic welding.

The devices and methodologies disclosed herein may be further understood with reference to the particular, non-limiting embodiments of the illumination devices depicted in FIGS. 1 through 35 herein. In these figures, like elements have been given like numerical identifiers. A listing of the numerical identifiers is attached hereto as APPENDIX A.

Figure 1:
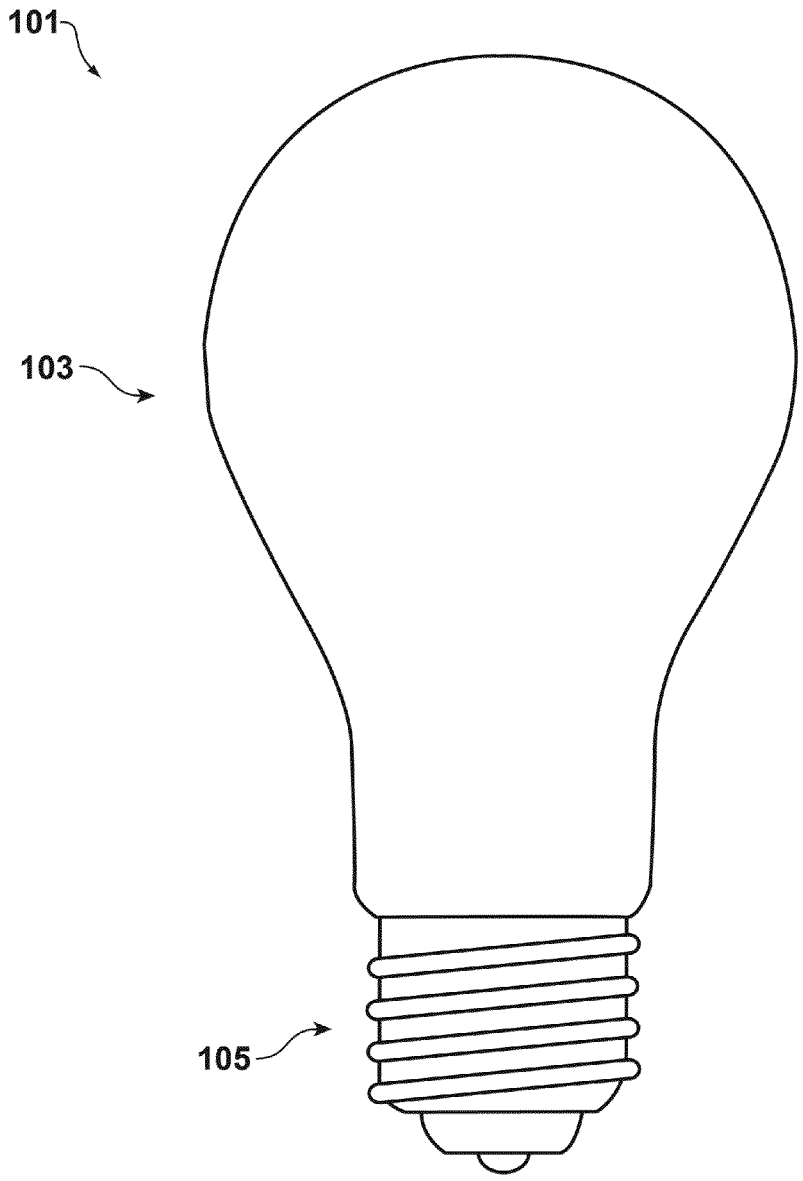
FIG. 1 is an illustration of an illumination device in accordance with the teachings herein.
Figure 2:
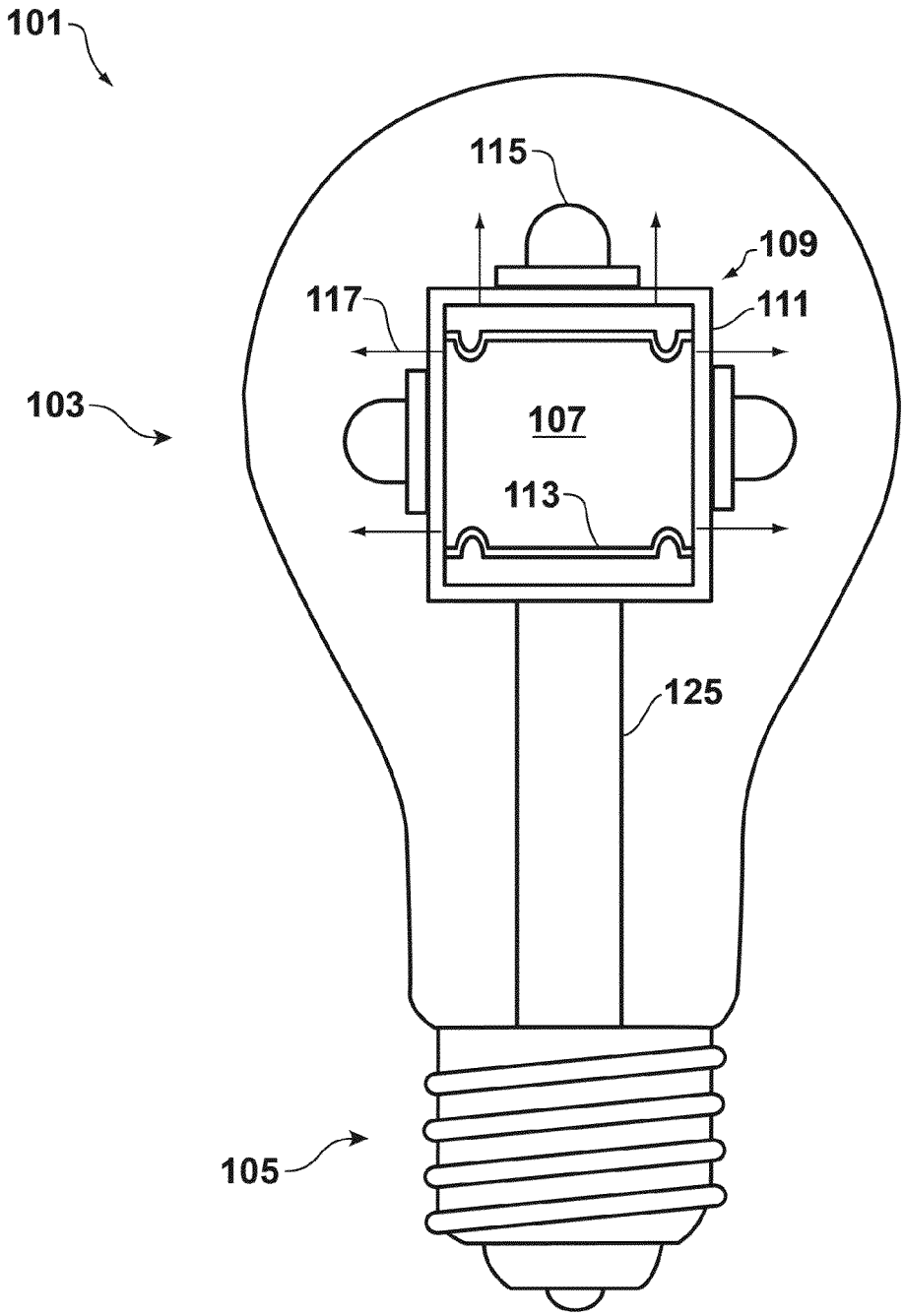
FIG. 2 is an illustration of an illumination device in accordance with the teachings herein.
Figure 3:
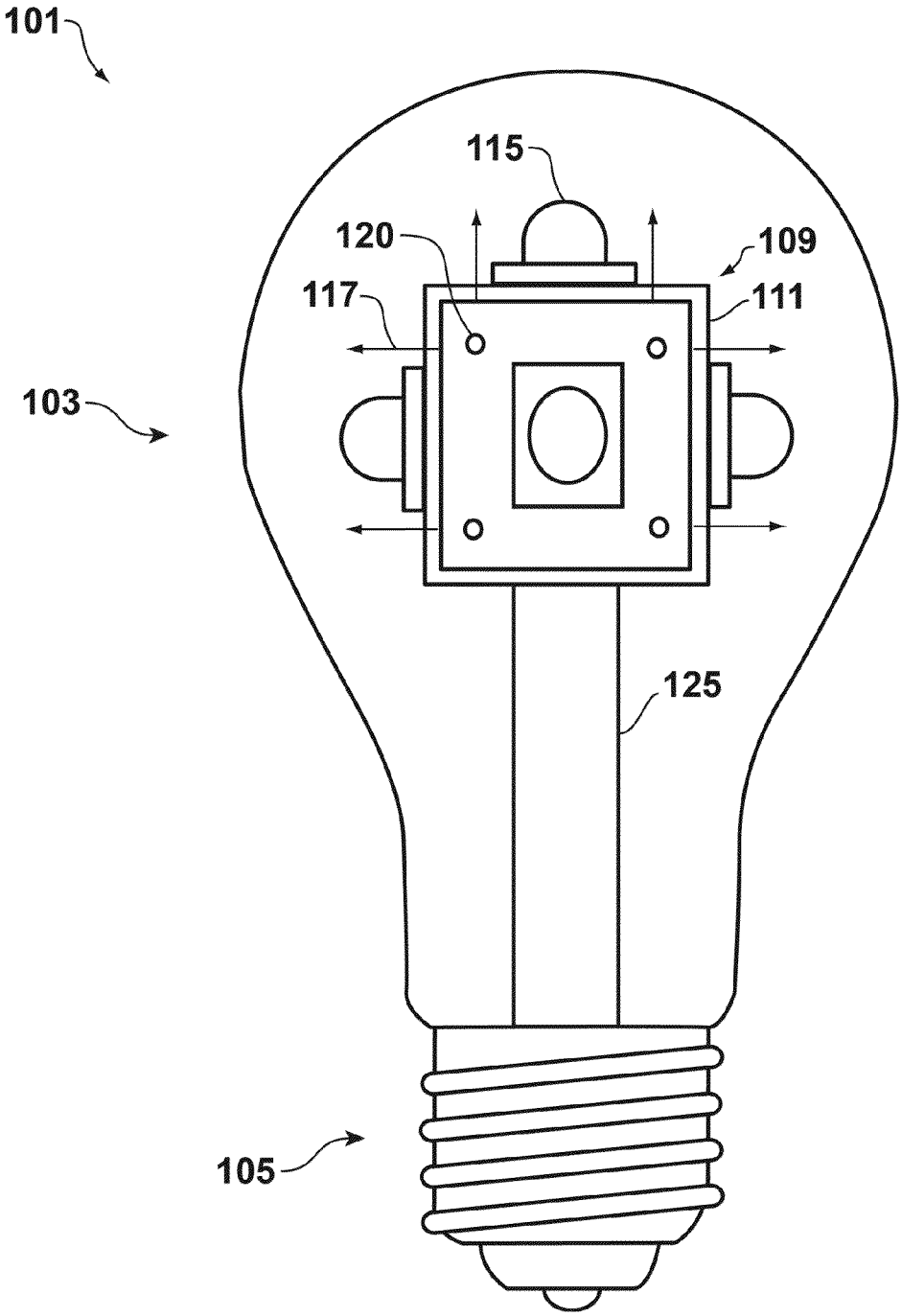
FIG. 3 is an illustration of an illumination device in accordance with the teachings herein.

FIGS. 1-3 depict a first particular, non-limiting embodiment of an LED-based illumination device in accordance with the teachings herein. As seen therein, the illumination device 101 comprises a light-emitting portion 103 which emits light, and a connector module 105 which connects the illumination device 101 to the electrical outlet of a light fixture. In the particular embodiment depicted, the connector module 105 is a threaded connector module that rotatingly engages a complimentary shaped socket in an electrical outlet (not shown), though it will be appreciated that the illumination devices disclosed herein are not necessarily limited to use in conjunction with such an outlet.

The light emitting portion 101 in this embodiment houses a pedestal 125 (see FIG. 2) upon which is disposed a synthetic jet ejector 109. The synthetic jet ejector 109 comprises a housing 111 which contains a set of diaphragms 113, and upon an exterior surface of which are disposed a plurality of LEDs 115. The set of diaphragms 113 operate to generate a plurality of synthetic jets 117, which are emitted from a plurality of apertures 120 (see FIG. 3) provided in the synthetic jet actuator housing 111, and which transfer heat from the LEDs to the interior of the light emitting portion 103. The apertures 120 may be disposed in a variety of suitable patterns around one or more of the LEDs 115, one particular example of which is depicted in FIG. 3. The heat in the interior of the light emitting portion 103 may then be transferred to the external environment through thermal transfer across the surface of the light emitting portion 103 or by other suitable means.

Figure 4:
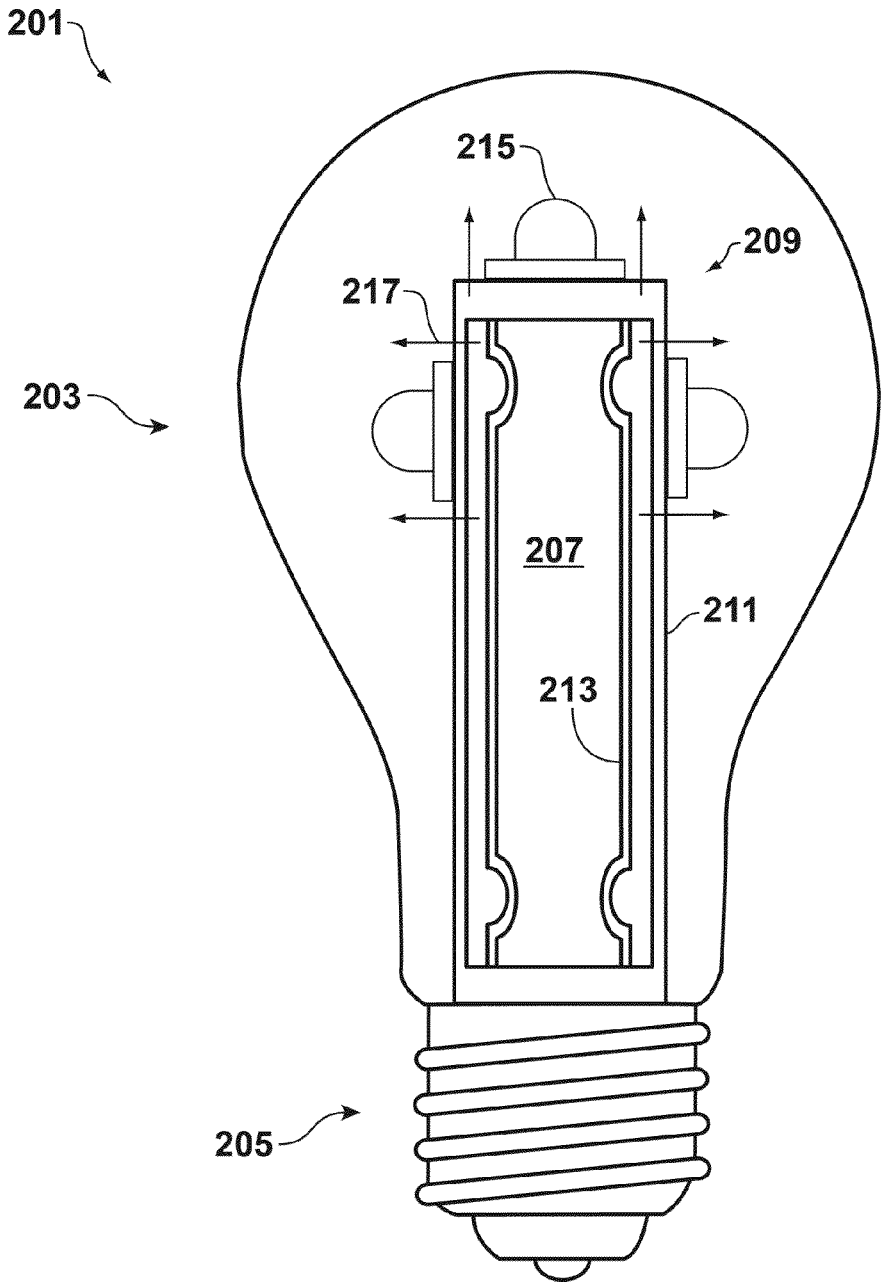
FIG. 4 is an illustration of an illumination device in accordance with the teachings herein.

FIG. 4 depicts another particular, non-limiting embodiment of an LED-based illumination device in accordance with the teachings herein is disclosed. As seen therein, the illumination device 201 comprises a light-emitting portion 203 which emits light, and a connector module 205 which connects the illumination device 201 to the electrical outlet of a light fixture. In the particular embodiment depicted, the connector module 205 is a threaded connector module that rotatingly engages a complimentary shaped socket in an electrical outlet (not shown), though it will be appreciated that the illumination devices disclosed herein are not necessarily limited to use in conjunction with such an outlet.

The light emitting portion 201 in this embodiment contains a synthetic jet actuator housing 211 which contains a set of diaphragms 213, and upon an exterior surface of which are disposed a plurality of LEDs 215. The set of diaphragms 213 operate to generate a plurality of synthetic jets 217, which are emitted from a plurality of apertures (not shown) provided in the synthetic jet actuator housing 211, and which transfer heat from the LEDs 215 to the interior of the light emitting portion 203. The apertures may be disposed in a variety of suitable patterns around one or more of the LEDs 215, one particular example of which is depicted in FIG. 4. The heat in the interior of the light emitting portion 203 may then be transferred to the external environment through thermal conduction, through the provision of apertures or vents in the light emitting portion 203, or by other suitable means.

The embodiment of FIG. 4 differs from the embodiment of FIGS. 1-3 in that the pedestal 125 of the embodiment of FIGS. 1-3 has essentially been replaced with the synthetic jet actuator housing 211. Such a construction allows for the use of larger diaphragms 213 which, in some applications and embodiments, may allow the synthetic jet actuator 207 to dissipate a larger amount of heat than a comparable device with smaller diaphragms 213.

Figure 5:
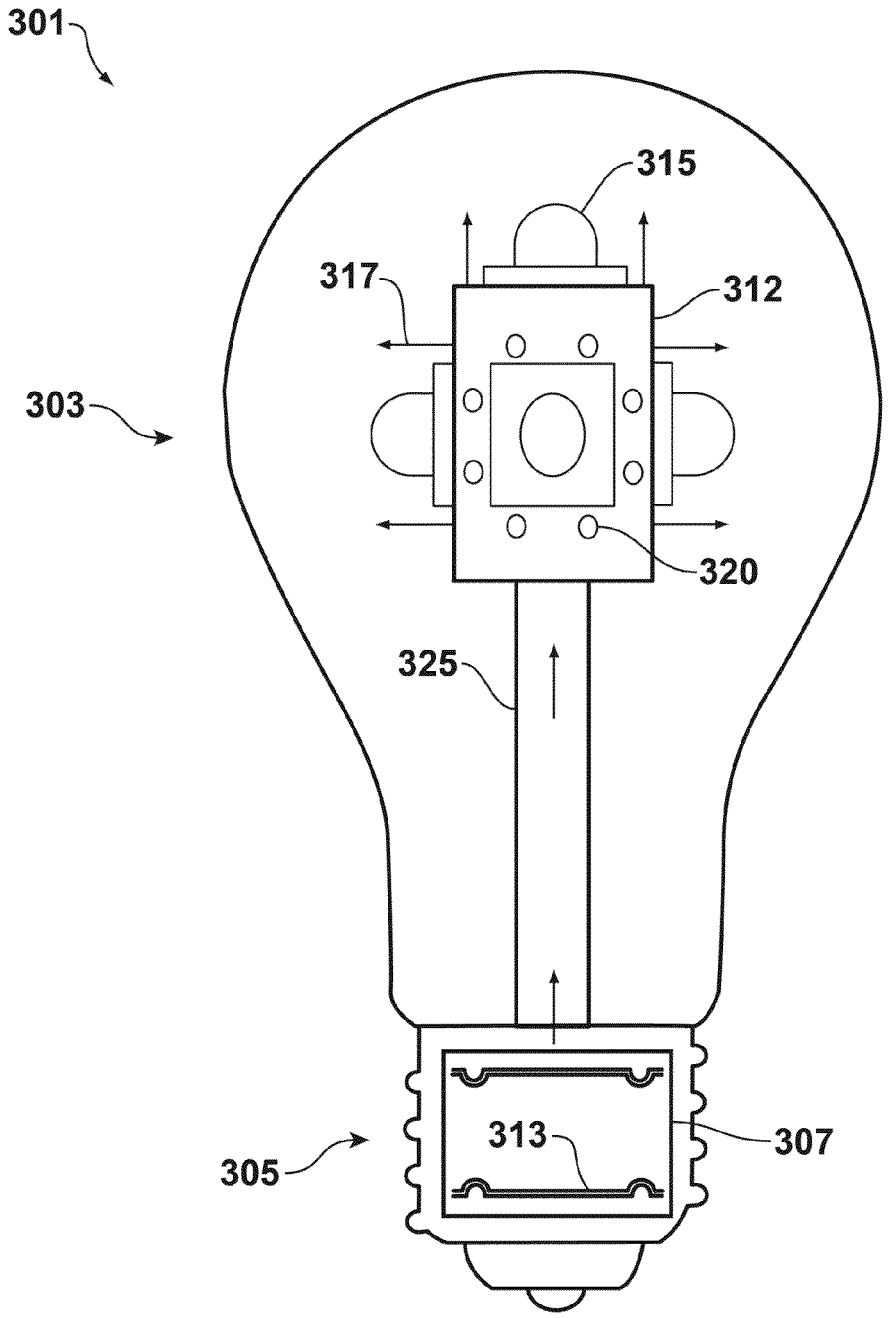
FIG. 5 is an illustration of an illumination device in accordance with the teachings herein.

FIG. 5 depicts another particular, non-limiting embodiment of an LED-based illumination device in accordance with the teachings herein. As seen therein, the illumination device 301 comprises a light-emitting portion 303 which emits light, and a connector module 305 which connects the illumination device 301 to the electrical outlet of a light fixture. In the particular embodiment depicted, the connector module 305 is a threaded connector module that rotatingly engages a complimentary shaped socket in an electrical outlet (not shown), though it will be appreciated that the illumination devices disclosed herein are not necessarily limited to use in conjunction with such an outlet.

The connector module 305 in this embodiment contains a synthetic jet actuator 307 which is equipped with a set of diaphragms 313. The synthetic jet actuator 307 is in fluidic communication with a pedestal 325 which is equipped on one end with a plenum 312. The plenum 312 is equipped with a plurality of apertures 320, and has a plurality of LEDs 315 disposed on an exterior surface thereof. The set of diaphragms 313 operate to generate a plurality of synthetic jets 317, which are emitted from a plurality of apertures 320 provided in the plenum 312, and which transfer heat from the LEDs 315 to the interior of the light emitting portion 303. The apertures 320 may be disposed in a variety of suitable patterns around one or more of the LEDs 315. The heat in the interior of the light emitting portion 303 may then be transferred to the external environment through thermal conduction, through the provision of apertures or vents in the light emitting portion 303, or by other suitable means.

The embodiment of FIG. 5 differs from the embodiment of FIGS. 1-3 in that the synthetic jet actuator 307 has been moved from the light emitting portion 303 of the device to the connector module 305. This arrangement is advantageous in some applications in that more of the interior space of the light emitting portion 303 is available for other purposes. It will be appreciated that this embodiment may offer greater flexibility in some applications with respect to the size and dimensions of the plenum 312, and the manner in which the LEDs 315 are disposed thereon.

Figure 6:
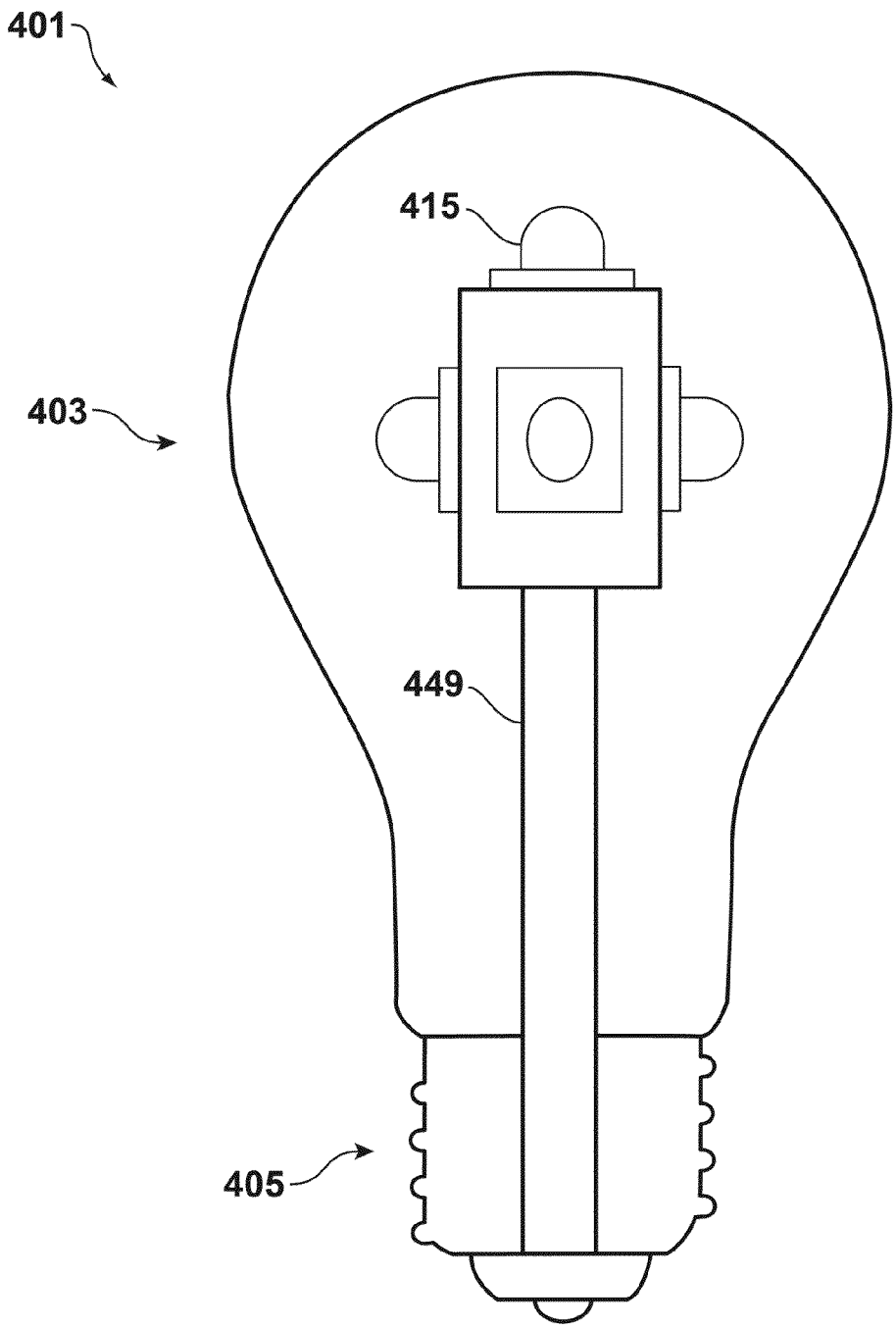
FIG. 6 is an illustration of an illumination device in accordance with the teachings herein.

FIG. 6 depicts another particular, non-limiting embodiment of an LED-based illumination device in accordance with the teachings herein. The illumination device 401 depicted therein comprises a light-emitting portion 403 which emits light, and a connector module 405 which connects the illumination device 401 to the electrical outlet of a light fixture.

This embodiment is similar to the embodiment of FIG. 3, except that the pedestal 125 of that embodiment has been replaced with a heat pipe 449. The heat pipe 449 is preferably in thermal communication with the connector module 405. A plurality of LEDs 415 are disposed on one end of the heat pipe 449. In some variations of this embodiment, the LEDs 415 may be mounted on a portion of the heat pipe 449 or on a thermally conductive substrate which is in thermal contact with the heat pipe 449. In some instances, this thermally conductive substrate may be the housing of a synthetic jet ejector or plenum thereof as in FIGS. 2-3, though variations of this embodiment are also contemplated which are devoid of a synthetic jet ejector.

Figure 7:
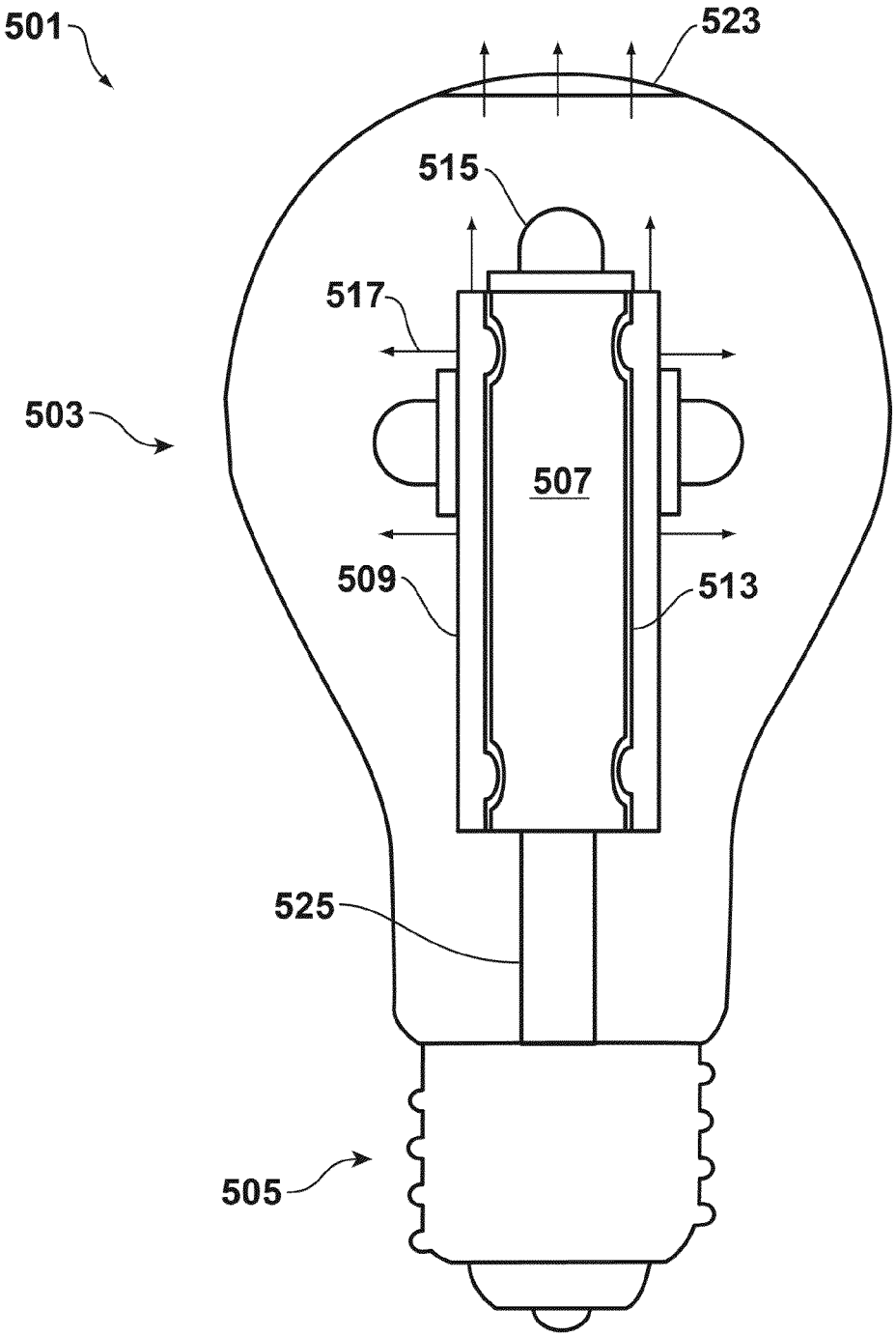
FIG. 7 is an illustration of an illumination device in accordance with the teachings herein.

FIG. 7 depicts another particular, non-limiting embodiment of an LED-based illumination device in accordance with the teachings herein. The illumination device 501 depicted therein comprises a light-emitting portion 503 which emits light, and a connector module 505 which connects the illumination device 501 to the electrical outlet of a light fixture.

The illumination device 501 in this embodiment is a hybrid of the embodiments depicted in FIGS. 2 and 4. In particular, this embodiment utilizes a vertical arrangement of the diaphragms 513 in the synthetic jet ejector 509, but also utilizes a pedestal 525. In some variations, the pedestal 525 may be replaced with, or may include, a heat pipe.

The illumination device 501 in this embodiment is also equipped with a vent 523 which allows the atmosphere inside of the light emitting portion 503 to be in fluidic communication with the external atmosphere. In some variations of this embodiment, the synthetic jet ejector 509 may be adapted to emit synthetic jets from apertures in the vent 523, either solely or in addition to emitting synthetic jets 517 from the actuator housing 511.

Figure 8:
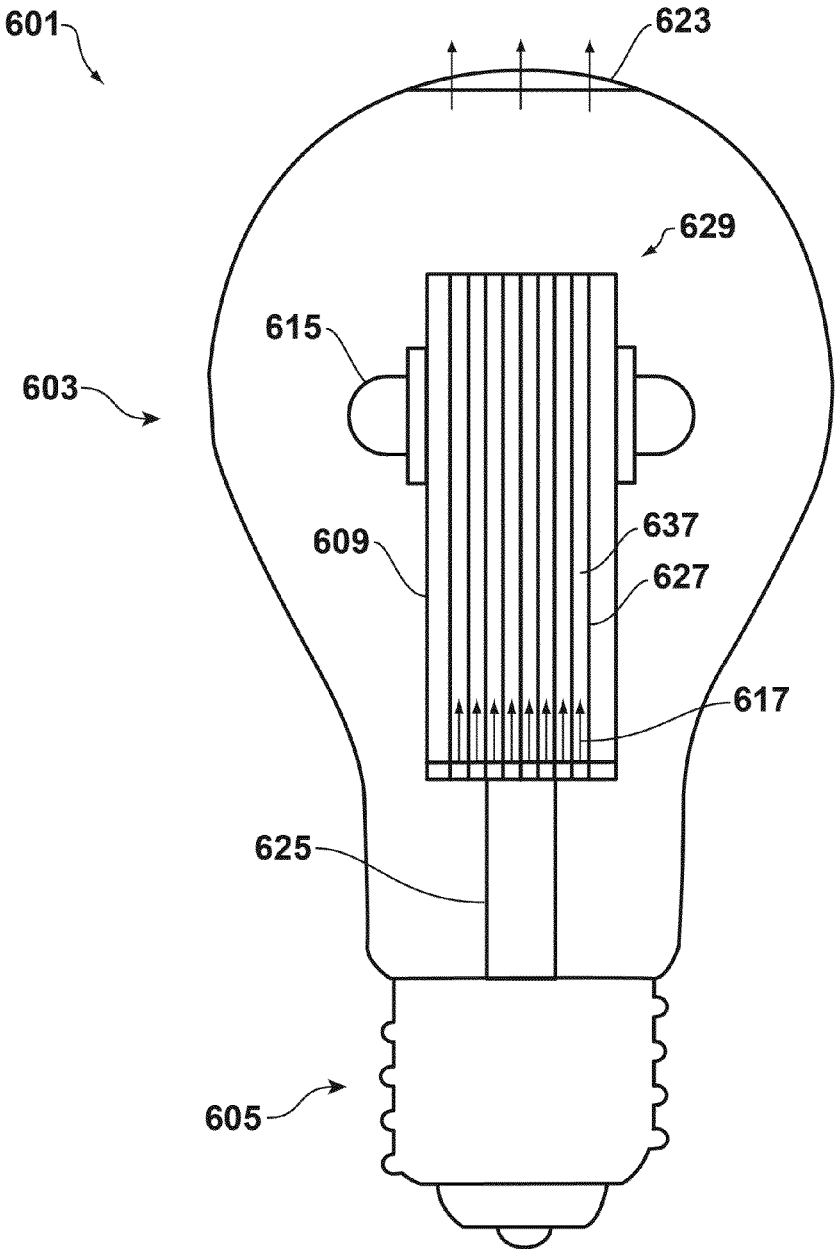
FIG. 8 is an illustration of an illumination device in accordance with the teachings herein.

FIG. 8 depicts another particular, non-limiting embodiment of an LED-based illumination device in accordance with the teachings herein. The illumination device 601 depicted therein comprises a light-emitting portion 603 which emits light, and a connector module 605 which connects the illumination device 601 to the electrical outlet of a light fixture.

The illumination device 601 in this embodiment is similar in many respects to the illumination device 501 of FIG. 7, but is equipped on an external surface thereof with a series of heat fins 627. The synthetic jet ejector 609 in this embodiment is adapted to direct a synthetic jet 617 into each channel 637 defined by an opposing pair of heat fins 627. The illumination device 601 in this embodiment is also equipped with a vent 623 which brings the atmosphere inside of the light emitting portion 603 into fluidic communication with the external atmosphere. In some variations of this embodiment, the synthetic jet ejector 609 may be adapted to emit synthetic jets from apertures in the vent 623 in addition to the synthetic jets 617 which are emitted from the synthetic jet ejector 609.

Figure 9:
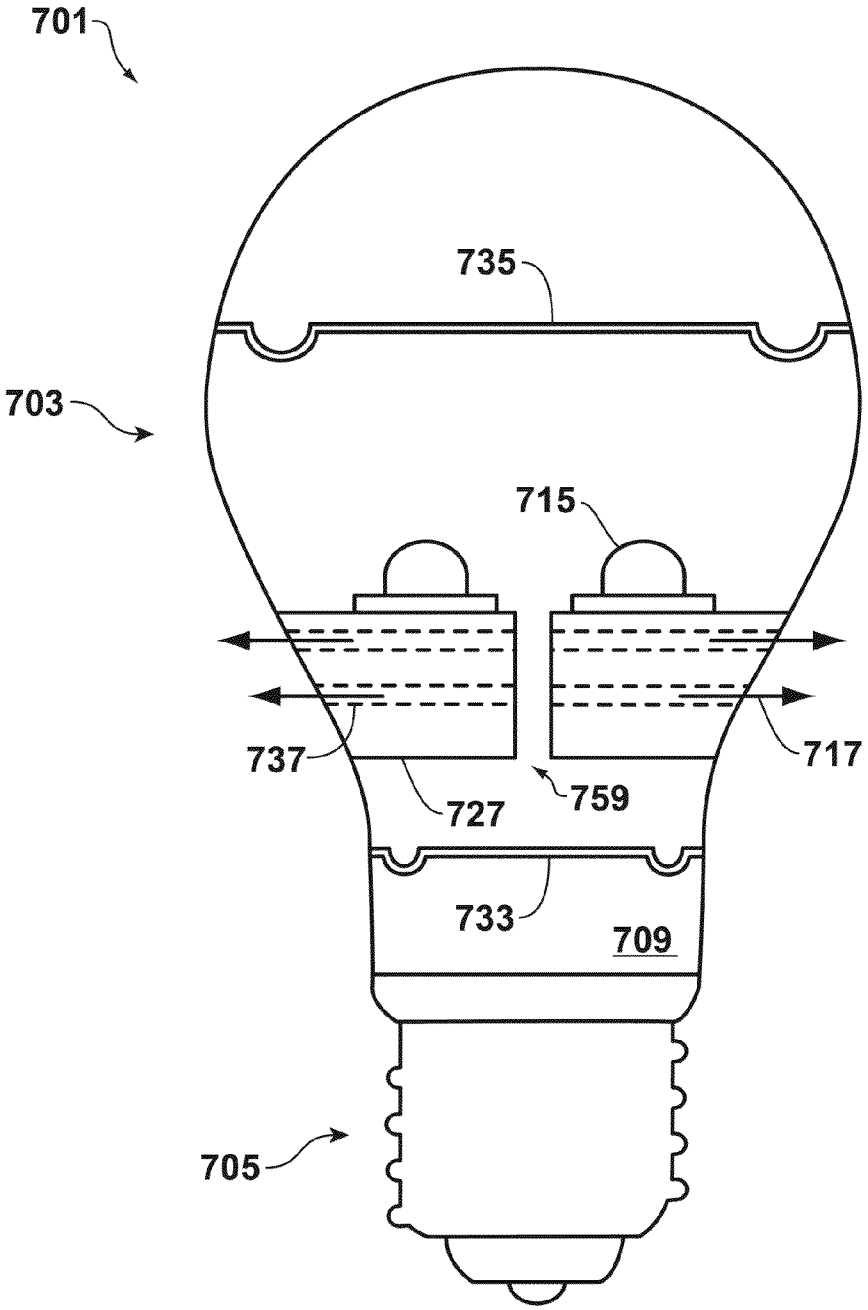
FIG. 9 is an illustration of an illumination device in accordance with the teachings herein.

FIG. 9 depicts another particular, non-limiting embodiment of an LED-based illumination device in accordance with the teachings herein. The illumination device 701 depicted therein comprises a light-emitting portion 703 which emits light, and a connector module 705 which connects the illumination device 701 to the electrical outlet of a light fixture.

The light emitting portion 701 in this embodiment contains an active diaphragm 733 and a passive diaphragm 735 which are in fluidic communication with each other. A heat sink 759 comprising at least one heat fin 727 is disposed between the active diaphragm 733 and the passive diaphragm 735 and has a plurality of LEDs 715 disposed thereon. Each heat fin 727 has at least one channel 737 defined therein which is in fluidic communication with the environment external to the light emitting portion.

In operation, the active diaphragm 733 vibrates to produce a plurality of synthetic jets 717 in the air passing through the channels 737 and into the external environment. Hence, as the heat fins 727 absorb heat from the LEDs 715 mounted on the heat sink 759, this operation ensures that the heat is efficiently transferred to the external environment through the turbulent flow created by the synthetic jets 717. During operation, the larger passive diaphragm 735 basically serves as a counterweight to the active diaphragm 733, which allows the synthetic jet actuator 709 to provide sufficient heat flux while operating outside of the audible range and producing fewer vibrations.

The passive diaphragm 735 preferably has the same mass as the active diaphragm 733, although the dimensions of the two diaphragms may be the same or different. The passive diaphragm 735 may also be of the same or different construction as the active diaphragm 733. In some implementations of the embodiment, the passive diaphragm 735 may comprise a transparent or translucent material.

Figure 10:
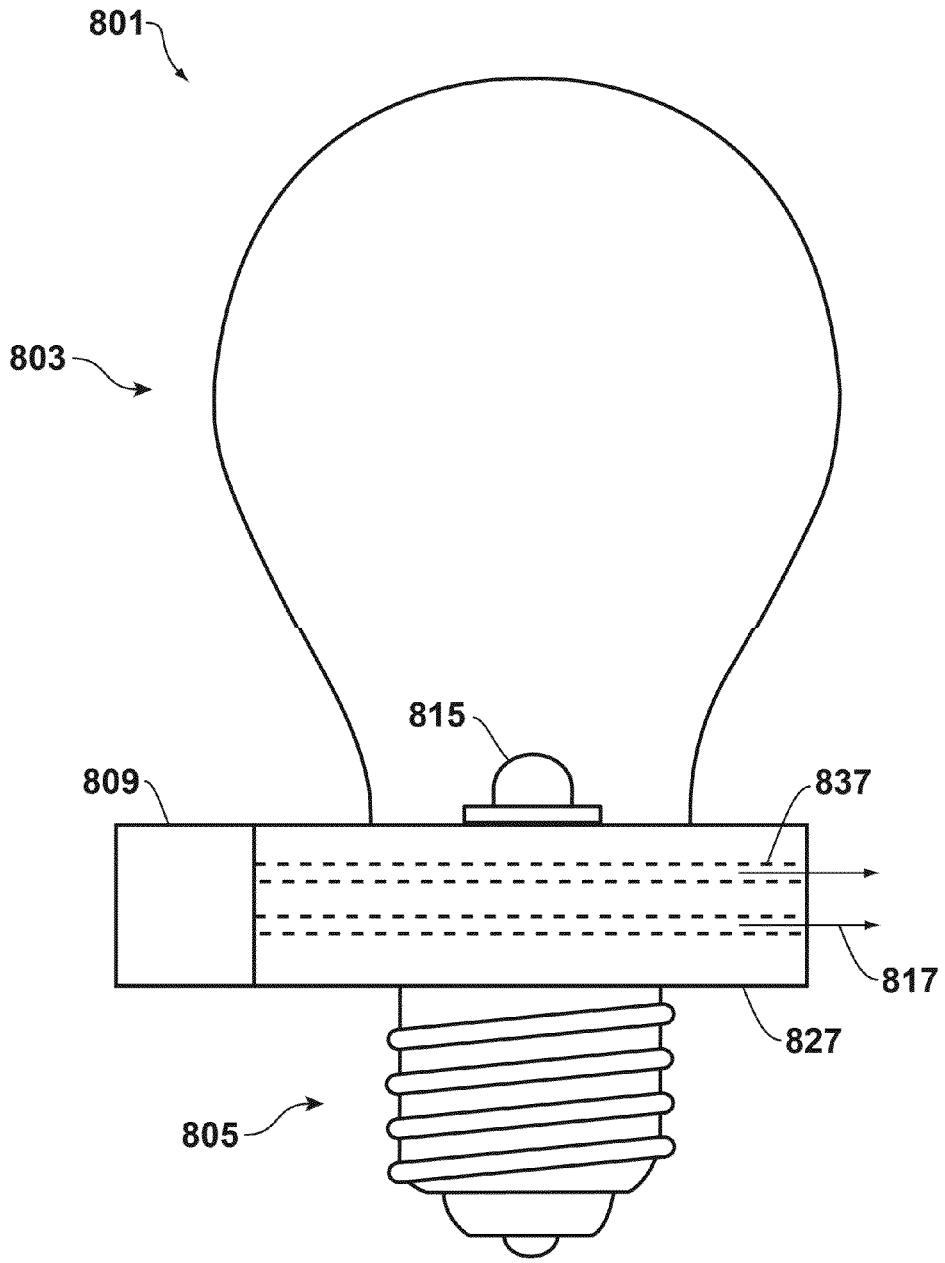
FIG. 10 is an illustration of an illumination device in accordance with the teachings herein.

FIG. 10 depicts another particular, non-limiting embodiment of an LED-based illumination device in accordance with the teachings herein. The illumination device 801 depicted therein comprises a light-emitting portion 803 which emits light, and a connector module 805 which connects the illumination device 801 to the electrical outlet of a light fixture.

The illumination device 801 in this embodiment is equipped with a combination synthetic jet ejector/heat sink 829 which contains both a synthetic jet ejector 809 and a heat sink 827. These two components may be combined in a variety of ways, and each of these components, or the combination thereof, may have a variety of shapes or sizes. The two components may also comprise a variety of materials, though the heat sink 827 preferably comprises a thermally conductive material such as a metal (such as, for example, copper, aluminum, tin, steel, or various combinations or alloys thereof) or a thermally conductive loaded polymer. In the particular embodiment depicted, however, the heat sink 827 extends from one side of the synthetic jet ejector 809 and is adapted to direct synthetic jets 817 through channels 837 defined in the heat sink 827. Since the LED 815 is mounted on top of the heat sink 827 and is in thermal communication therewith, this arrangement transfers heat from the LED 815 to the atmosphere external to the illumination device 801.

In the embodiment depicted in FIG. 10, the light emitting portion 803 is preferably mounted on top of the heat sink 827 and may be open to the external atmosphere or may be vacuum sealed. Appropriate channels or conduits may be provided in the heat sink to accommodate any wires or circuitry associated with the LED 815. In some variations of this embodiment, however, the combination synthetic jet ejector/heat sink 829, the heat sink 827, or the synthetic jet ejector 809 may be disposed on an external surface of the illumination device 801. In such embodiments, if the heat sink 827 is disposed on an exterior surface of the illumination device 801, the LED 815 may be in thermal contact with the heat sink 827 through one or more heat pipes or other thermally conductive elements.

Figure 11:
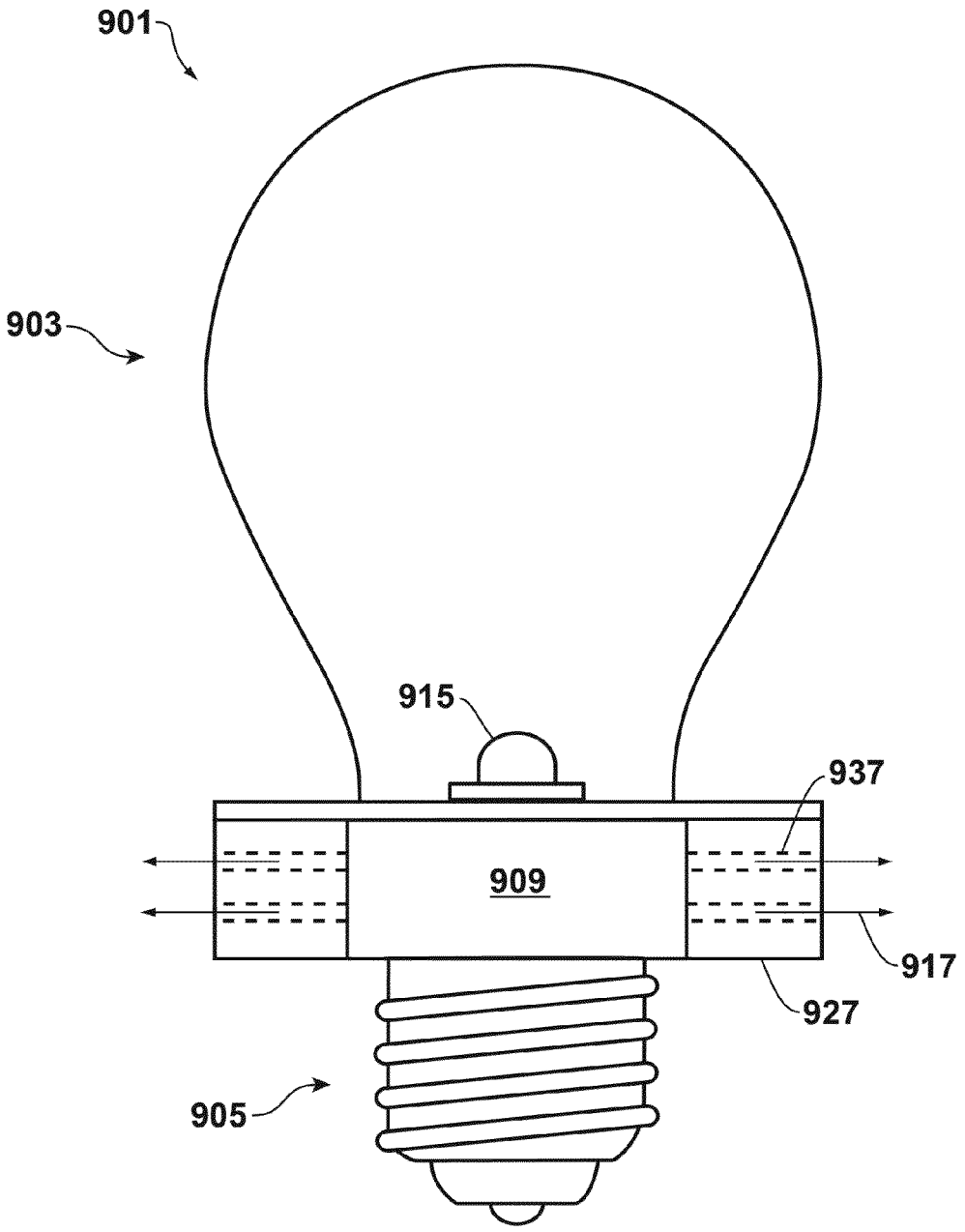
FIG. 11 is an illustration of an illumination device in accordance with the teachings herein.

FIG. 11 depicts another particular, non-limiting embodiment of an LED-based illumination device in accordance with the teachings herein. The illumination device 901 depicted therein comprises a light-emitting portion 903 which emits light, and a connector module 905 which connects the illumination device 901 to the electrical outlet of a light fixture.

The illumination device 901 of this embodiment is similar in most respects to the illumination device 801 of FIG. 11 and hence is equipped with a combination synthetic jet ejector/heat sink 829 which contains both a synthetic jet ejector 809 and a heat sink 827. However, the illumination device 901 in this embodiment differs from the illumination device 901 of FIG. 10 in that the synthetic jet ejector 909 is centrally located. In some implementations, this type of embodiment may facilitate integration of the circuitry of the synthetic jet ejector 909 with the circuitry used to power the LED 915.

Figure 12:
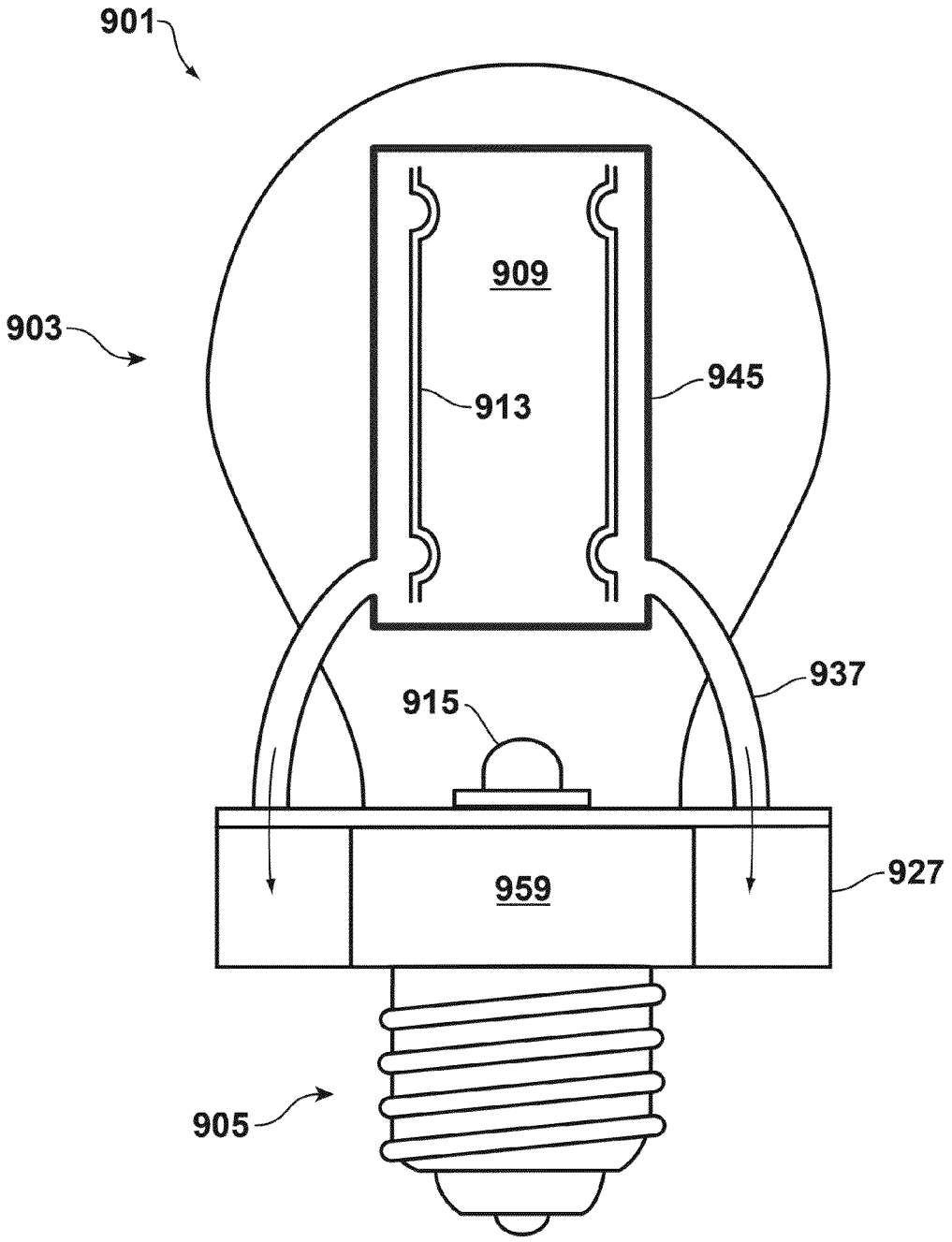
FIG. 12 is an illustration of an illumination device in accordance with the teachings herein.

FIG. 12 depicts a further particular, non-limiting embodiment of an LED-based illumination device in accordance with the teachings herein. The illumination device 1001 depicted therein comprises a light-emitting portion 1003 which emits light, and a connector module 1005 which connects the illumination device 1001 to the electrical outlet of a light fixture.

In this embodiment, a heat sink 1059 is disposed about the exterior of the light emitting portion 1003 and the synthetic jet ejector 1009 is disposed within the light emitting portion 1003. However, the synthetic jet ejector 1009 is in fluidic communication with the heat sink 1059 by way of one or more channels 1037. In the particular embodiment depicted, these channels 1037 extend from the interior of the light emitting portion to the exterior of the light emitting portion 1003, and are adapted to direct one or more synthetic jets across the surfaces of the heat sink 1059 or the heat fins 1027 thereof.

Figure 13:
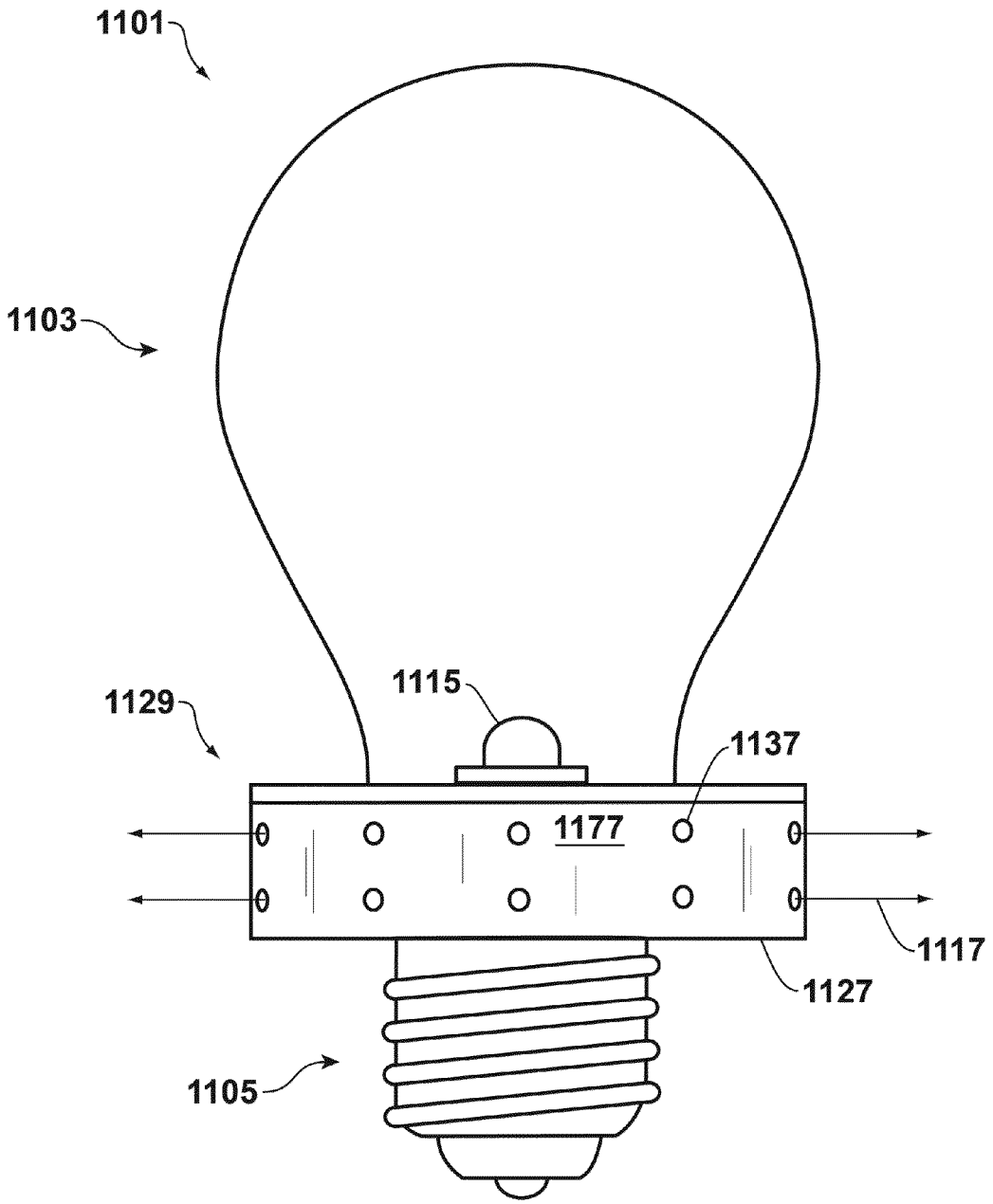
FIG. 13 is an illustration of an illumination device in accordance with the teachings herein.

FIG. 13 depicts another particular, non-limiting embodiment of an LED-based illumination device in accordance with the teachings herein. The illumination device 1101 depicted therein comprises a light-emitting portion 1103 which emits light, and a connector module 1105 which connects the illumination device 1101 to the electrical outlet of a light fixture.

The illumination device 1101 of this embodiment is similar in most respects to the illumination device 901 of FIG. 11 and hence is equipped with a combination synthetic jet ejector/heat sink 1129 (shown in greater detail in FIG. 14) which contains both a synthetic jet actuator 1107 and a heat sink 1159. However, the illumination device 1101 in this embodiment differs from the illumination device 801 of FIG. 11 in that the heat sink 1127 is covered with a smooth exterior surface having a plurality of apertures 1123 defined therein (see FIG. 13). These apertures 1123 are in fluidic communication with the synthetic jet actuator 1107 by way of channels 1137 defined in the heat sink 1127 (see FIG. 14). This type of embodiment may be advantageous in applications where the presence of exposed heat fins on the exterior of the illumination device 1101 would be objectionable or undesirable.

Figure 15:
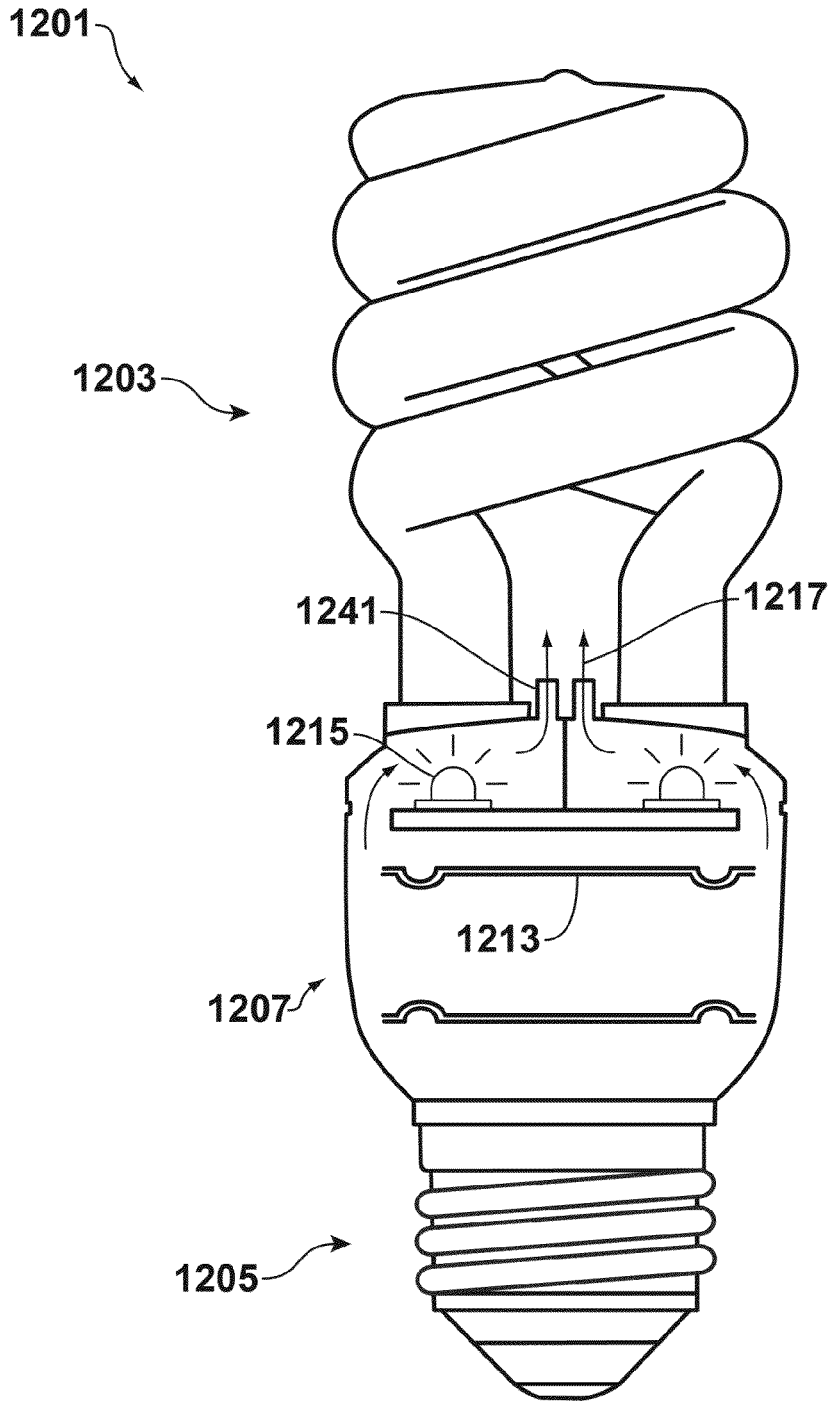
FIG. 15 is an illustration of an illumination device in accordance with the teachings herein.
Figure 16:
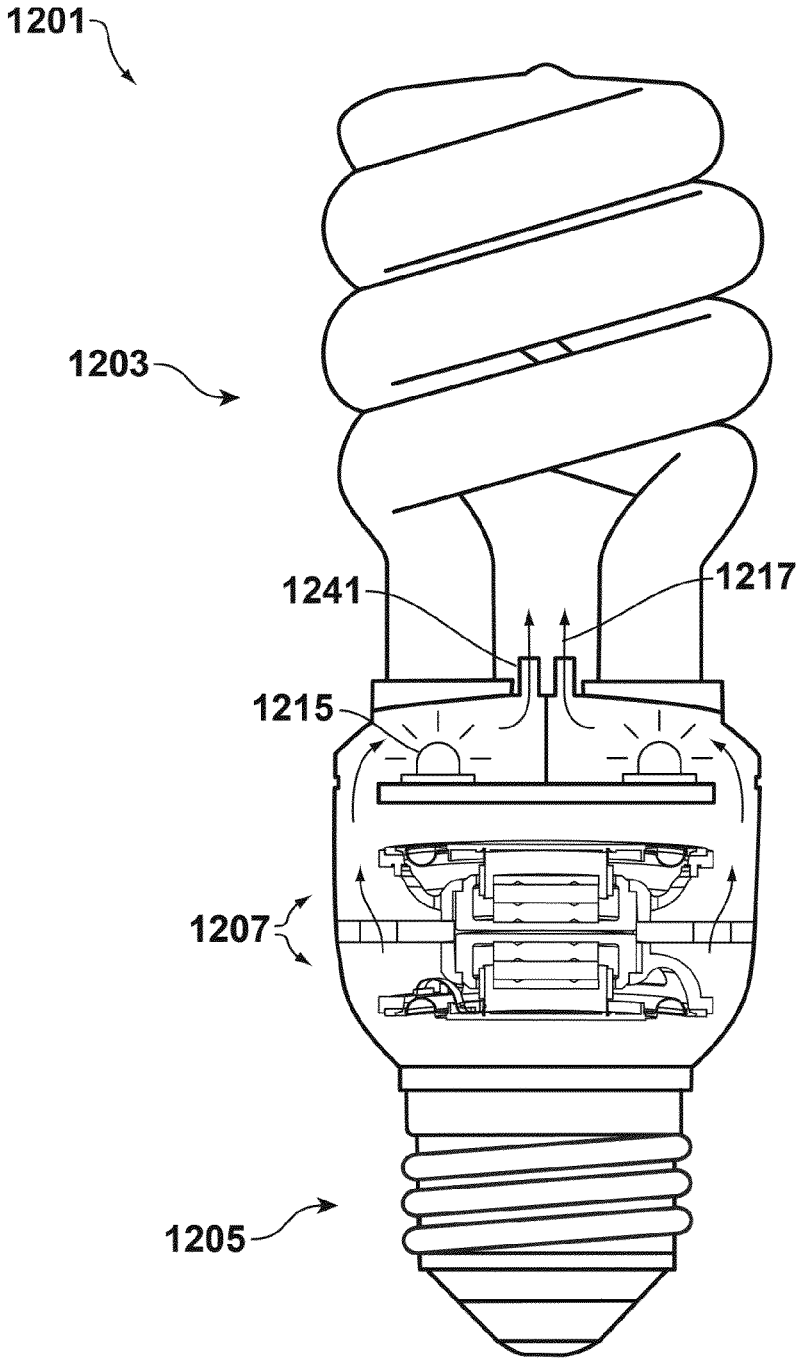
FIG. 16 is an illustration of an illumination device in accordance with the teachings herein.

FIGS. 15 to 16 depict a further particular, non-limiting embodiment of an LED-based illumination device in accordance with the teachings herein. The illumination device 1201 depicted therein comprises a light-emitting portion 1203 which emits light, and a connector module 1205 which connects the illumination device 1201 to the electrical outlet of a light fixture. A synthetic jet actuator 1207 is disposed between the light emitting portion and the connector module 1205.

This embodiment illustrates the application of the principles described herein to a popular type of compact fluorescent light bulb. The synthetic jet actuator 1207 in this embodiment is equipped with a set of nozzles 1241 which are adapted to direct a plurality of synthetic jets 1217 across the surfaces, or into the interior of, the helical coil of the light emitting portion 1203. The nozzles 1241 are in fluidic communication with the interior of the synthetic jet actuator 1207 where the diaphragms 1213 are disposed, and the LEDs 1215 which illuminate the light emitting portion 1203 are disposed in, or adjacent to, this fluidic path.

In operation, the synthetic jet actuator 1207 operates to create a fluidic flow adjacent to, or across the surfaces of, the LEDs 1215, thereby removing heat from the LEDs and rejecting it to the external environment. The hot fluid is ejected as a synthetic jet 1217, and hence is removed a significant distance from the nozzles 1241. The synthetic jets also entrain cool air from the local environment and create a turbulent flow around the surfaces of the helix of the light emitting portion, thus helping to cool this portion of the illumination device 1201 as well. The synthetic jets also draw in cool fluid around the nozzles 1241, which is then drawn into the synthetic jet ejector during the in-flow phase of the diaphragms 1213.

Figure 17:
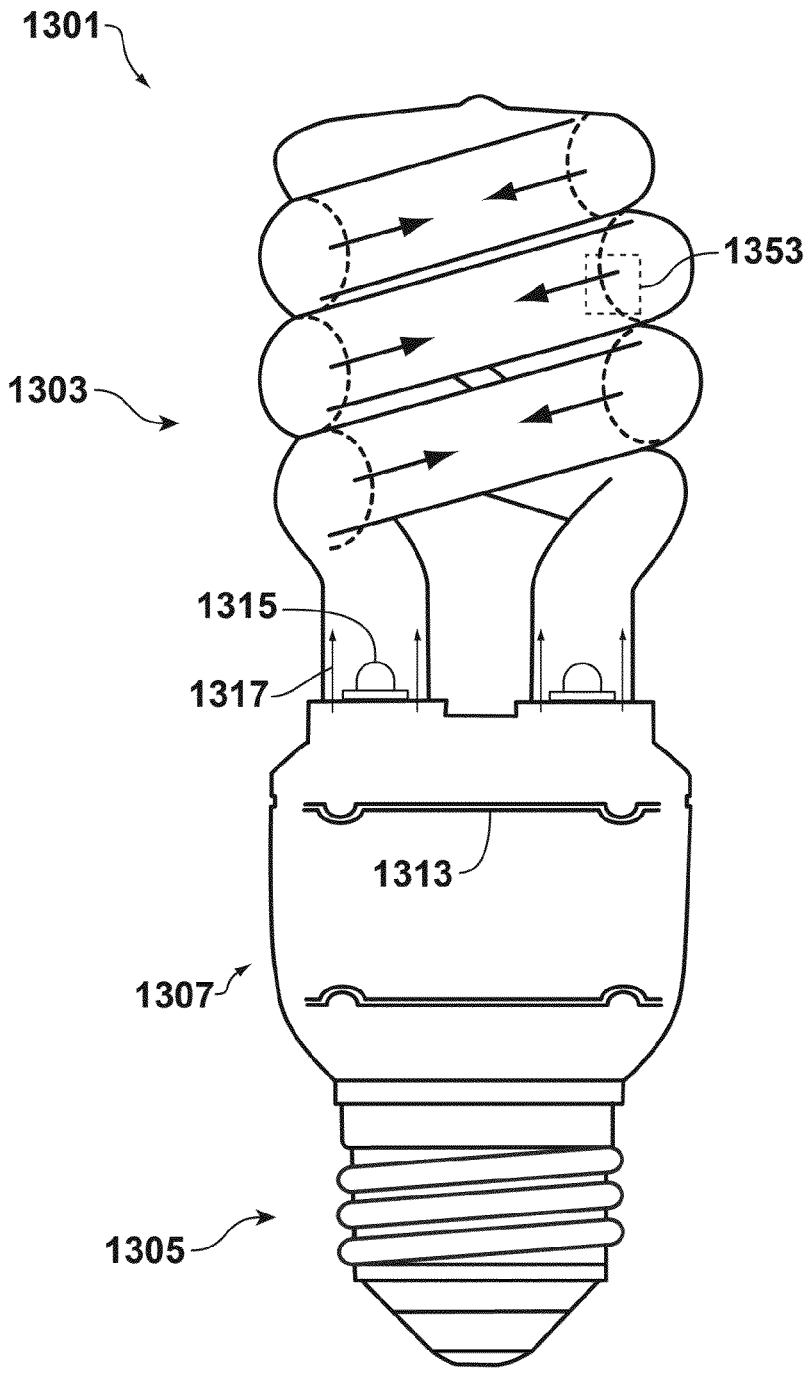
FIG. 17 is an illustration of an illumination device in accordance with the teachings herein.
Figure 18:
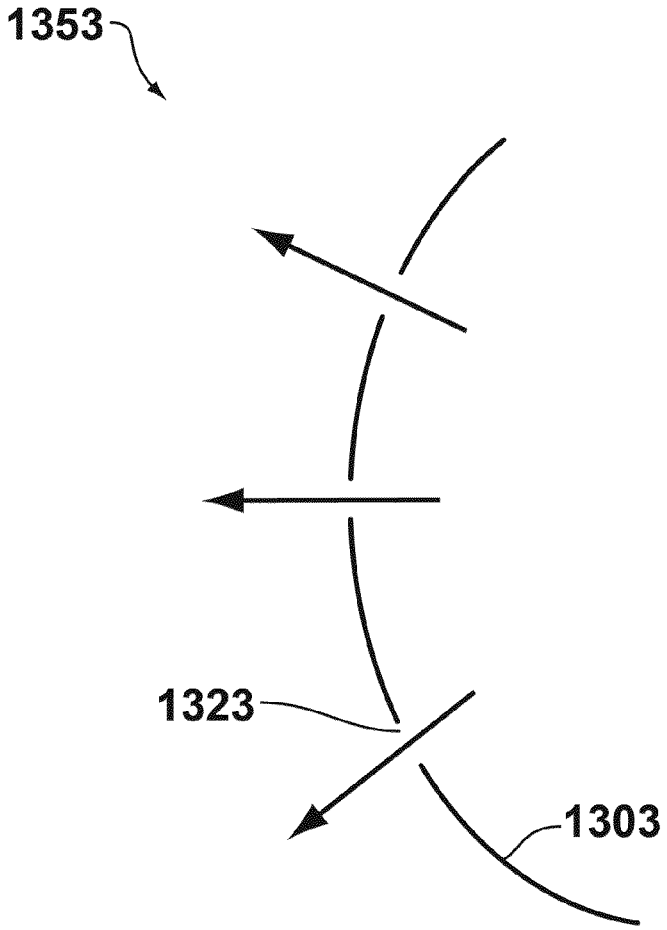
FIG. 18 is an illustration of a portion of the housing structure of the illumination device of FIG. 17.

FIGS. 17 to 18 depict another particular, non-limiting embodiment of an LED-based illumination device in accordance with the teachings herein. The illumination device 1301 depicted therein comprises a light-emitting portion 1303 which emits light, and a connector module 1305 which connects the illumination device 1301 to the electrical outlet of a light fixture. A synthetic jet actuator 1307 is disposed between the light emitting portion and the connector module 1305.

The illumination device of FIGS. 17 to 18 is similar in many respects to the illumination device 1201 of FIGS. 15 to 16. However, in the embodiment of FIGS. 17 to 18, the LEDs 1315 are disposed at entrances to the helical light emitting portion 1303, and the synthetic jet actuator 1307 operates to direct synthetic jets 1317 past the LEDs and into the light emitting portion 1303. As best seen in FIG. 18, region 1353 of the light emitting portion 1303 is equipped with a series of apertures 1323 which vent the fluidic flow to the external atmosphere. The vented flow may be in the form of one or more synthetic jets, but need not be so.

Various modifications may be made to the embodiment depicted in FIGS. 17 to 18. For example, in some variations, a single LED 1315 may be utilized to generate light, and hence only one opening of the helix may be occupied by an LED 1315. In some embodiments, two or more LEDs 1315 may be provided which emit different wavelengths of light, and which provide color mixing for desired optical effects. In some embodiments, the apertures 1323 may be disposed in any desired location on the light emitting portion 1303.

Figure 19:
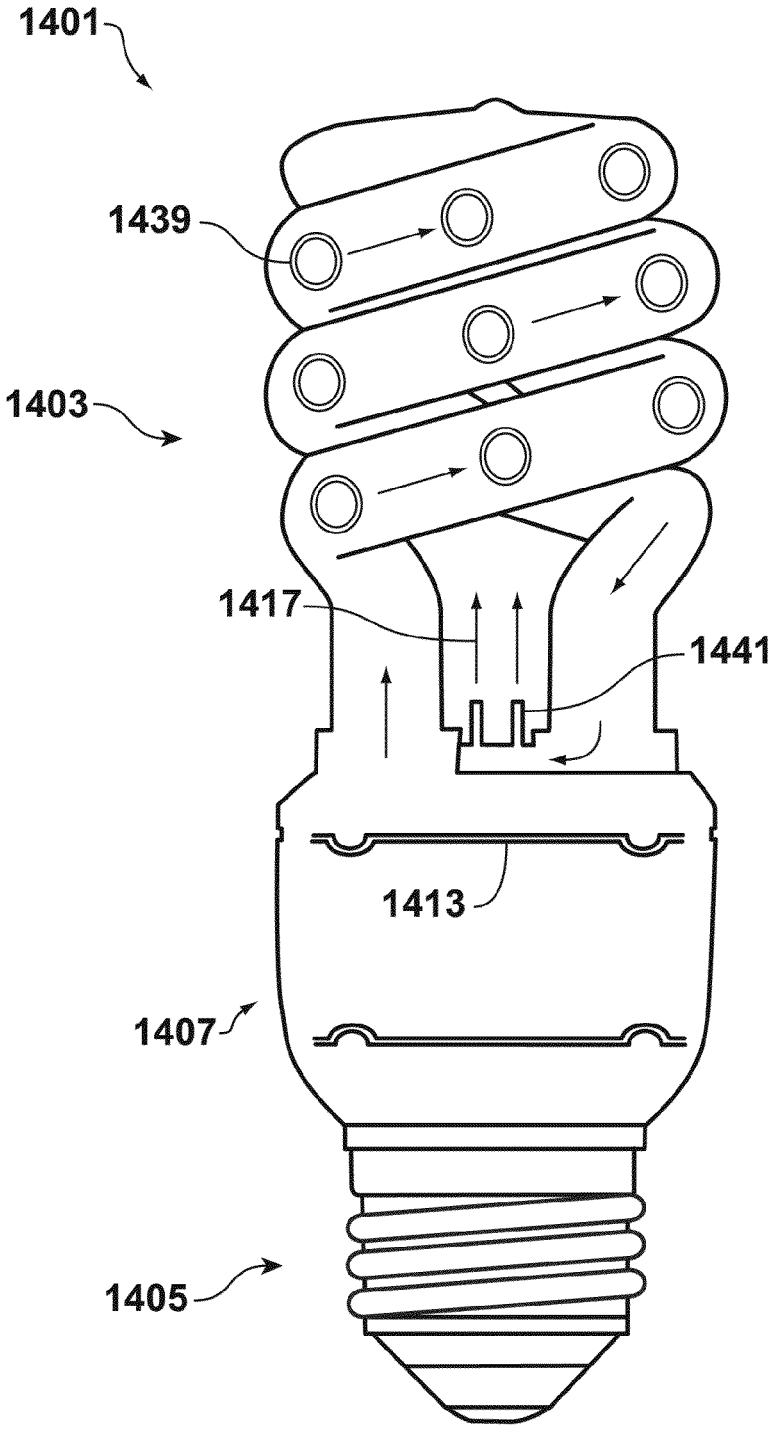
FIG. 19 is an illustration of an illumination device in accordance with the teachings herein.

FIG. 19 depicts another particular, non-limiting embodiment of an LED-based illumination device in accordance with the teachings herein. The illumination device 1401 depicted therein comprises a light-emitting portion 1403 which emits light, and a connector module 1405 which connects the illumination device 1401 to the electrical outlet of a light fixture. A synthetic jet actuator 1407 is disposed between the light emitting portion and the connector module 1405.

The illumination device 1405 of FIG. 19 is similar in most respects to the illumination device of FIG. 15, but differs in the placement of the LEDs 1439. In particular, in the embodiment depicted in FIG. 19, the LEDs 1439 are disposed on the external surface of the helix of the light emitting portion 1403. The synthetic jet actuator 1407 operates to generate a fluidic flow which extends through the coils of the light emitting portion 1403, and exits through nozzles 1441 in the form of synthetic jets 1417. Hence, this embodiment operates to cool the substrate the LED 1439 is disposed on, as well as the light emitting surface of the LED 1439.

In some variations of this embodiment, the helical coils of the light emitting portion 1403 may comprise a suitably thermally conductive material. Such a material may provide for more efficient transfer of heat from the LEDs 1439 to the underlying substrate, where it may be rejected to the external atmosphere by the fluidic flow created by the synthetic jet actuator 1407. In other variations, the LEDs 1439 may be directed inward so that their backsides are exposed to the internal environment, and their light emitting surfaces are directed towards the interior of the helical coil. In these different embodiments, a metallic interconnect may be disposed on the interior or exterior surface of the coils, or may be embedded in the walls of the coils.

Figure 20:
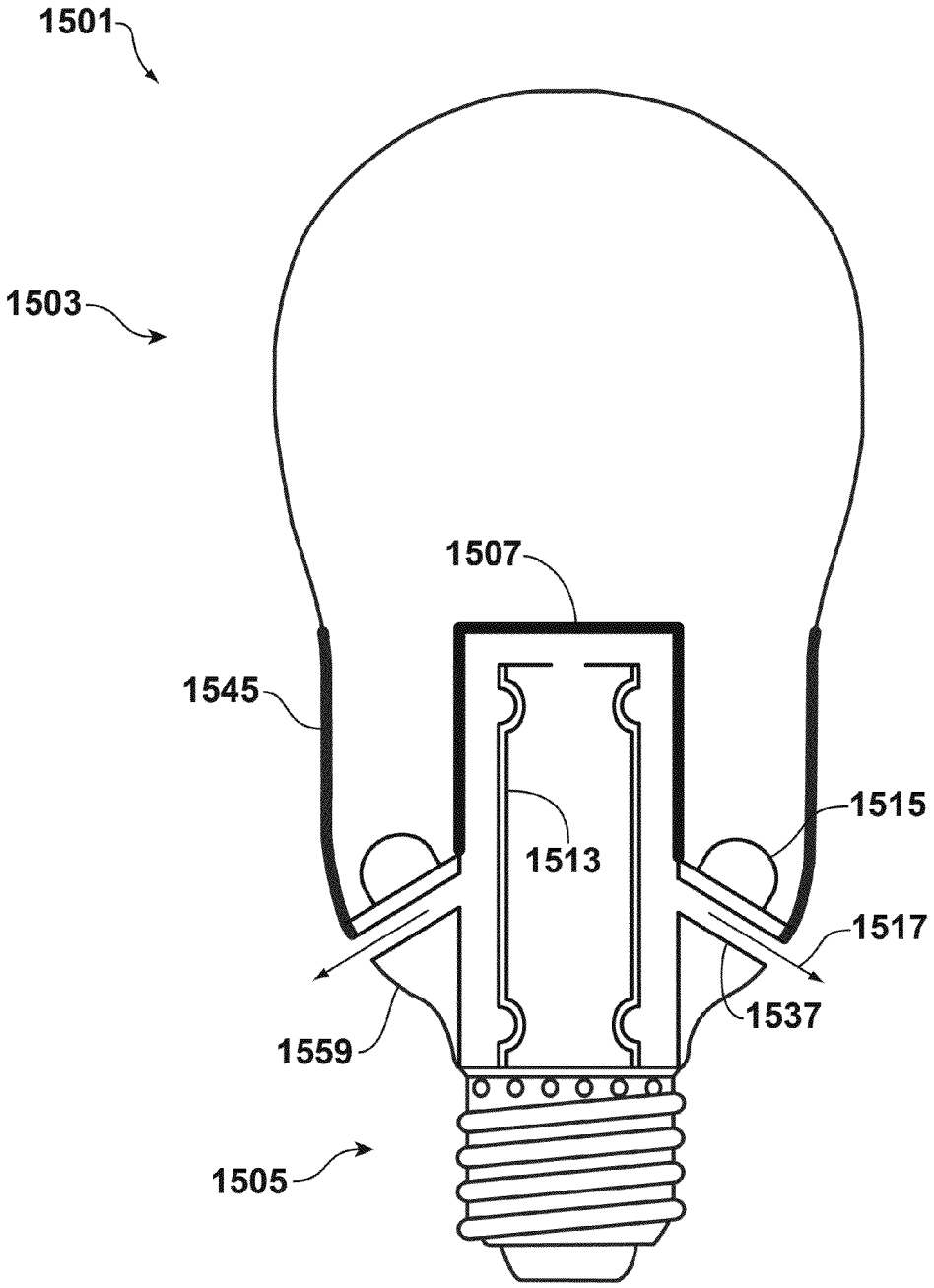
FIG. 20 is an illustration of an illumination device in accordance with the teachings herein.

FIG. 20 depicts another particular, non-limiting embodiment of an LED-based illumination device in accordance with the teachings herein. The illumination device 1501 depicted therein comprises a light-emitting portion 1503 which emits light, and a connector module 1503 which connects the illumination device 1501 to the electrical outlet of a light fixture. A synthetic jet actuator 1507 is disposed between the light emitting portion and the connector module 1505.

In this embodiment, the synthetic jet actuator 1507 is centrally disposed within the light emitting portion 1503, and a plurality of LEDs 1515 are disposed around it. A heat sink 1559 is built into the base of the illumination device 1501, and is equipped with channels 1537 which are in fluidic communication with the synthetic jet actuator 1507. During operation, the synthetic jet actuator 1507 creates a fluidic flow which preferably includes synthetic jets 1517, and which rejects heat from the heat sink 1559 to the external environment.

As indicated in FIG. 20, the surfaces of the illumination device 1501 in the vicinity of the LEDs 1515 may be covered with a suitable reflective material 1545. The amount of the surface area so coated may be determined, for example, by the desired illumination profile of the illumination device 1501. Notably, the design of this illumination device 1501 also allows for the use of relatively large diaphragms 1513 in the synthetic jet actuator 1507, which may be useful in achieving high heat flux from the heat sink 1559 to the external environment.

Figure 21:
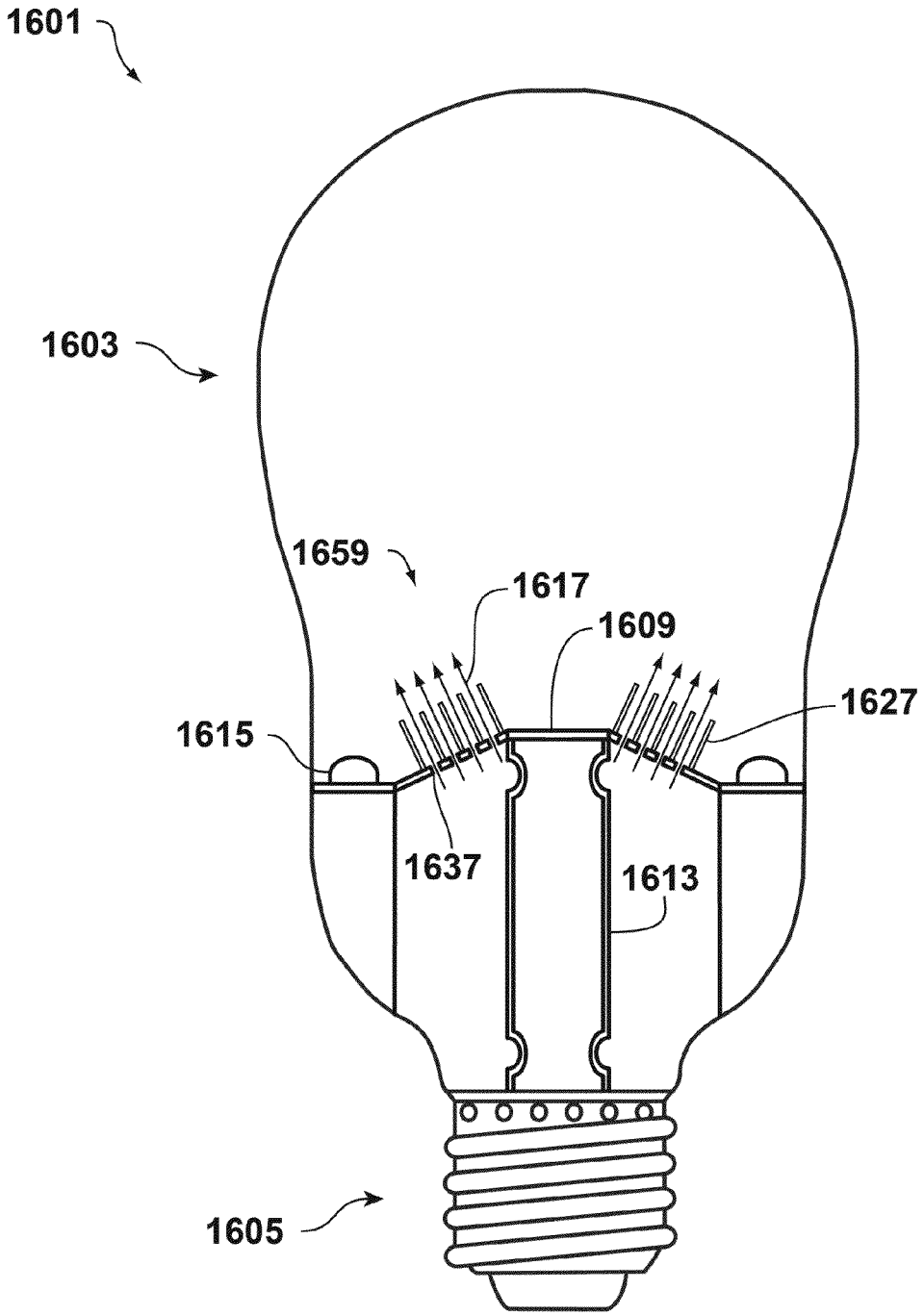
FIG. 21 is an illustration of an illumination device in accordance with the teachings herein.

FIG. 21 depicts another particular, non-limiting embodiment of an LED-based illumination device in accordance with the teachings herein. The illumination device 1601 depicted therein comprises a light-emitting portion 1603 which emits light, and a connector module 1605 which connects the illumination device 1601 to the electrical outlet of a light fixture. A synthetic jet ejector 1609 is disposed between the light emitting portion and the connector module 1605.

One wall of the synthetic jet ejector 1609 is equipped with a heat sink 1659 comprising a plurality of heat fins 1627. The heat fins 1627 are disposed adjacent to an LED 1615 and define a plurality of channels 1637 which are in fluidic communication with the interior of the synthetic jet ejector 1609.

During operation, the heat sink 1659 absorbs heat from the LEDs 1615, and the synthetic jet ejector 1609 generates a plurality of synthetic jets 1617 in the channels 1637 which transfers the heat to the interior environment of the light emitting portion 1603. From there, the heat is rejected to the external environment through thermal transfer. In some implementations, thermal transfer to the external environment may be facilitated by the provision of suitable venting in the light emitting portion 1603 or by other suitable means. As with the previous embodiment, the design of this illumination device 1601 allows for the use of relatively large diaphragms 1613 in the synthetic jet ejector 1609, which may be useful in achieving high heat flux from the heat sink 1659 to the external environment.

Figure 22:
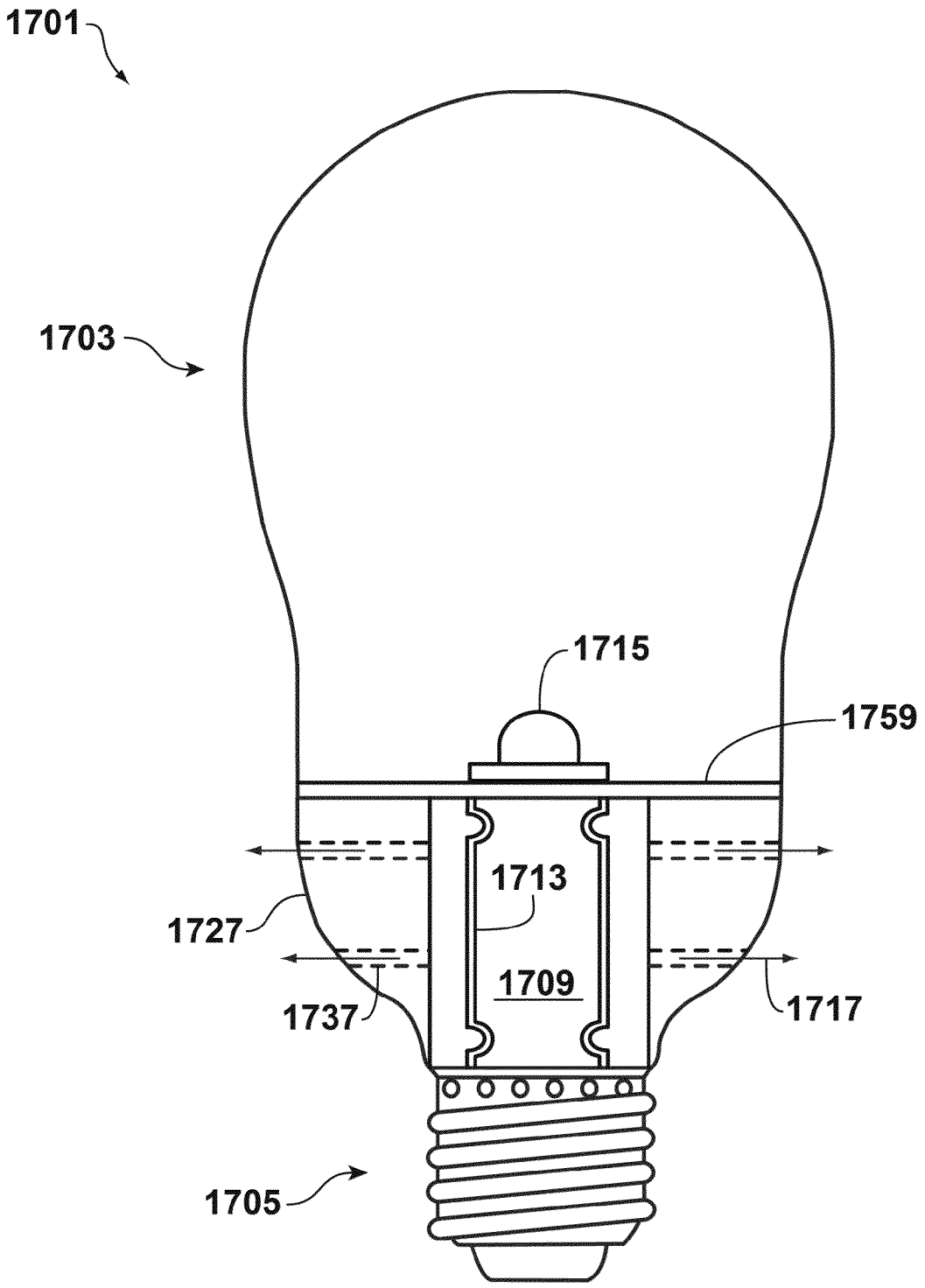
FIG. 22 is an illustration of an illumination device in accordance with the teachings herein.

FIG. 22 depicts another particular, non-limiting embodiment of an LED-based illumination device in accordance with the teachings herein. The illumination device 1701 depicted therein comprises a light-emitting portion 1703 which emits light, and a connector module 1705 which connects the illumination device 1701 to the electrical outlet of a light fixture. A synthetic jet ejector 1709 is disposed between the light emitting portion and the connector module 1705.

In this embodiment, the synthetic jet ejector 1709 is centrally disposed within a heat sink 1759 having a plurality of external heat fins 1727. The external heat fins 1727 have a plurality of channels 1737 defined therein which are in fluidic communication with the interior of the synthetic jet ejector 1709 and the external environment. An LED 1715 is disposed on top of the heat sink.

In operation, the heat sink 1759 absorbs heat given off by the LED 1715, and this heat is transferred to the heat fins 1727. The synthetic jet ejector 1709 creates a plurality of synthetic jets 1717 in the channels 1737 which rejects the heat to the external environment. As with the previous embodiment, the design of this illumination device 1701 allows for the use of relatively large diaphragms 1713 in the synthetic jet ejector 1709, which may be useful in achieving high heat flux from the heat sink 1759 to the external environment.

Figure 23:
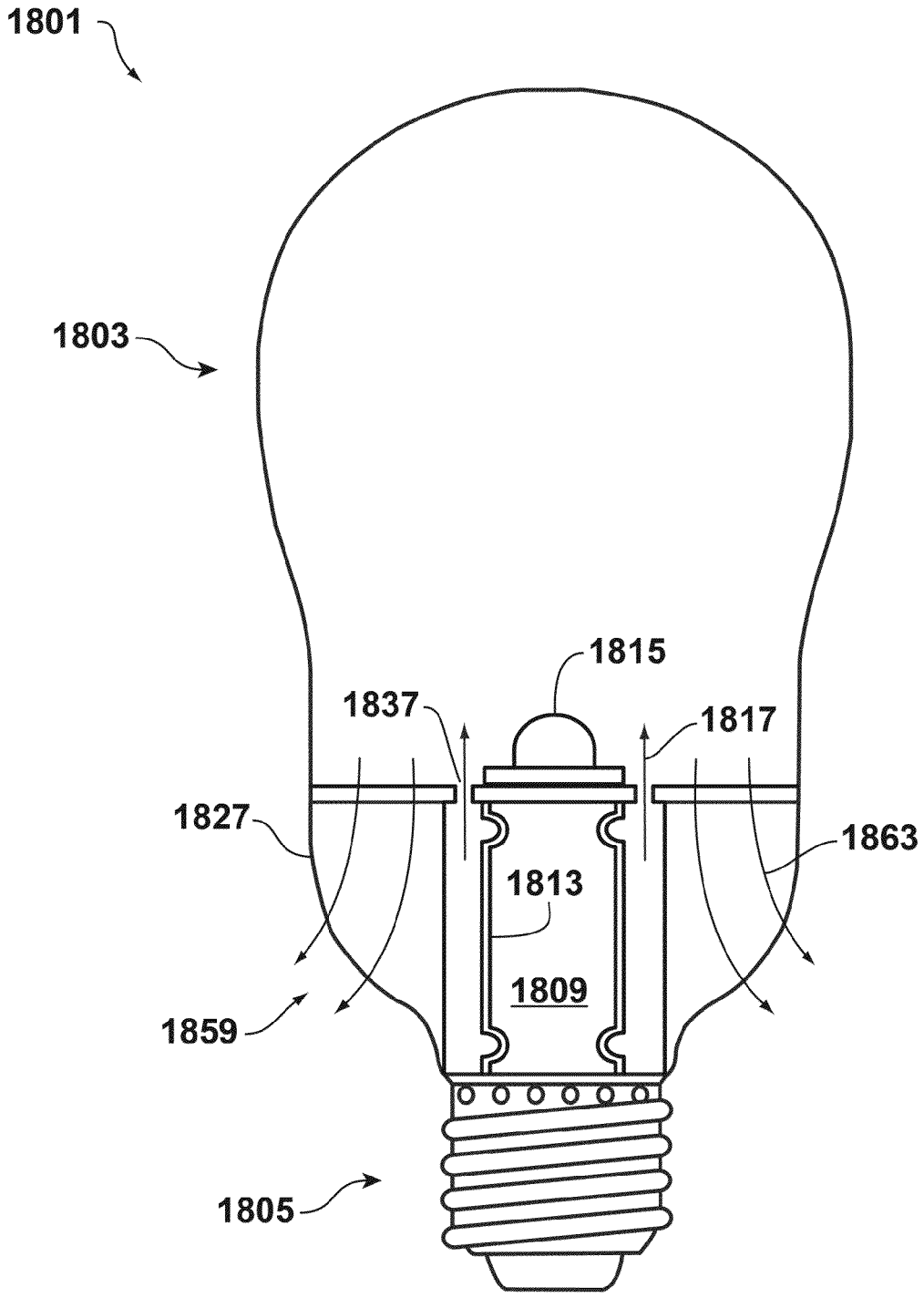
FIG. 23 is an illustration of an illumination device in accordance with the teachings herein.

FIG. 23 depicts another particular, non-limiting embodiment of an LED-based illumination device in accordance with the teachings herein. The illumination device 1801 depicted therein comprises a light-emitting portion 1803 which emits light, and a connector module 1805 which connects the illumination device 1801 to the electrical outlet of a light fixture. A synthetic jet ejector 1809 is disposed between the light emitting portion and the connector module 1805.

In this embodiment, the synthetic jet ejector 1809 is centrally disposed within a heat sink 1859 having a plurality of external heat fins 1827. The portion of the heat sink 1859 which separates the light emitting portion 1803 from the heat fins 1827 is porous, and hence provides for fluidic flow between the interior of the light emitting portion 1803 and the external environment as indicated by arrows 1863. This may be achieved, for example, by forming this portion of the heat sink 1859 out of a foamed, thermally conductive material, such as a foamed metal, or by providing a plurality of apertures or vents in this portion of the heat sink 1859. An LED 1815 is disposed on top of the heat sink 1859.

Similarly, the interior of the light emitting portion 1803 is in fluidic communication with the interior of the synthetic jet ejector 1809. This may be accomplished, for example, by seating the LED 1815 on a metal plate or heat spreader which is in thermal contact with the heat fins 1827, and which has a plurality of apertures 1837 therein adjacent to the LED 1815 which are in fluidic communication with the interior of the synthetic jet ejector 1809.

In operation, the heat sink 1859 absorbs heat given off by the LED 1815, and this heat is transferred to the heat fins 1847. The synthetic jet ejector 1809 emits a plurality of synthetic jets 1817 from the channels 1837, which in turn creates a flow of fluid across the heat fins 1827. The synthetic jets 1817 also facilitate the transfer of heat from the LED 1815 to the interior atmosphere of the light emitting portion 1803, where the warmed fluid can then exit the light emitting portion 1803 to the external environment as indicated by the arrows 1863. This fluidic flow also facilitates the transfer of heat from the heat fins 1827 to the external environment. As with the previous embodiment, the design of this illumination device 1801 allows for the use of relatively large diaphragms 1813 in the synthetic jet ejector 1809, which may be useful in achieving high heat flux from the heat sink 1859 to the external environment.

Figure 24:
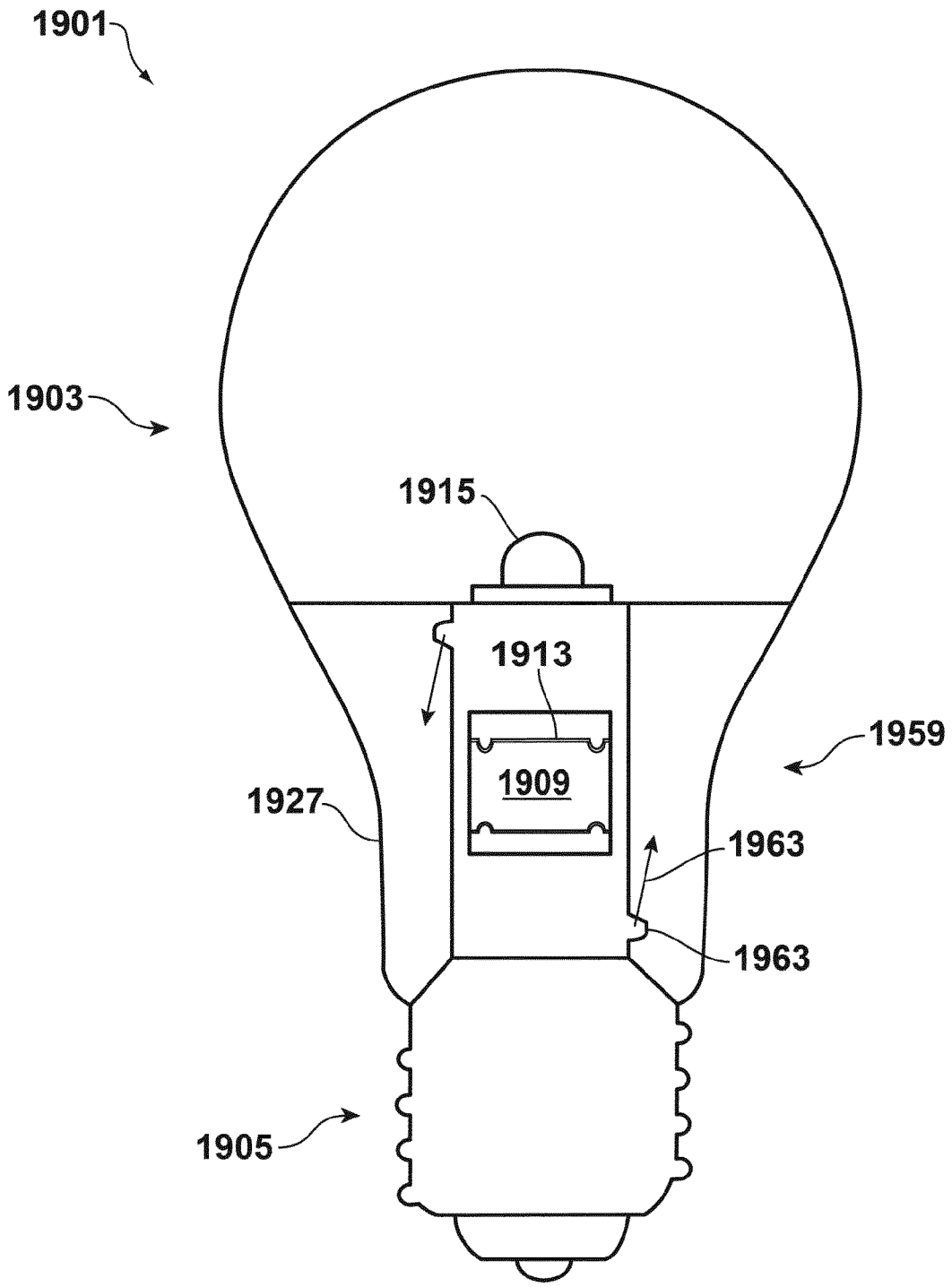
FIG. 24 is an illustration of an illumination device in accordance with the teachings herein.

FIG. 24 depicts another particular, non-limiting embodiment of an LED-based illumination device in accordance with the teachings herein. The illumination device 1901 depicted therein comprises a light-emitting portion 1903 which emits light, and a connector module 1905 which connects the illumination device 1901 to the electrical outlet of a light fixture. A synthetic jet ejector 1909 is disposed between the light emitting portion and the connector module 1905.

In this embodiment, the synthetic jet ejector 1909 is centrally disposed within a heat sink 1959 having a plurality of external heat fins 1927. The heat sink 1959 has a plurality of channels defined therein by the space between adjacent heat fins 1927. These channels are in fluidic communication with the external environment, and are also in fluidic communication with the interior of the synthetic jet ejector 1909 by way of a plurality of nozzles 1941 disposed at the top and bottom of the channels. An LED 1915 is disposed on top of the heat sink.

In operation, the heat sink 1959 absorbs heat given off by the LED 1915, and this heat is transferred to the heat fins 1927. The synthetic jet ejector 1909 creates a plurality of synthetic jets 1917 in the channels of the heat sink 1959 which rejects the heat to the external environment.

Various flow patterns are possible with this embodiment. Preferably, for any pair of heat fins which are coplanar (as shown in the figure) or on opposing sides of the heat sink, one heat fin has a synthetic jet directed in a first direction parallel to its major surface, and the second heat fin has a synthetic jet directed in a second direction parallel to its major surface, where the first and second directions are preferably opposing directions. It is also preferred that the heat fins on a first half of the device have synthetic jets directed across their major surfaces in the first direction, and that the heat fins on a second half of the device have synthetic jets directed across their major surfaces in the second direction, since this helps to create a circular flow pattern around the device. However, embodiments are also possibly where the directions of the jets alternate between each channel formed by adjacent pairs of fins.

Figure 25:
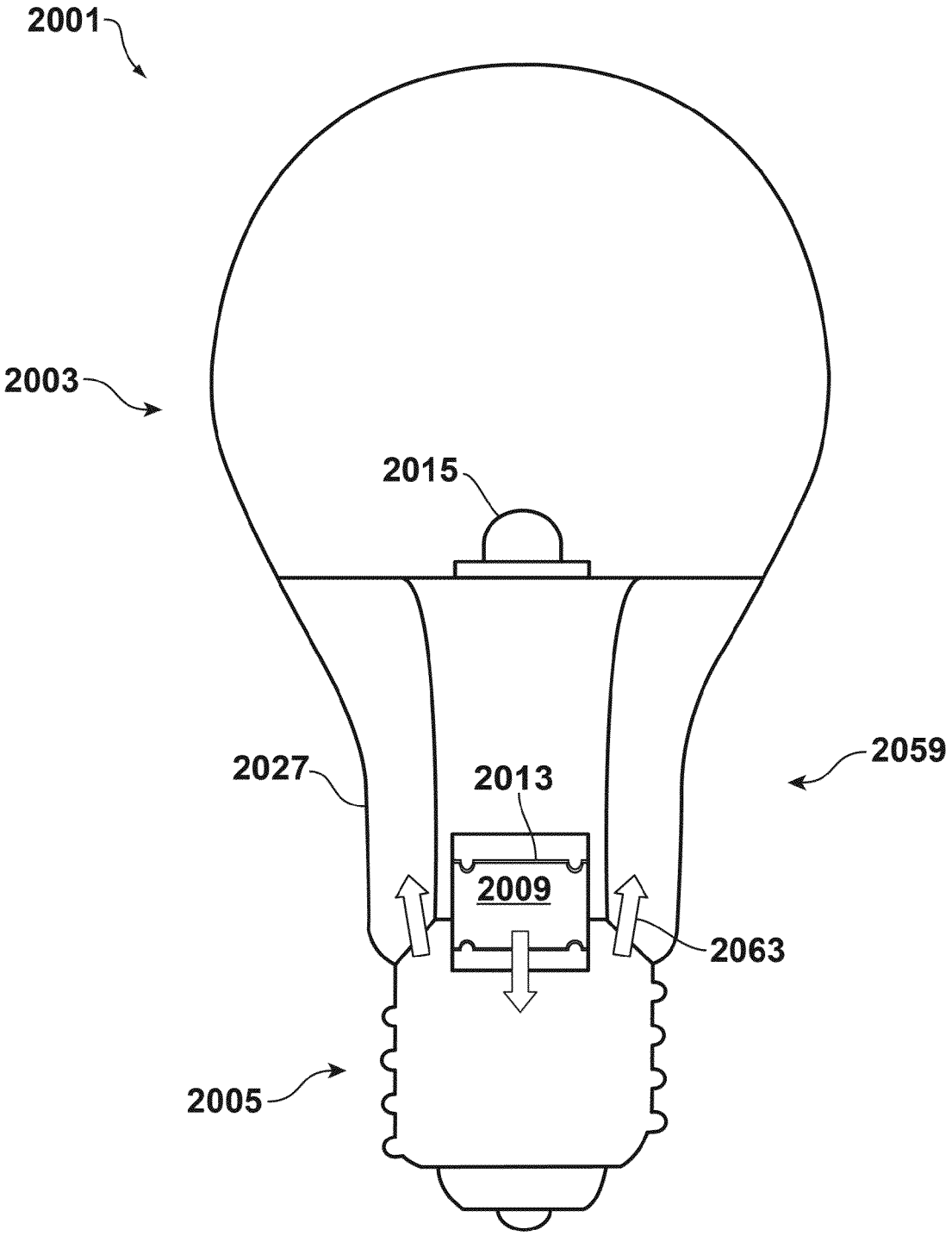
FIG. 25 is an illustration of an illumination device in accordance with the teachings herein.

FIG. 25 depicts another particular, non-limiting embodiment of an LED-based illumination device in accordance with the teachings herein. The illumination device 2001 depicted therein comprises a light-emitting portion 2003 which emits light and a connector module 2005 which connects the illumination device 2001 to the electrical outlet of a light fixture. A heat sink 2059 having a plurality of external heat fins 2027 is disposed between the connector module 2005 and the light-emitting portion 2003.

A synthetic jet ejector 2009 is centrally disposed between the heat sink 2059 and the connector module 2005. The heat sink 2059 has a plurality of channels defined therein by the space between adjacent heat fins 2027. These channels are in fluidic communication with the external environment, and are also in fluidic communication with the interior of the synthetic jet ejector 2009 by way of the interior of the connector module k1-05 as indicated by arrows 2063. An LED 2015 is disposed on top of the heat sink 2059.

In operation, the heat sink 2059 absorbs heat given off by the LED 2015, and this heat is transferred to the heat fins 2027. The synthetic jet ejector 2009 creates a plurality of synthetic jets 2017 in the channels of the heat sink 2059 which rejects the heat to the external environment.

Figure 26:
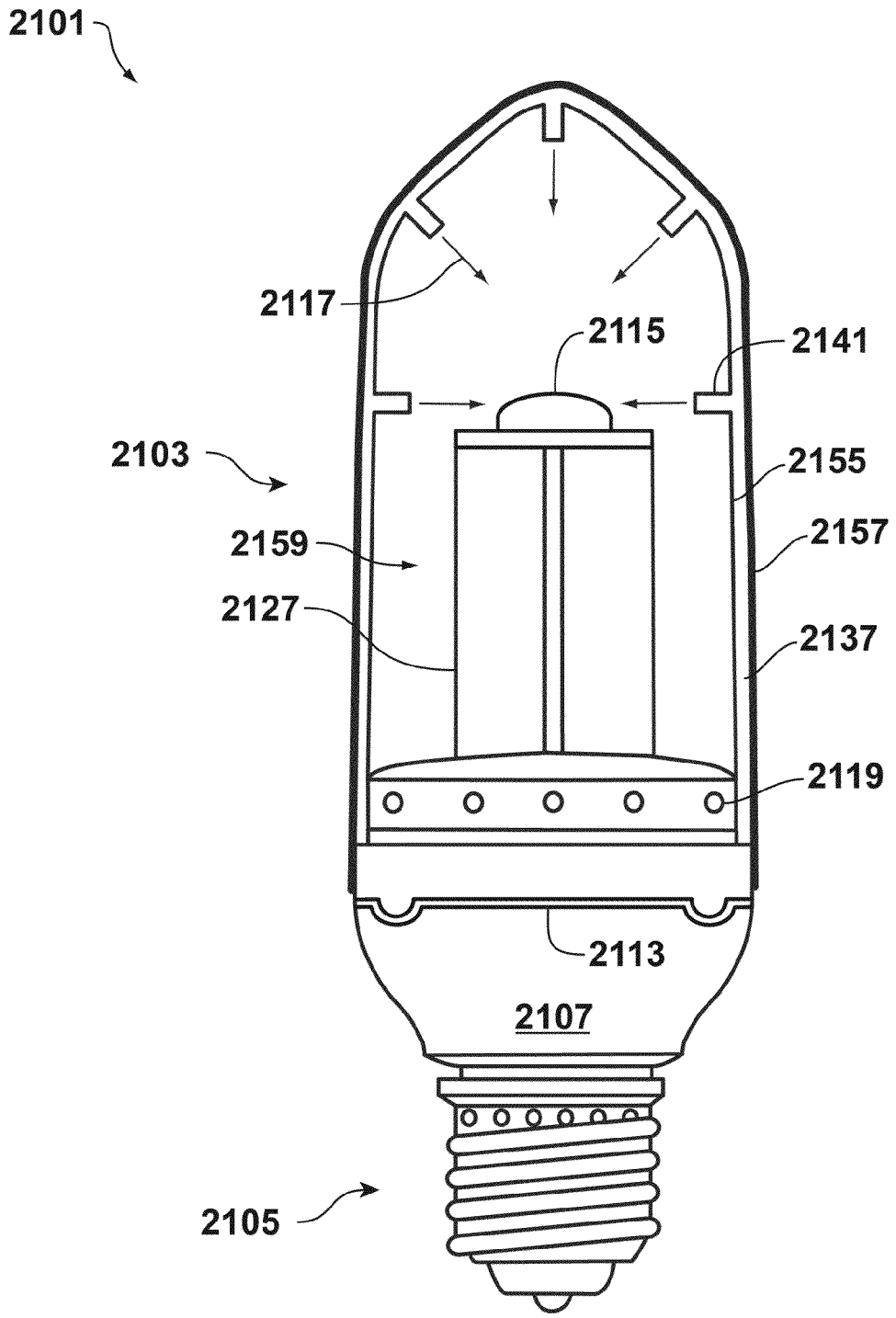
FIG. 26 is an illustration of an illumination device in accordance with the teachings herein.

FIG. 26 depicts a further particular, non-limiting embodiment of an LED-based illumination device in accordance with the teachings herein. The illumination device 2101 depicted therein comprises a light-emitting portion 2103 which emits light, and a connector module 2105 which connects the illumination device 2101 to the electrical outlet of a light fixture. A synthetic jet actuator 2107 is disposed between the light emitting portion 2103 and the connector module 2105.

The illumination device 2101 in this embodiment is equipped with a heat sink 2159 comprising a plurality of heat fins 2127, and upon which is disposed an LED 2115. The illumination device 2101 comprises an interior housing element 2155 and an exterior housing element 2157 which, between them, define a channel 2137 for fluidic flow. The channel 2137 is in fluidic communication with the synthetic jet actuator 2107 by way of a series of internal apertures 2109, and is further in fluidic communication with a plurality of nozzles 2141 disposed about the interior of the light emitting portion 2103.

In operation, the synthetic jet actuator 2107, which is driven by one or more diaphragms 2113, creates a plurality of synthetic jets 2117 at the nozzles 2141. The synthetic jets 2117 are directed at, or across, the surfaces of the LED 2115, and especially the light emitting surface thereon. The synthetic jets 2117 facilitate the transfer of heat from the LED 2115 to the interior atmosphere of the light emitting portion 2103, where it can be dissipated through thermal transfer to the internal 2155 and external 2157 housing elements and to the external environment, or through absorption by the heat sink 2159. The heat sink 2159 serves to absorb heat directly from the backside of the LED 2115. In some implementations of this embodiment, the heat sink 2159 may be equipped with one or more heat pipes.

Figure 27:
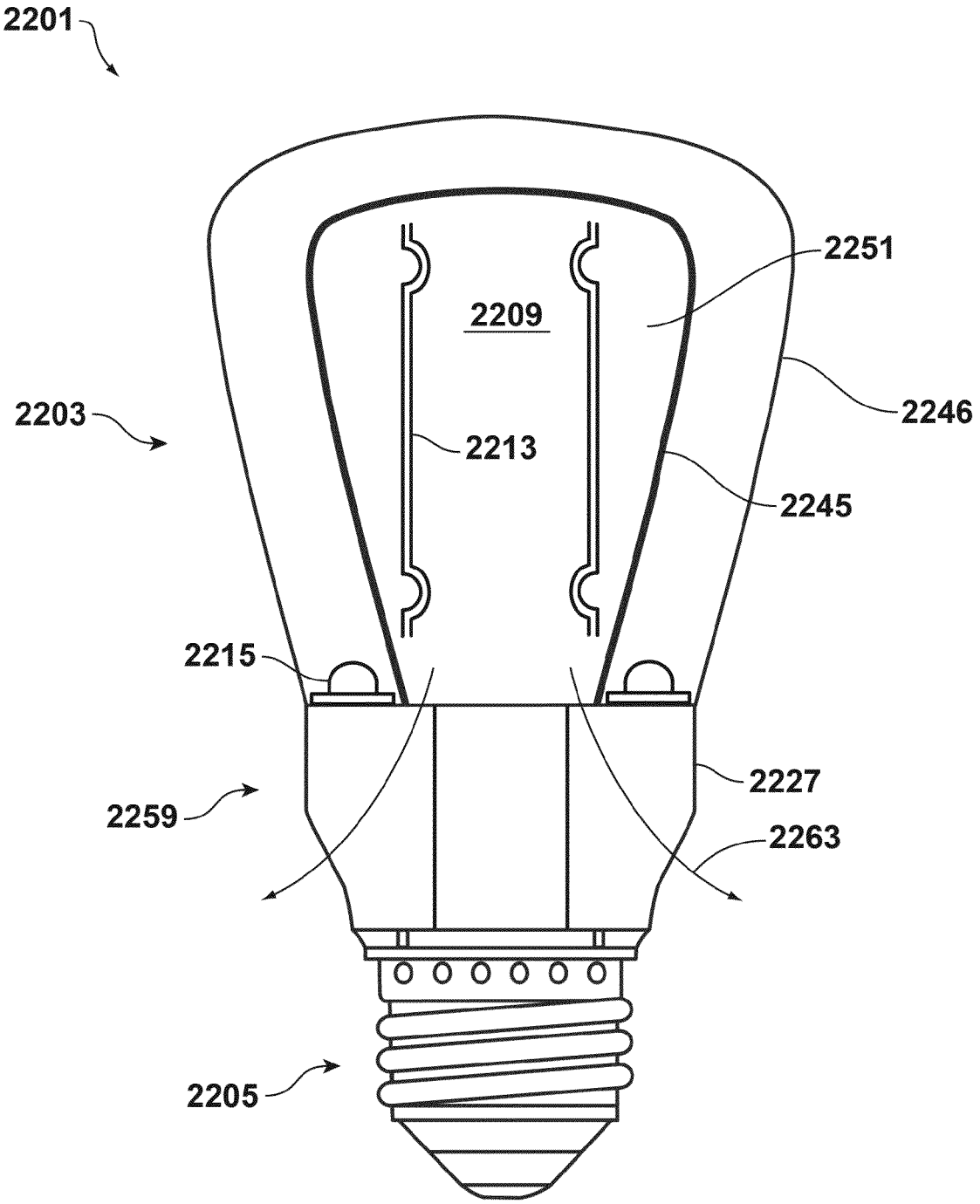
FIG. 27 is an illustration of an illumination device in accordance with the teachings herein.

FIG. 27 depicts a further particular, non-limiting embodiment of an LED-based illumination device in accordance with the teachings herein. The illumination device 2201 depicted therein comprises a light-emitting portion 2203 which emits light, a connector module 2205 which connects the illumination device 2201 to the electrical outlet of a light fixture, and a heat sink 2259 disposed between the two. A synthetic jet ejector 2209 equipped with a set of diaphragms 2213 is disposed in a central, internal chamber 2251 in the light emitting portion 2203 of the illumination device 2201. The internal chamber 2251 has a reflective surface 2245. A plurality of LEDs 2215 are disposed on the heat sink 2259 in the volume between the internal chamber 2245 and the exterior wall of the light emitting portion 2203.

In operation, the light emitted from the LEDs 2215 is reflected off of the reflective surface 2245 and is emitted through the exterior wall of the light emitting portion 2203. The degree of specular or diffuse reflectivity of these two surfaces may be selected to achieve a desired illumination footprint. Heat is withdrawn from the LEDs 2215 by the heat sink 2259. The synthetic jet ejector 2209 creates a fluidic flow across the surfaces of the heat fins 2227 as indicated by the arrows 2263, thus rejecting the heat to the external environment. Preferably, this flow 2263 is in the form of one or more synthetic jets.

Figure 28:
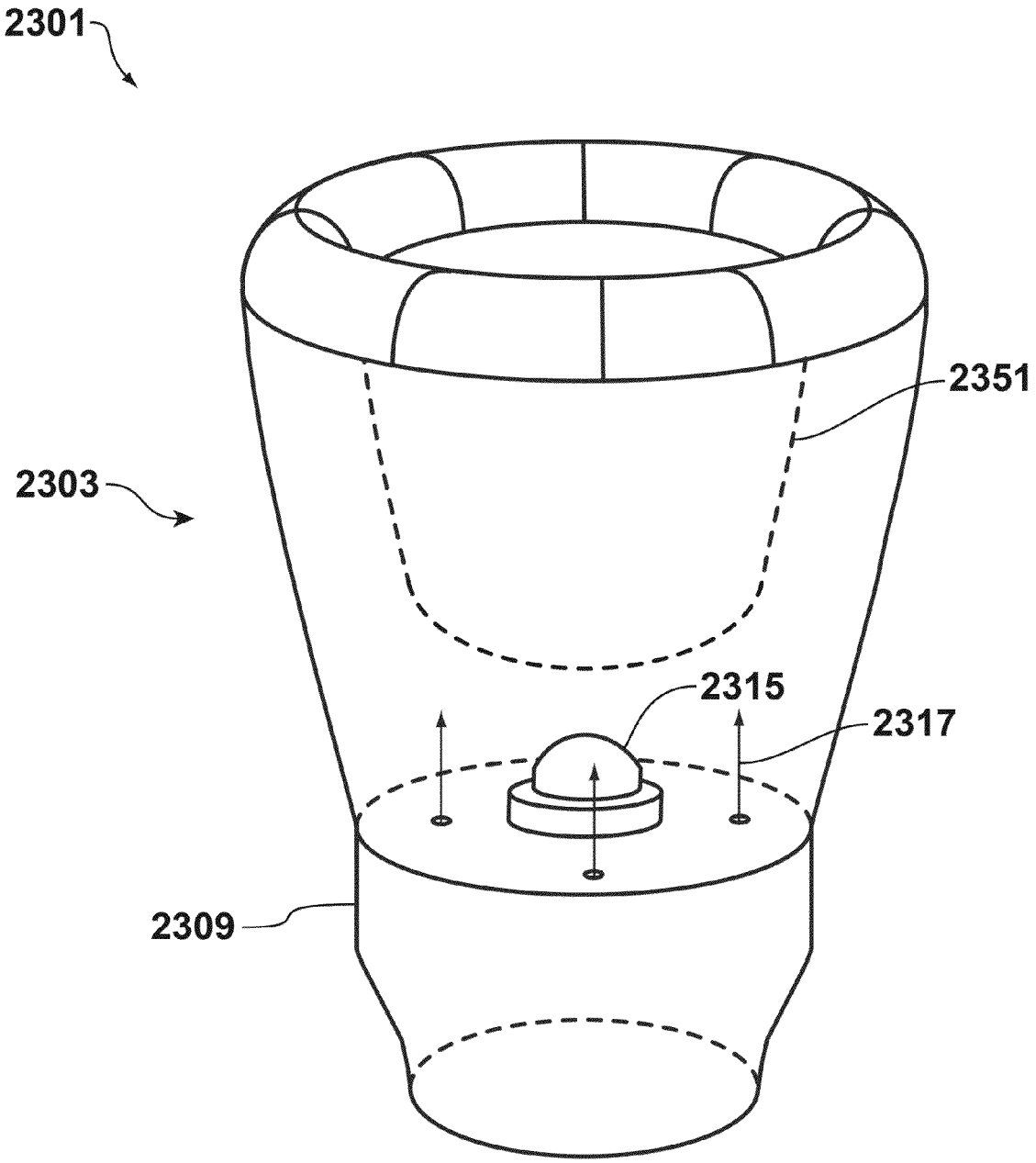
FIG. 28 is an illustration of an illumination device in accordance with the teachings herein.

FIG. 28 depicts another particular, non-limiting embodiment of an LED-based illumination device in accordance with the teachings herein. The illumination device 2301 depicted therein comprises a light-emitting portion 2303 which emits light, and a synthetic jet ejector 2309. The remaining elements of the illumination device have been omitted for clarity of illustration, but would typically include an electrical connector module and the operating components of the synthetic jet ejector 2309. The illumination device 2301 includes a heat spreader 2365 with a plurality of apertures 2319 defined therein. The globe 2357 of the light emitting portion 2303 is provided with a centrally disposed depression 2351 therein.

In use, the synthetic jet ejector 2309 creates a plurality of synthetic jets 2317 in the vicinity of the LED 2315. The synthetic jets impinge on the surface of the depression 2351, and thus aid in the transfer of heat from the interior of the light emitting portion 2303 to the external environment.

Figure 29:
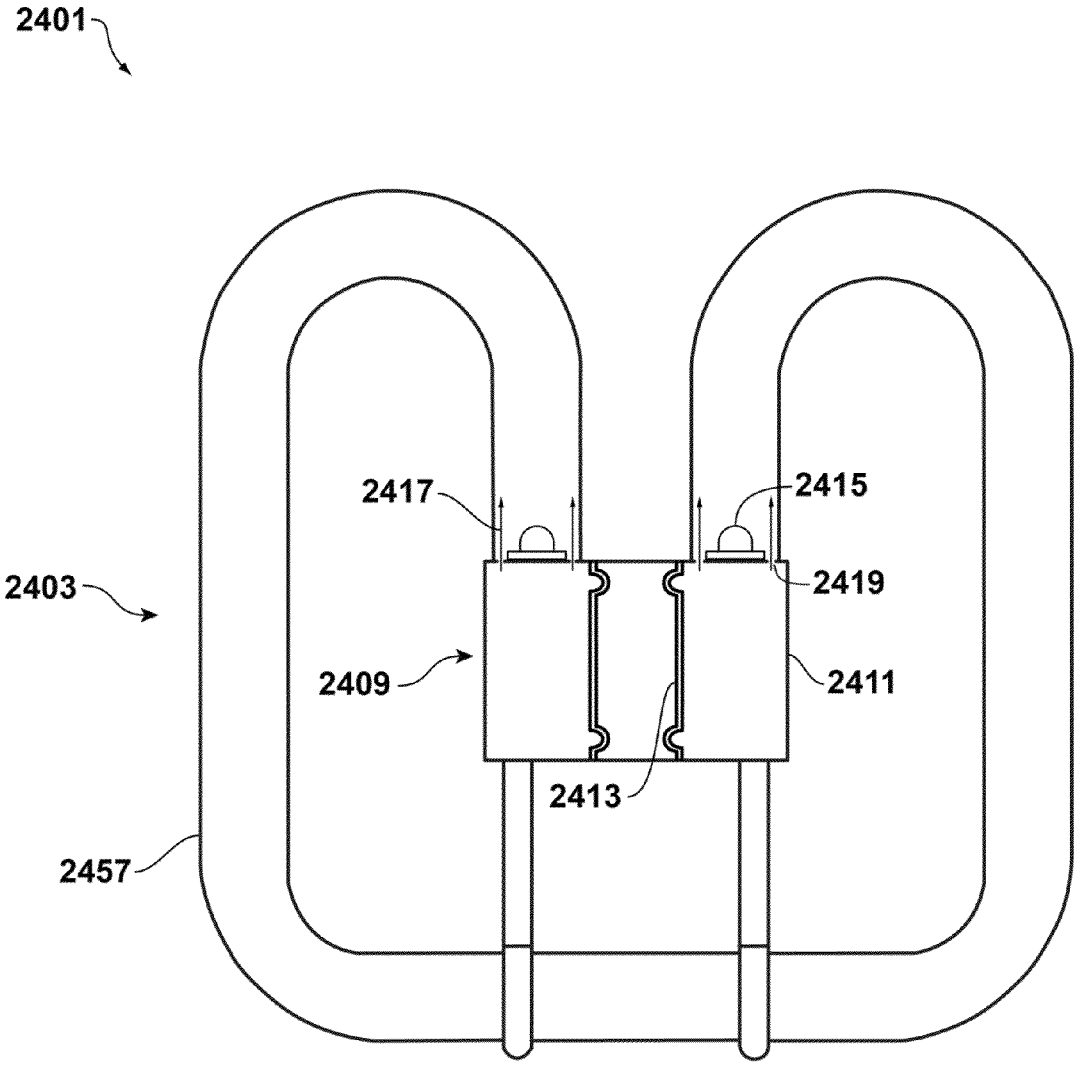
FIG. 29 is an illustration of an illumination device in accordance with the teachings herein.

FIG. 29 depicts another particular, non-limiting embodiment of an LED-based illumination device in accordance with the teachings herein, which in this case is a tubular illumination device similar to the type used in fluorescent lamps. The illumination device 2401 depicted therein comprises a light-emitting portion 2403 which emits light, and a synthetic jet actuator 2409 equipped with a set of diaphragms 2413. An LED 2415 is disposed at each end of the tubing 2457 forming the light emitting portion 2403, and has a set of apertures 2419 disposed adjacent thereto which permit a fluidic flow about the LED 2413 and into the tubing 2457 of the light emitting portion 2403.

In operation, the synthetic jet ejector 2409 creates a fluidic flow about the LEDs 2415 in the form of one or more synthetic jets 2417. This flow transfers heat from the LEDs 2413 to the surfaces of the tubing 2457 of the light emitting portion 2403, where it is rejected to the external atmosphere.

Figure 30:
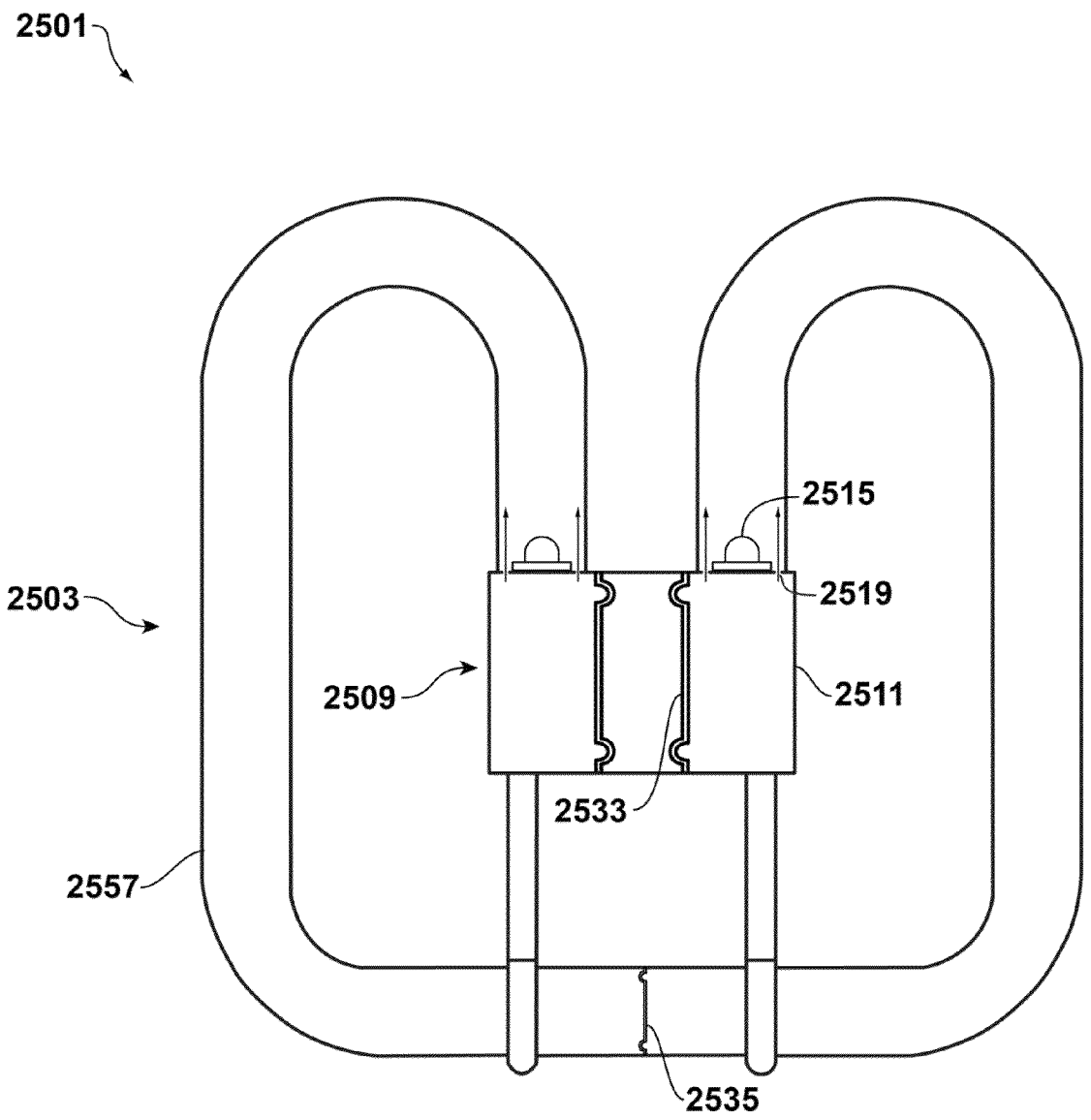
FIG. 30 is an illustration of an illumination device in accordance with the teachings herein.

FIG. 30 depicts another particular, non-limiting embodiment of an LED-based illumination device in accordance with the teachings herein. The illumination device 2501 depicted therein is similar in most respects to the embodiment depicted in FIG. 29, and hence comprises a light-emitting portion 2503 which emits light, and a synthetic jet actuator 2509 equipped with a set of diaphragms 2513. An LED 2515 is disposed at each end of the tubing 2557 forming the light emitting portion 2503, and has a set of apertures 2519 disposed adjacent thereto which permit a fluidic flow about the LED 2515 and into the tubing 2557 of the light emitting portion 2503. In addition, however, the illumination device 2501 of this embodiment is equipped with a passive diaphragm 2535 which operates in a manner similar the passive diaphragm 735 in the embodiment of FIG. 9.

In operation, the synthetic jet ejector 2509 creates a fluidic flow about the LEDs 2515 in the form of one or more synthetic jets 2517. This flow transfers heat from the LEDs 2515 to the surfaces of the tubing 2557 of the light emitting portion 2503, where it is rejected to the external atmosphere.

Figure 31:
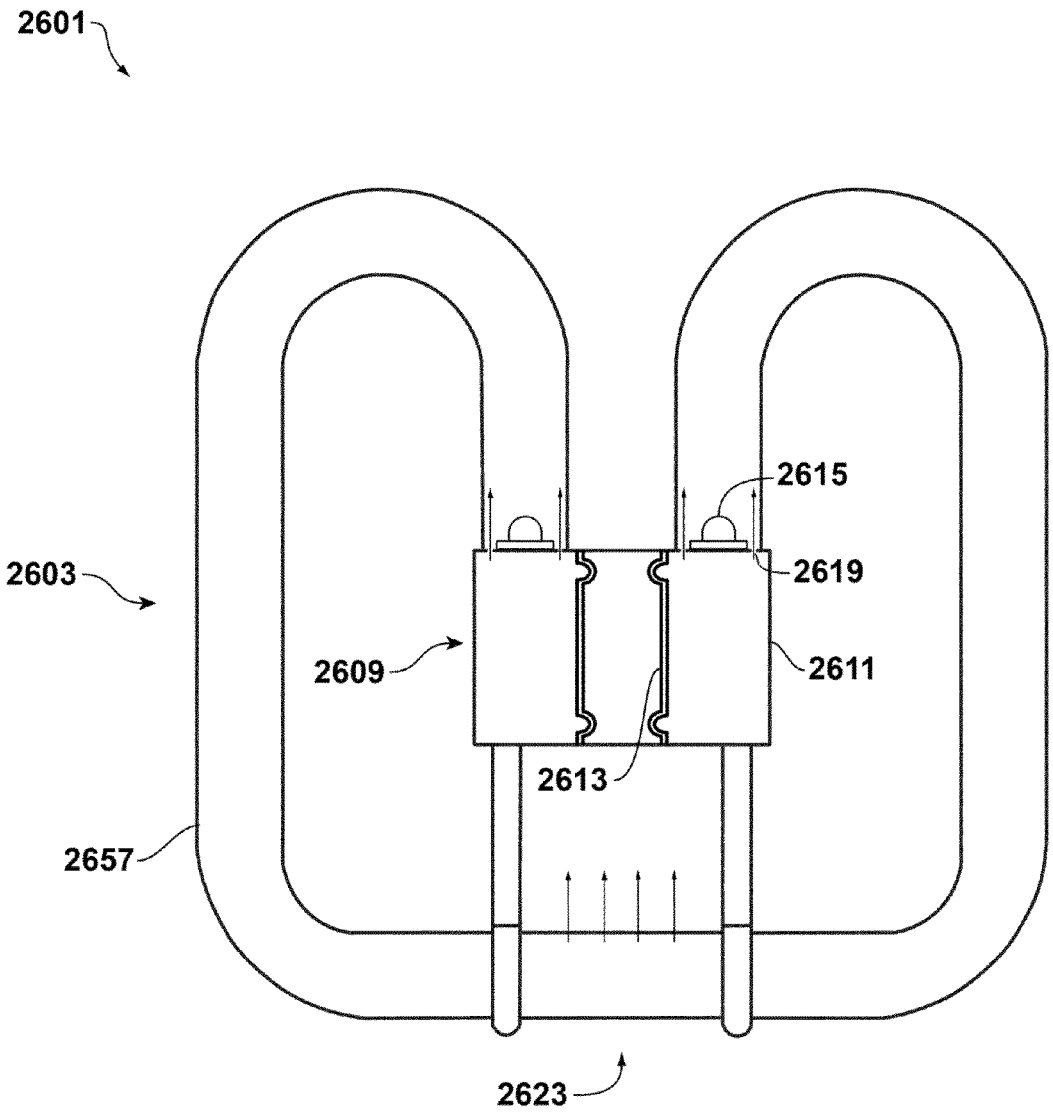
FIG. 31 is an illustration of an illumination device in accordance with the teachings herein.

FIG. 31 depicts another particular, non-limiting embodiment of an LED-based illumination device in accordance with the teachings herein. The illumination device 2601 depicted therein is similar in most respects to the embodiment depicted in FIG. 29, and hence comprises a light-emitting portion 2603 which emits light, and a synthetic jet actuator 2609 equipped with a set of diaphragms 2613. An LED 2615 is disposed at each end of the tubing 2657 forming the light emitting portion 2603, and has a set of apertures 2619 disposed adjacent thereto which permit a fluidic flow about the LED 2615 and into the tubing 2657 of the light emitting portion 2603. In addition, however, this embodiment is equipped with an external vent 2623 disposed in a central location on the tubing 2657 which forms the light emitting portion 2603.

In operation, the synthetic jet ejector 2609 creates a fluidic flow about the LEDs 2615 in the form of one or more synthetic jets 2617. This flow transfers heat from the LEDs 2615 to the surfaces of the tubing 2657 of the light emitting portion 2603, where it is rejected to the external atmosphere. The external vent 2623 provides an additional means by which heat may be rejected to the external environment.

In some variations of this embodiment, the illumination device 2601 may be adapted to emit synthetic jets from the external vent 2623. In other variations, the synthetic jet ejector provides a fluidic flow around the LEDs 2615, but only emits synthetic jets at the external vent 2623.

Reflective Materials

The various embodiments of light fixtures disclosed herein may be equipped with various reflective materials or surfaces. These include, without limitation, specularly or diffusely reflective or scattering materials. Such materials may be applied to the intended substrate as coatings or films. In some implementations, these coatings or films may be formed and then applied to the substrate, while in other implementations, they may be formed on the substrate in situ.

Examples of such scattering films include those based on continuous/disperse phase materials. Such films may be formed, for example, from a disperse phase of polymeric particles disposed within a continuous polymeric matrix. In some embodiments, one or both of the continuous and disperse phases may be birefringent. Such a film may be oriented, typically by stretching, in one or more directions. The size and shape of the disperse phase particles, the volume fraction of the disperse phase, the film thickness, and the amount of orientation may be chosen to attain a desired degree of diffuse reflection and total transmission of electromagnetic radiation of a desired wavelength in the resulting film. Films of this type, and methods for making them, are described, for example, in U.S. Pat. No. 6,031,665 (Carlson et al.), which is incorporated herein by reference in its entirety. Analogous films in which the disperse phase comprises inorganic or non-polymeric materials (such as, for example, silica, alumina, or metal particles) may also be utilized in the devices and methodologies described herein.

Reflective surfaces may also be imparted to the devices described herein through suitable metallization. These include, for example, films of silver or other metals which may be formed through vapor or electrochemical deposition.

Electrical Outlets

The various embodiments of light fixtures disclosed herein may be equipped with various electrical connectors. These include, without limitation, threaded connectors that rotatingly engage complimentary shaped sockets in an electrical outlet; prong connectors, which may be male or female, and which mate with complimentary shaped prongs or receptacles in an electrical outlet; cord connectors; and the like. The choice of connector may vary from one application to another and may depend, for example, on the wattage output of the light fixture and other such considerations as are known to the art. It will be understood, however, that while embodiments of light fixtures may have been disclosed or illustrated herein as having a particular connector type, any other suitable connector, including those described above, may be substituted where suitable for a particular application.

Bulb Coatings/Pigments

The various embodiments of light fixtures disclosed herein may be equipped with various bulbs. These bulbs, or any portion thereof, may be clear, opaque, specularly or diffusively transmissive, specularly or diffusively reflective, polarizing, mirrored, colored, or any combination of the foregoing. In some embodiments, the bulb may also be equipped with a film or pigment which provides the light fixture with a desired optical footprint. These bulbs may also be equipped with any of the various types of phosphors as are known to the art, or with various combinations of such phosphors.

Synthetic Jet Actuators/Ejectors

Various synthetic jet actuators and synthetic jet ejectors may be utilized in the devices and methodologies described herein. Preferably, however, the synthetic jet actuators and synthetic jet ejectors are of the type described in U.S. Ser. No. 61/304,427, entitled "SYNTHETIC JET EJECTOR AND DESIGN THEREOF TO FACILITATE MASS PRODUCTION" (Grimm et al.), which is incorporated herein by reference in its entirety. These synthetic jet actuators and synthetic jet ejectors may have various sizes, dimensions and geometries, and hence may be adapted to spaces available in the host device. Hence, for example, the synthetic jet ejector may be cylindrical, parallelepiped, or irregular in shape. Also, while the use of synthetic jet actuators which utilize voice coils is preferred, one skilled in the art will appreciate that synthetic jet actuators based on various piezoelectric materials may also be utilized.

Figure 32:
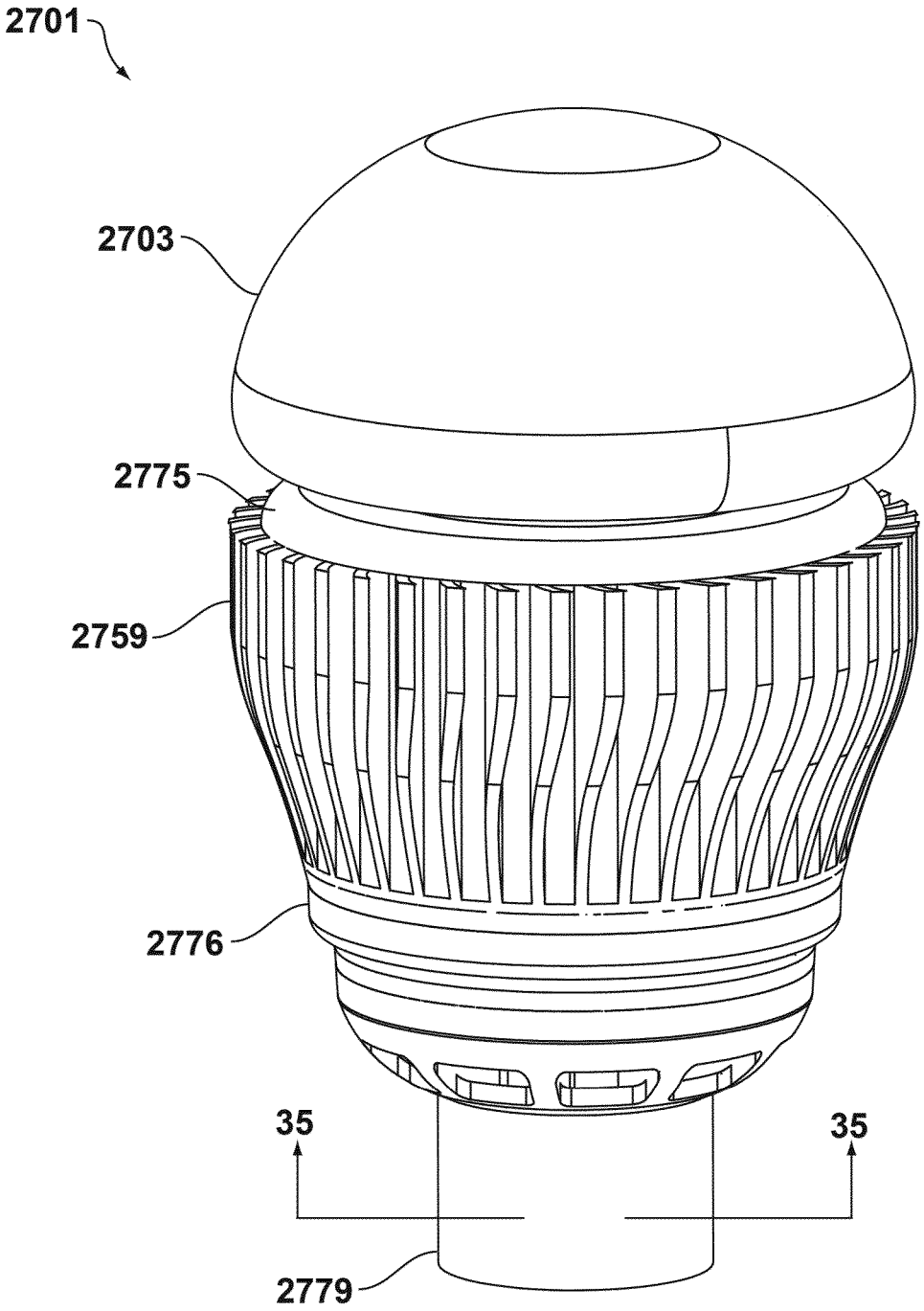
FIG. 32 is an illustration of an illumination device in accordance with the teachings herein.
Figure 33:
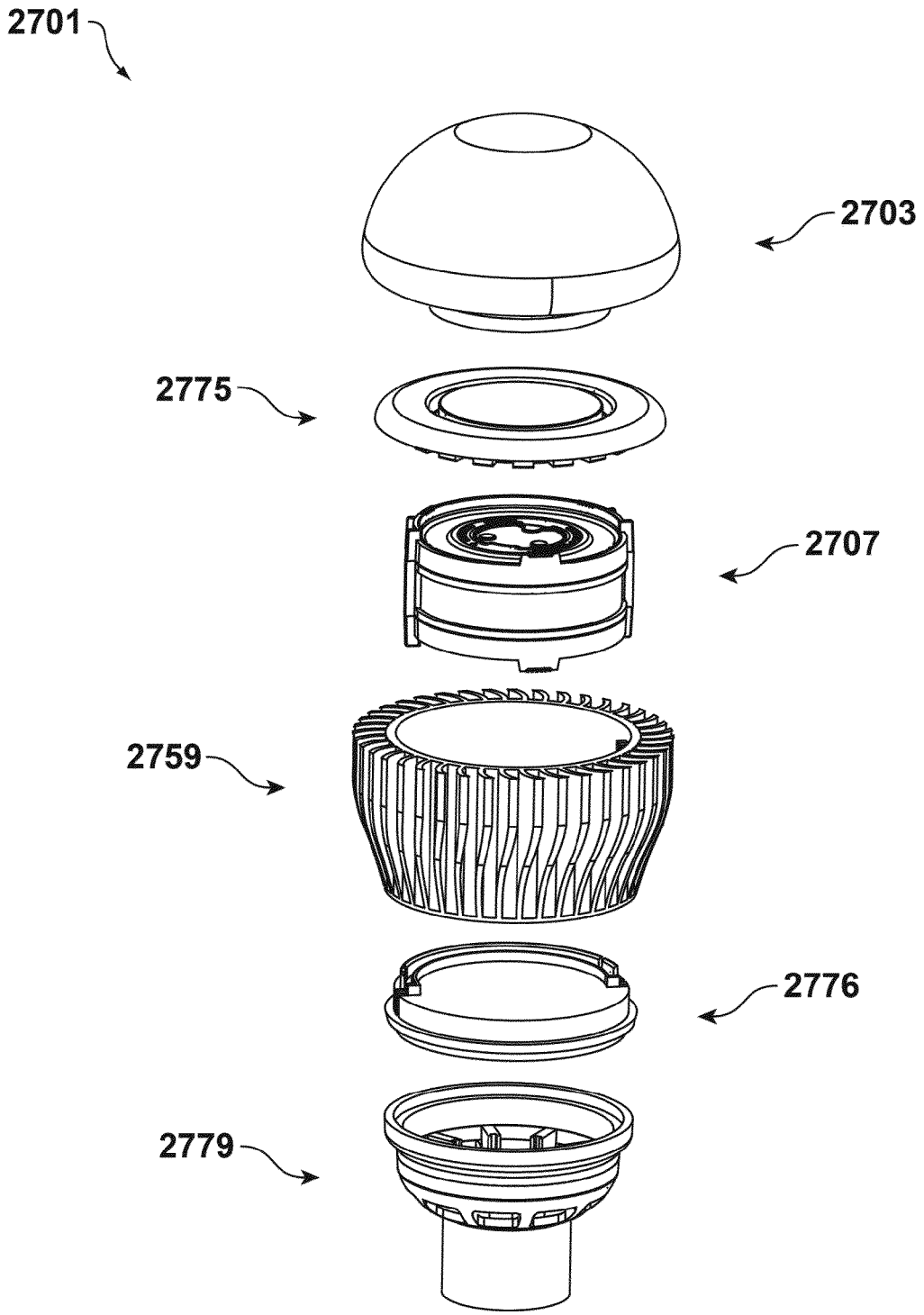
FIG. 33 is an exploded view of the illumination device of FIG. 32.
Figure 34:
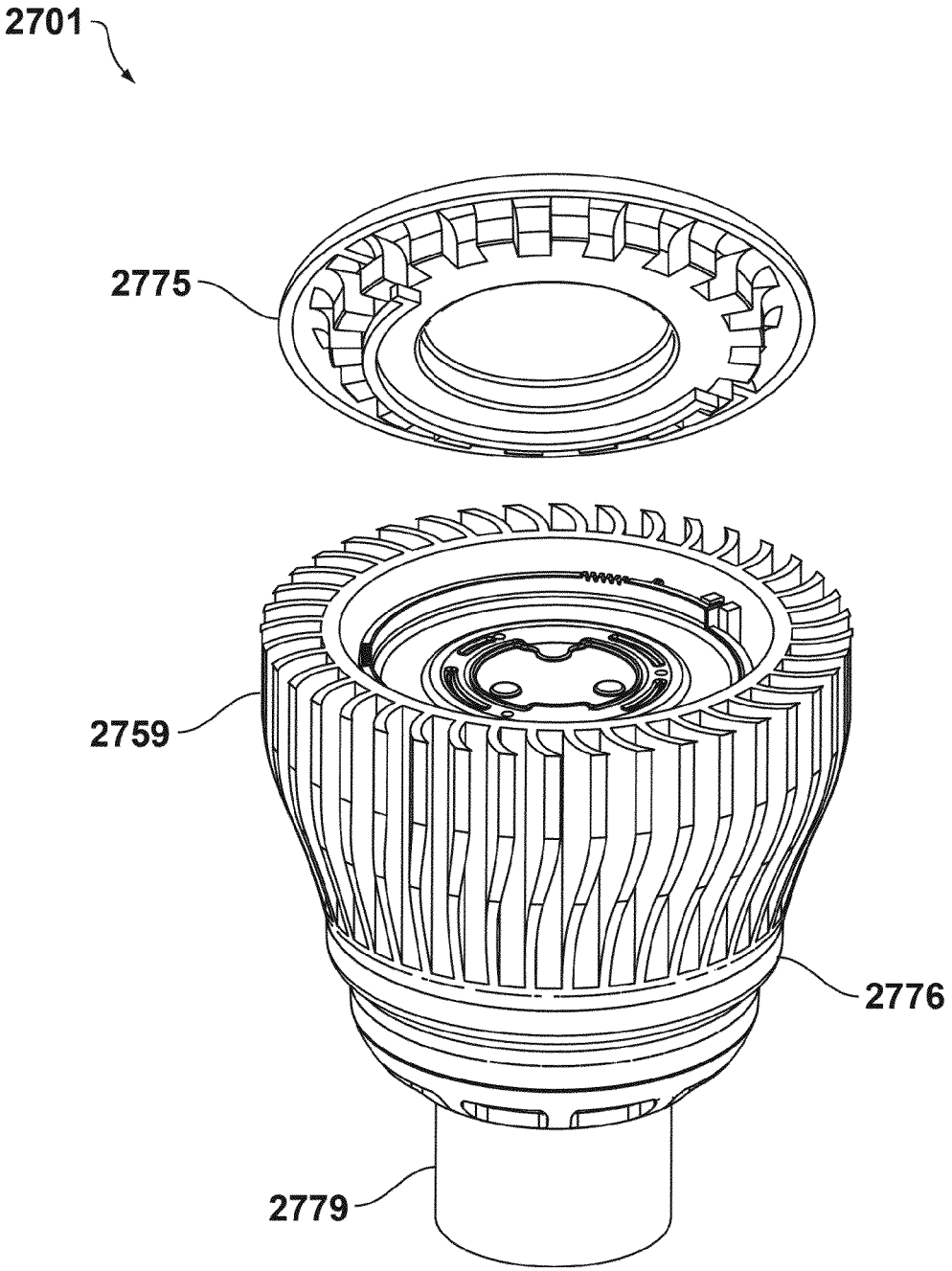
FIG. 34 is an illustration of the illumination device of FIG. 32 depicting the manner in which the upper wall integrates with the heat sink to form flow paths.

FIG. 32 depicts a particular, non-limiting embodiment of such a synthetic jet ejector 2709 and its application in an illumination device 2701. The illumination device 2701 comprises a light-emitting portion 2703, a heat sink 2759 (which, in this embodiment, is integral with the housing) having a synthetic jet actuator 2707 (see FIG. 33) disposed therein, an upper wall 2775, a lower wall 2776, and a base 2779.

Figure 35:
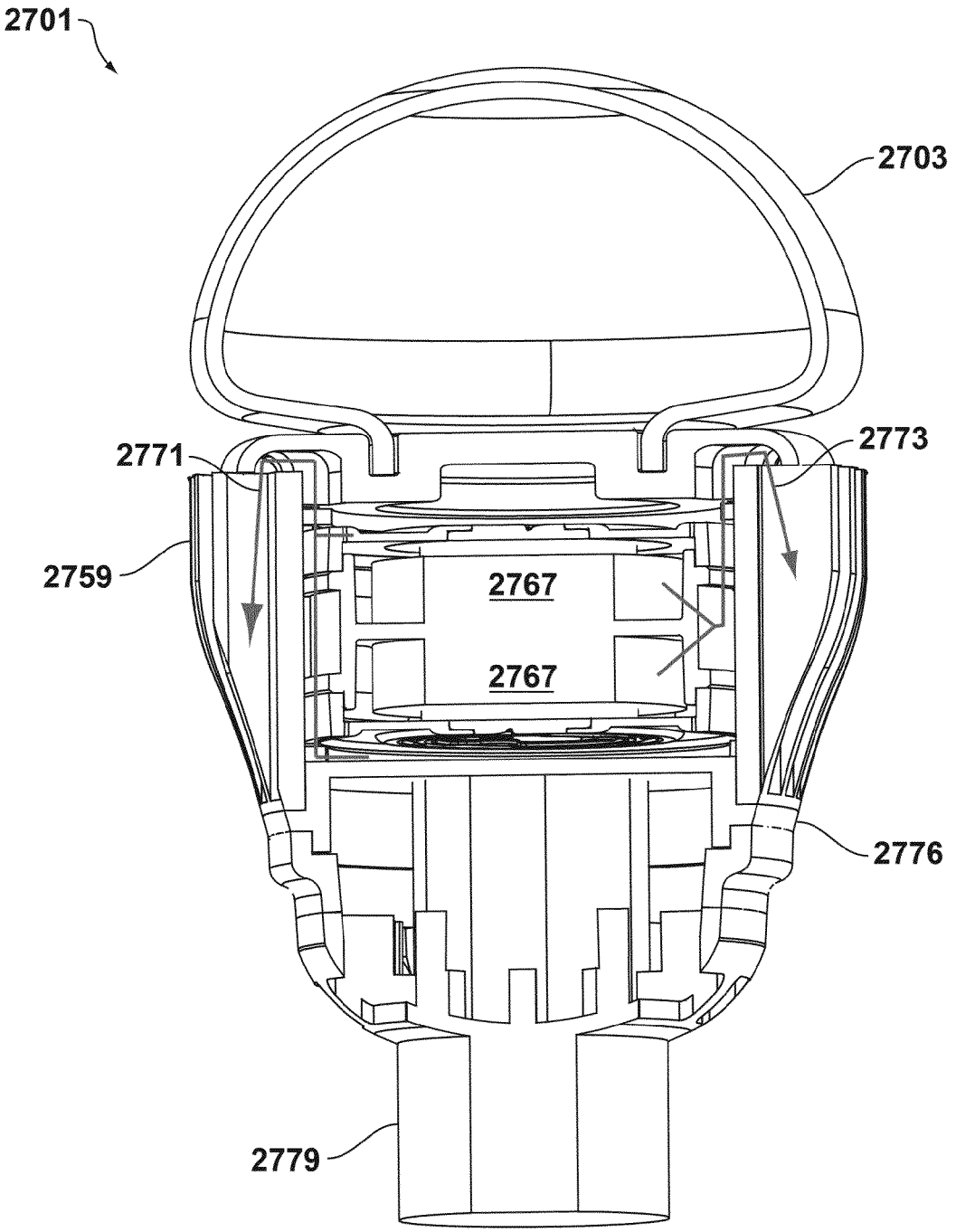
FIG. 35 is a cross-sectional view taken along LINE 35-35 of the illumination device of FIG. 32 depicting the flow paths between the synthetic jet actuators and the heat sink.

As best seen in FIG. 35, the synthetic jet ejector 2709 comprises first and second voice coils 2767 which drive first and second diaphragms 2769. The synthetic jet ejector 2709 has first 2771 and second 2773 channels defined therein which are in fluidic communication with a heat sink 2759.

Notably, in the particular illumination device 2701 depicted, elements of the host illumination device 2701 define the housing of the synthetic jet ejector 2709. Consequently, the overall space occupied by the synthetic jet ejector 2709 is significantly reduced compared to the situation that would exist if the synthetic jet ejector was made as a standalone unit (with its own housing) and subsequently incorporated into the host device. Moreover, in this embodiment, the upper wall 2775 (see FIG. 32) is thermally conductive and is in thermal communication with the heat sink fins 2727, and hence forms part of the heat sink 2759. This allows the synthetic jet ejector 2709 to absorb a greater amount of heat, distribute it over a larger area, and disperse it to the external atmosphere with the fluidic flow used to create synthetic jets 2717. As a further advantage, the synthetic jets 2717 further help to dissipate heat to the external environment by disrupting the boundary layer at the surfaces of the fins 2727 of the synthetic jet ejector 2709.

Figure 36:
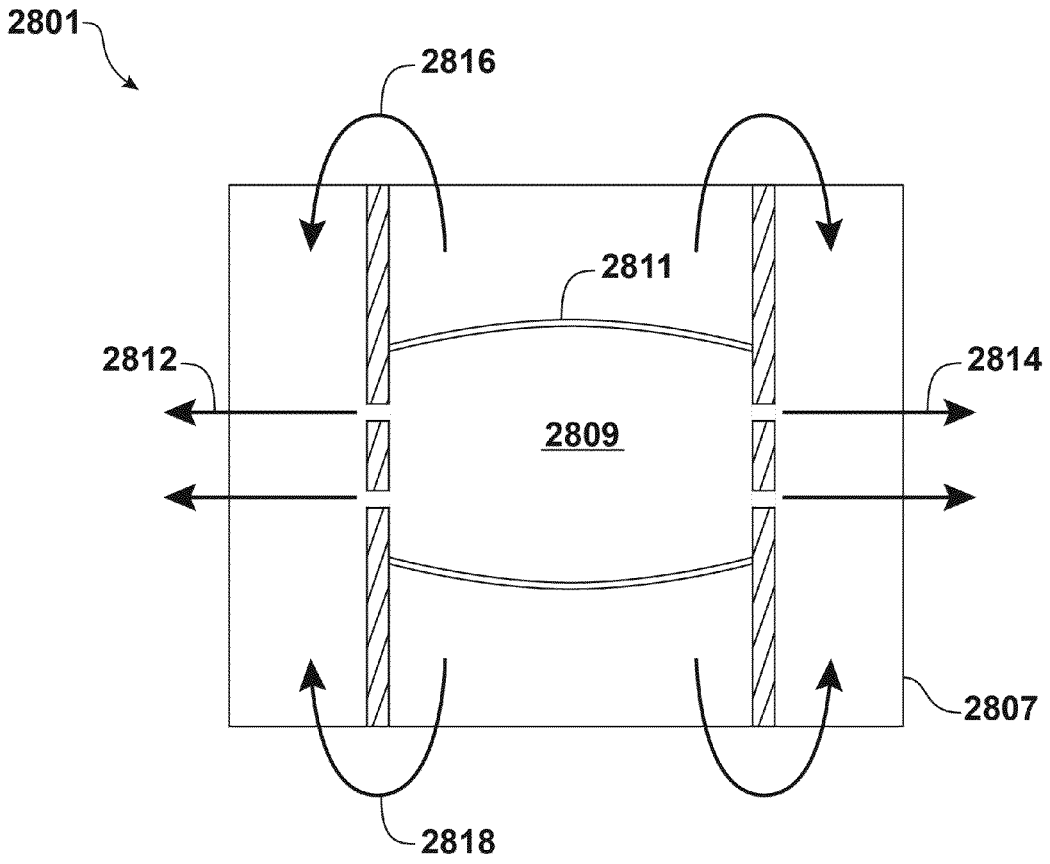
FIG. 36 is an illustration of a synthetic jet ejector which may be used in some of the LED-based illumination devices disclosed herein.

FIG. 36 depicts a particular, non-limiting embodiment of a synthetic jet ejector which may be used in some of the LED-based illumination devices disclosed herein, and which may also be used in various other applications where synthetic jet ejectors commonly find use. As seen therein, the synthetic jet ejector 2801 comprises a heat sink 2803 having a perimeter wall 2805. The exterior surface of the perimeter wall 2805 is equipped with a plurality of heat fins 2807, and the interior surface of the perimeter wall 2805 defines an interior space 2809 within which one or more synthetic jet actuators are disposed. For simplicity of illustration, the details of the one or more synthetic jet actuators are not illustrated; rather, the synthetic jet actuators is indicated by opposing diaphragms 2811. Of course, one skilled in the art will appreciate that, in a particular implementation, a single diaphragm 2811, or more than two diaphragms 2811, may be utilized. Moreover, the one or more synthetic jet actuators may be driven by voice coils, piezoelectric devices, or other suitable actuator means as are known to the art, although the use of voice coils is preferred.

As seen in FIG. 36, the one or more synthetic jet actuators operate to create a fluidic flow which preferably includes one or more synthetic jets in at least two, and preferably at least four, different directions within a given cross-sectional plane taken in a direction parallel to the major surface of a heat fin (here, it is to be understood that the use of non-planar heat fins is also possible in variations of this embodiment; hence, reference to planar heat fins is for simplicity of illustration). Preferably, this fluidic flow is primarily disposed along first and second mutually orthogonal axes, it being understood that synthetic jets are typically highly directional and characterized by a predominant flow along a single axis for a particular synthetic jet.

Fluidic flow along a first axis parallel to the major surfaces of the heat fins 2807 may be achieved through the provision of a series of flow control devices (preferably in the form of apertures in the perimeter wall 2805) which may be configured to induce the formation of synthetic jets in the ambient media along a first axis (indicated by arrows 2812, 2814) parallel to the major surfaces of the heat fins 2807. Since the perimeter wall 2805 may assume virtually any shape (including, for example, circular, elliptical, irregular or polygonal (including, but not limited to, square, rectangular, pentagonal and hexagonal)), these synthetic jets may be directed in a plurality of directions. Preferably, though not necessarily, the heat fins 2807 will follow the contour of the perimeter wall 2805.

Fluidic flow along a second axis parallel to the major surfaces of the heat fins 2807 may be achieved through the provision of a series of flow control devices which may be configured to induce the formation of synthetic jets in the ambient media along a second axis (indicated by arrows 2816, 2818) parallel to the major surfaces of the heat fins 2807. An example of such a flow control device is disclosed in U.S. Ser. No. 12/503,832, entitled "Advanced Synjet Cooler Design for LED Light Modules" (Grimm), filed on Jul. 15, 2009. Such a flow control device may be utilized, for example, to direct fluidic flow which may include synthetic jets from a series of apertures disposed along the top and bottom of the device. Notably, the direction of flow indicated by arrows 2816, 2818 is preferably orthogonal to the fluidic flow along the first axis.

The synthetic jet ejector 2801 of FIG. 36 has some notable features that make its use advantageous in some applications. In particular, the design of the synthetic jet ejector 2801 makes it smaller, which is advantageous in applications where there is limited space in the host device. Moreover, the flow design has the potential to create more entrainment, and better thermal performance, in some applications.

Heat Sinks

The various illumination devices described herein may be equipped with heat sources of various sizes, shapes and geometries. These heat sinks may be readily adapted to the space available within the illumination device or external to it. In some embodiments, these heat sinks may comprise a plurality of heat fins or other suitable heat dissipating structures.

Figure 14:
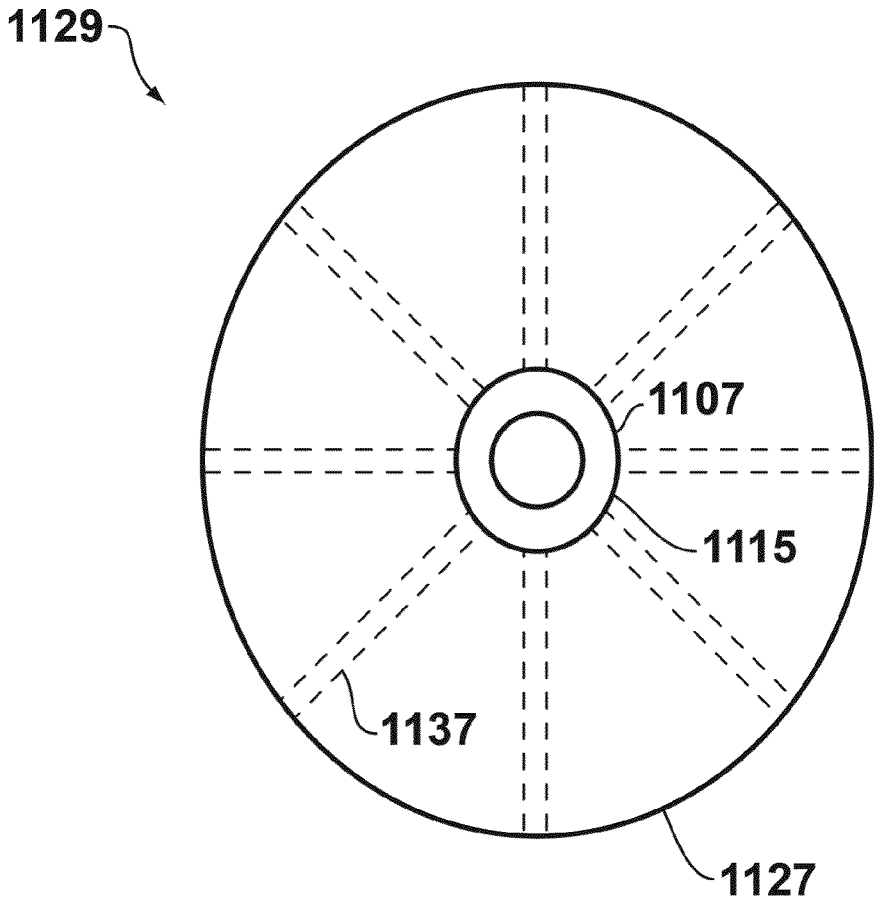
FIG. 14 is an illustration of the synthetic jet ejector/heat sink combination utilized in the illumination device of FIG. 13.

In some applications, it may be desirable to mount the heat sink on the exterior of an illumination device. Examples of such embodiments may be found in FIGS. 10, 11 and 12. As illustrated in the embodiment of FIGS. 13 and 14, however, the surface created by the heat fins may be covered by a smooth surface equipped with a plurality of apertures. Such a surface permits a fluidic flow between adjacent fins in the heat sink, but presents a smooth, possibly aesthetically pleasing outer surface. In such embodiments, the edges of the channels formed by adjacent fins may be left open to the ambient environment to facilitate heat transfer thereto.

In some embodiments, the heat sink may be utilized as a support structure for the actuator, engine, diaphragm or other components of the synthetic jet ejector. Since many current synthetic jet ejectors have various support structures for these components, this approach helps to reduce the size and cost of synthetic jet ejectors. If desired, some of these components may also be formed out of thermally conductive materials (such as, for example, injection molded plastics with conductive fillers).

Figure 37:
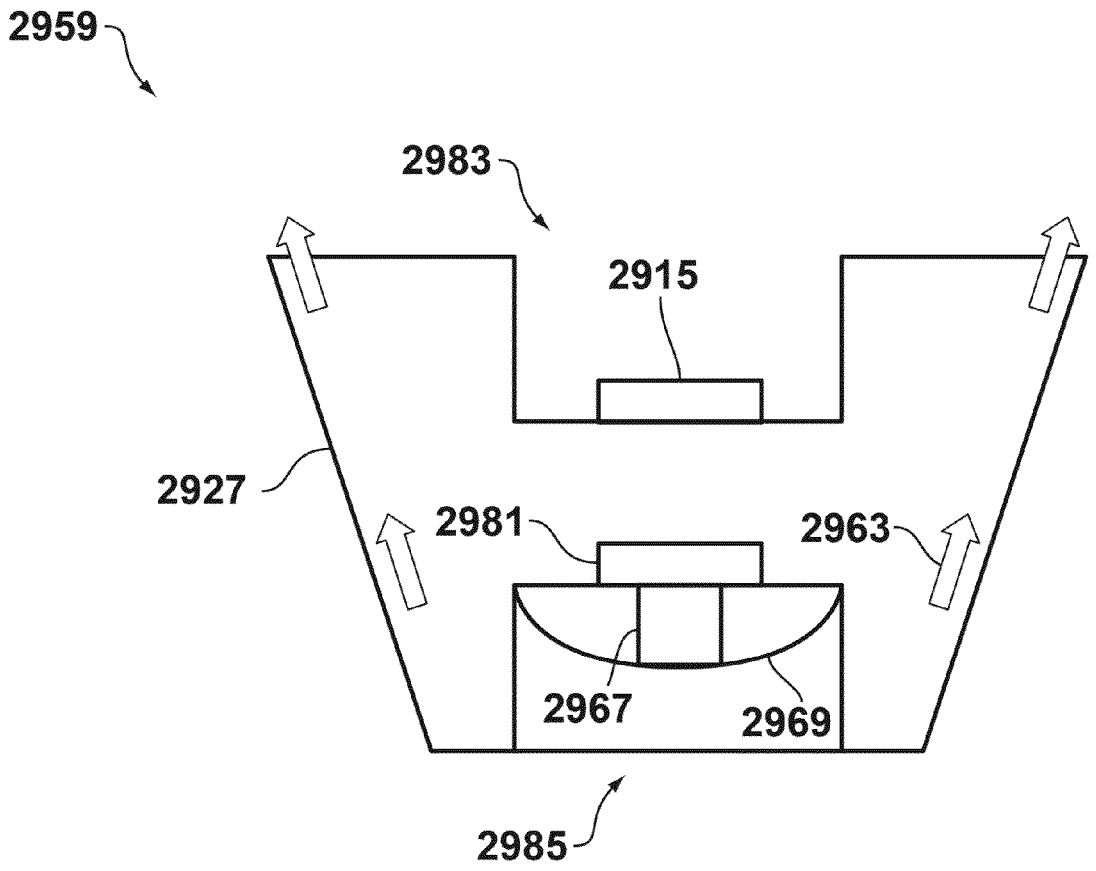
FIG. 37 is an illustration of a heat sink/support structure combination in accordance with the teachings herein.

FIG. 37 shows a particular, non-limiting embodiment of the foregoing type of heat sink. As seen therein, the heat sink 2959 depicted therein is constructed to include or provide support for some of the components of the synthetic jet ejector. The heat sink 2959 in this embodiment may comprise any suitable thermally conductive material, including various metals and filled polymers. Preferably, however, the heat sink 2959 comprises a thermally conductive, injection molded plastic.

The heat sink 2959 in this embodiment comprises a first compartment 2983 which houses one or more LEDs 2915, and a second compartment 2985 which houses the voice coils 2967 and diaphragms 2969 of one or more synthetic jet actuators. A magnet 2981 associated with the one or more synthetic jet actuators is embedded in the material of the heat sink 2959. Also, as indicated by arrows 2963, flow paths are designed in the heat sink 2959. Such flow paths may be in the form of channels molded into the heat sink 2959, which may be closed along portions of their length, or which may be open along all, or a portion of, their lengths. Preferably, these channels are formed by pairs of adjacent heat fins 2927 along portions of their length.

Figure 38:
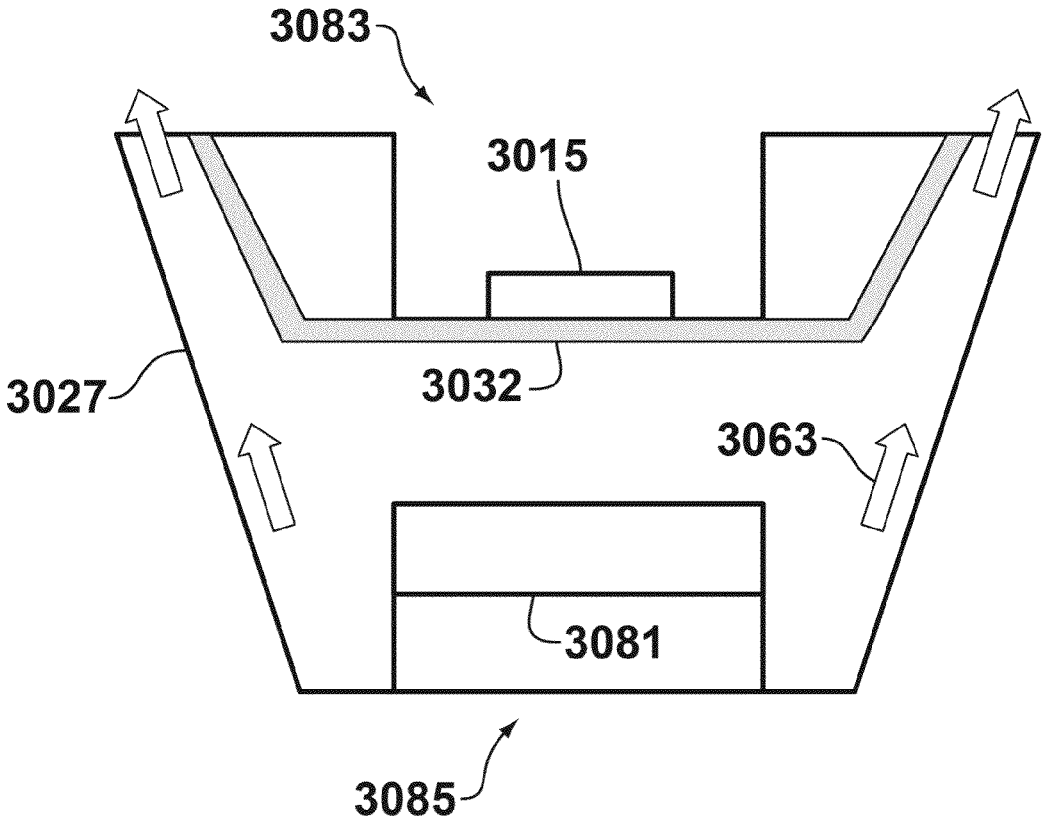
FIG. 38 is an illustration of a heat sink/support structure combination in accordance with the teachings herein.

FIG. 38 shows another particular, non-limiting embodiment of a heat sink which is similar in many respects to the embodiment shown in FIG. 37. Hence, as seen therein, the heat sink 3059 depicted is constructed to include or provide support for some of the components of the synthetic jet ejector. The heat sink 3059 in this embodiment may comprise any suitable thermally conductive material, including various metals and filled polymers, and preferably comprises a thermally conductive, injection molded plastic. However, unlike the embodiment shown in FIG. 37, the heat sink further includes an integrated heat sink support structure 3032. This heat sink support structure 3032 preferably comprises a material that is more thermally conductive than the thermally conductive, injection molded plastic to provide better thermal conduction in the base and into the fins. The heat sink support structure 3032 preferably comprises a metal with high thermal conductivity, such as aluminum or copper, which may be stamped and formed into the heat sink shape and overmolded with the thermally conductive, injection molded plastic.

The heat sink 3059 in this embodiment comprises a first compartment 3083 which houses one or more LEDs 3015, and a second compartment 3085 which houses the voice coils 3067 and diaphragms 3069 of one or more synthetic jet actuators. A magnet 3081 associated with the one or more synthetic jet actuators is embedded in the material of the heat sink 3059. Also, as indicated by arrows 3063, flow paths are designed in the heat sink 3059. Such flow paths may be in the form of channels molded into the heat sink 3059, which may be closed along portions of their length, or which may be open along all, or a portion of, their lengths. Preferably, these channels are formed by pairs of adjacent heat fins 3027 along portions of their length.

Figure 39:
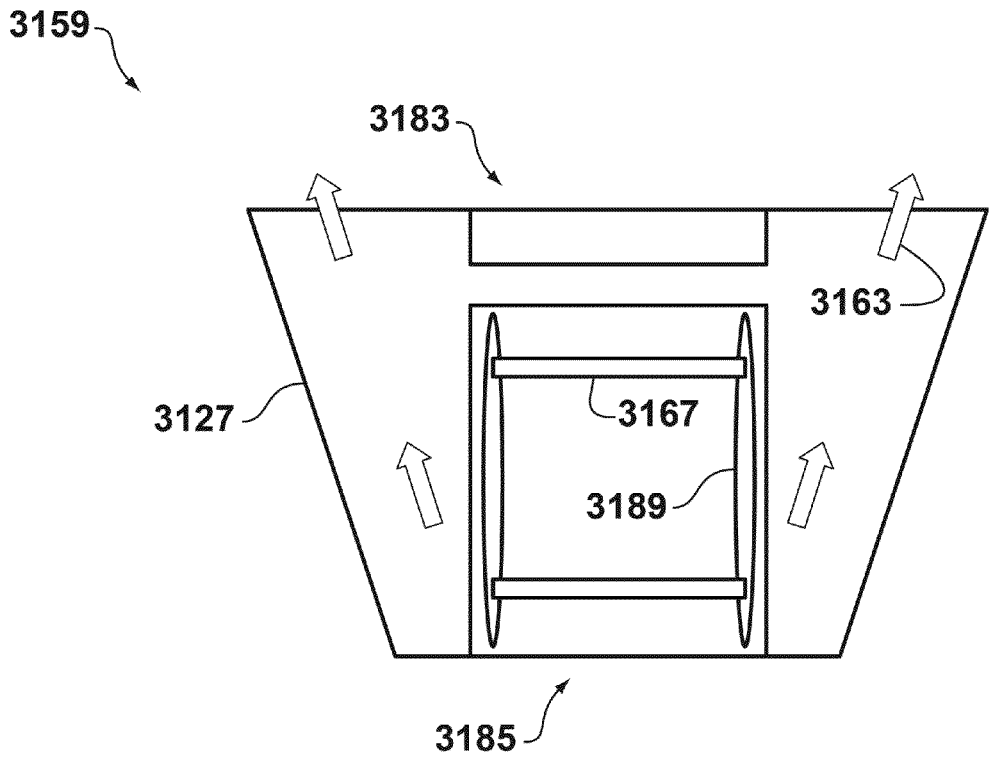
FIG. 39 is an illustration of a heat sink/support structure combination in accordance with the teachings herein.

FIG. 39 shows another particular, non-limiting embodiment of a heat sink which is similar in some respects to the heat sinks utilized in the embodiments shown in FIGS. 20 to 23. Hence, as seen therein, the heat sink 3159 depicted therein is constructed to include or provide support for some of the components of the synthetic jet ejector. The heat sink 3159 in this embodiment may comprise any suitable thermally conductive material, including various metals and filled polymers. Preferably, however, the heat sink 3159 comprises a thermally conductive, injection molded plastic.

The heat sink 3159 in this embodiment comprises a first compartment 3183 which may be utilized to house one or more LEDs (not shown), and a second compartment 3185 which houses the voice coils 3167 and diaphragms 3169 of one or more synthetic jet actuators. As indicated by arrows 3163, flow paths are designed in the heat sink 3159. Such flow paths may be in the form of channels molded into the heat sink 3159, which may be closed along portions of their length, or which may be open along all, or a portion of, their lengths. Preferably, these channels are formed by pairs of adjacent heat fins 3127 along portions of their length.

This embodiment is advantageous in that the surround is long and has a small bend radius. Such a construction allows for a larger usable piston area. Moreover, the small radius allows for a smaller diameter assembly with more usable piston area.

Figure 40:
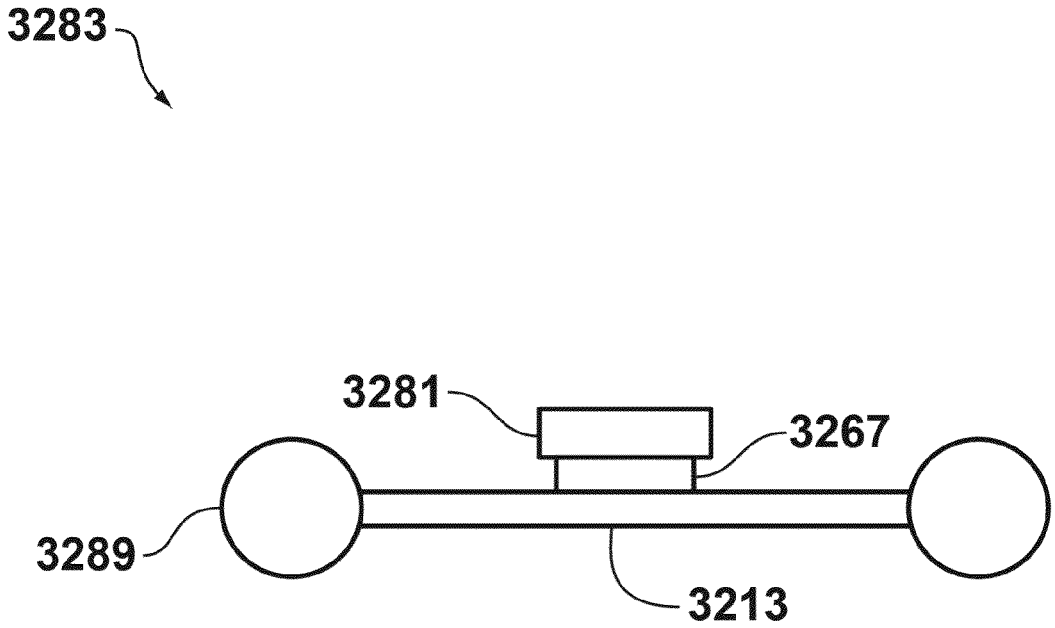
FIG. 40 is an illustration of a diaphragm assembly in accordance with the teachings herein.
Figure 41:
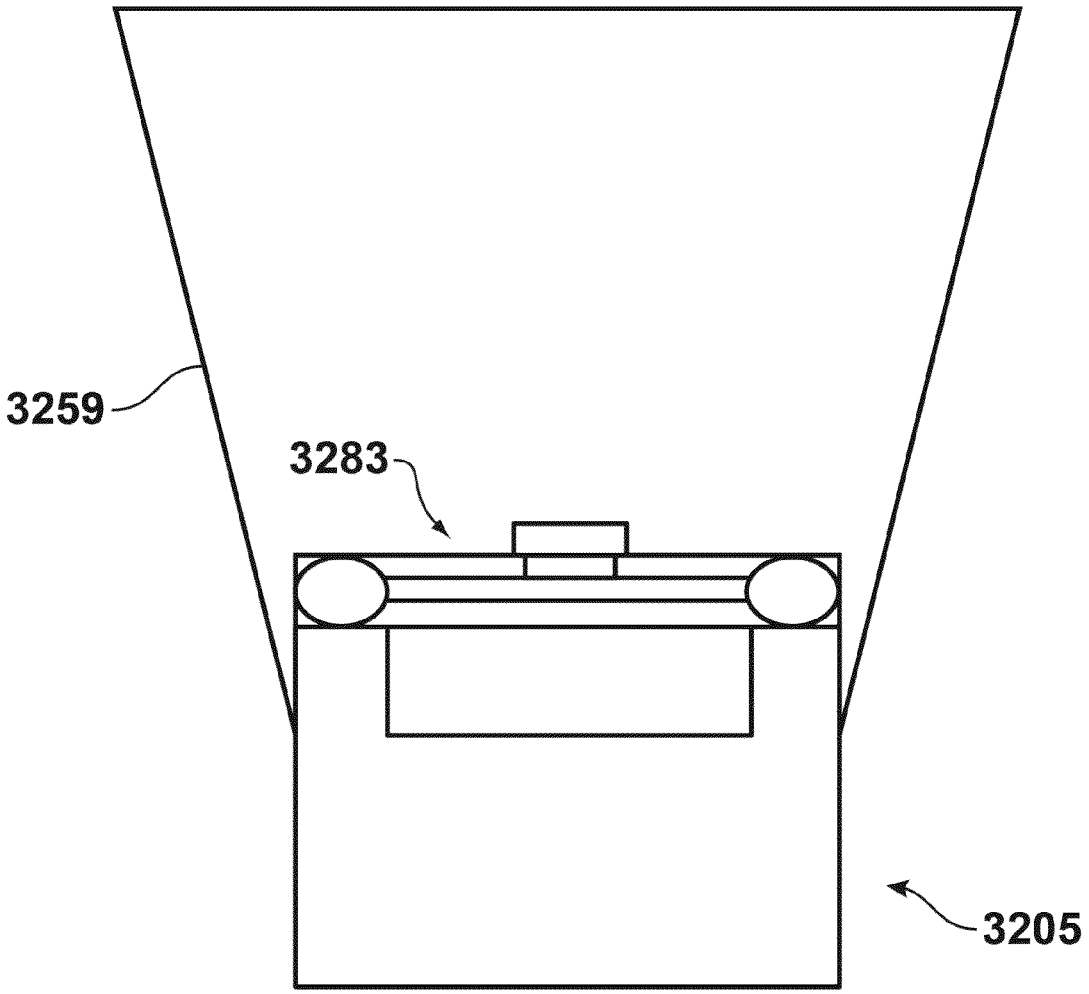
FIG. 41 is an illustration of a portion of an illumination device which incorporates the diaphragm assembly of FIG. 40.

FIGS. 40 to 41 illustrate a particular, non-limiting embodiment of a diaphragm assembly and its use in accordance with the teachings herein. As with the previous embodiments, this embodiment allows elements of the host device to be used as part of the construction of the synthetic jet ejector.

With reference to FIG. 40, the diaphragm assembly 3283 comprises a diaphragm 3213, a preferably toroidal and resilient surround 3289, a voice coil 3267 and a magnet 3289. This assembly is preferably prefabricated as a single standalone unit.

As seen in FIG. 41, the diaphragm assembly 3283 may then be assembled into an illumination device. For simplicity of illustration, only the heat sink 3259 and the electrical connector module 3205 of an illumination device are shown, and these components are preferably designed to fit together with a snap fit or threaded fit. As seen therein, the diaphragm assembly 3283 is disposed between the heat sink 3259 and the electrical connector module 3259 in such a way that the resilient surround 3289 is compressed between the two when they are attached together, thus forming a seal. This construction eliminates the need for adhesives, overmolding or ultrasonic welding in assembling these devices.

Figure 45:
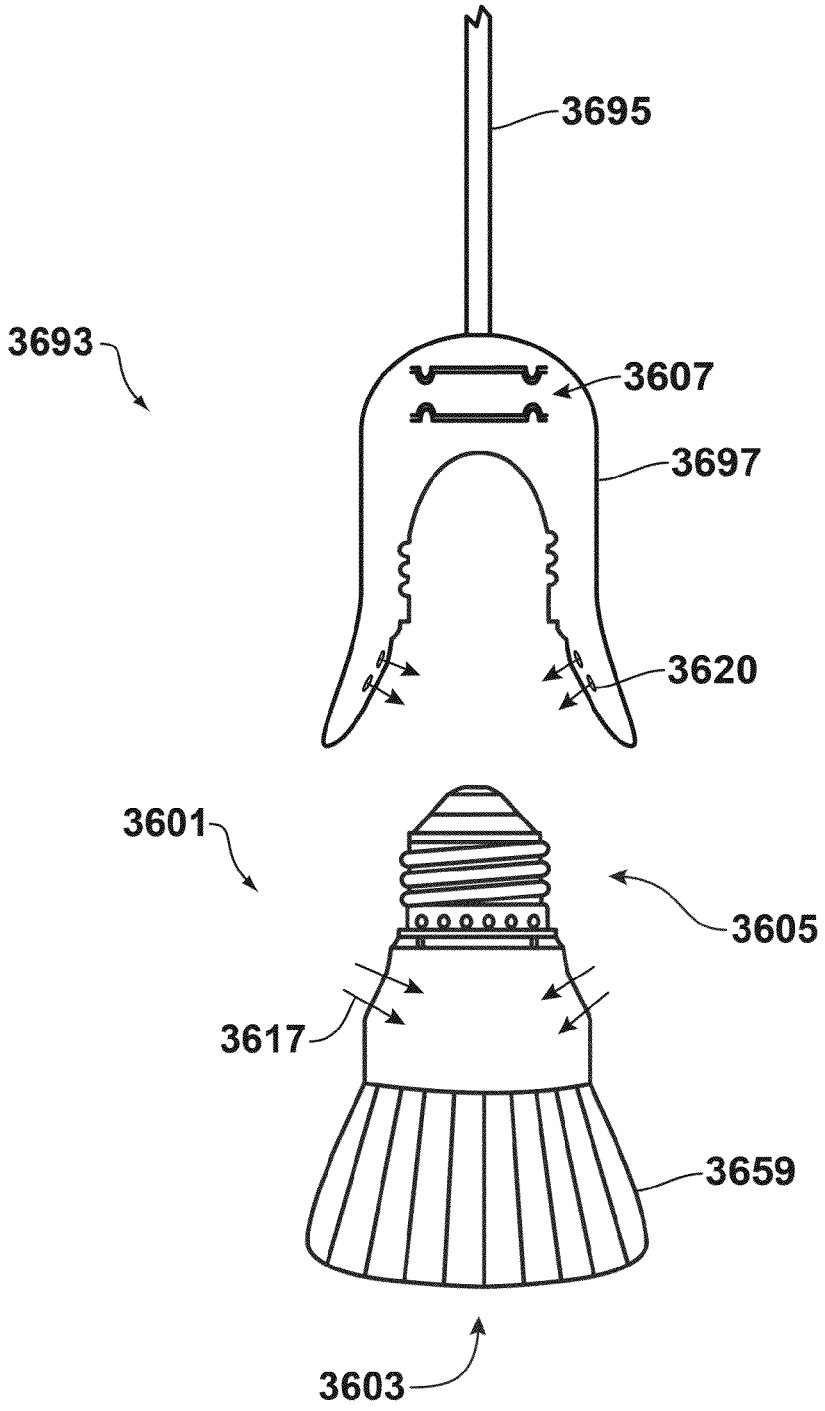
FIG. 45 is an illustration of an illumination device in accordance with the teachings herein in which elements of the thermal management solution are built into different components of the final device.
Figure 46:
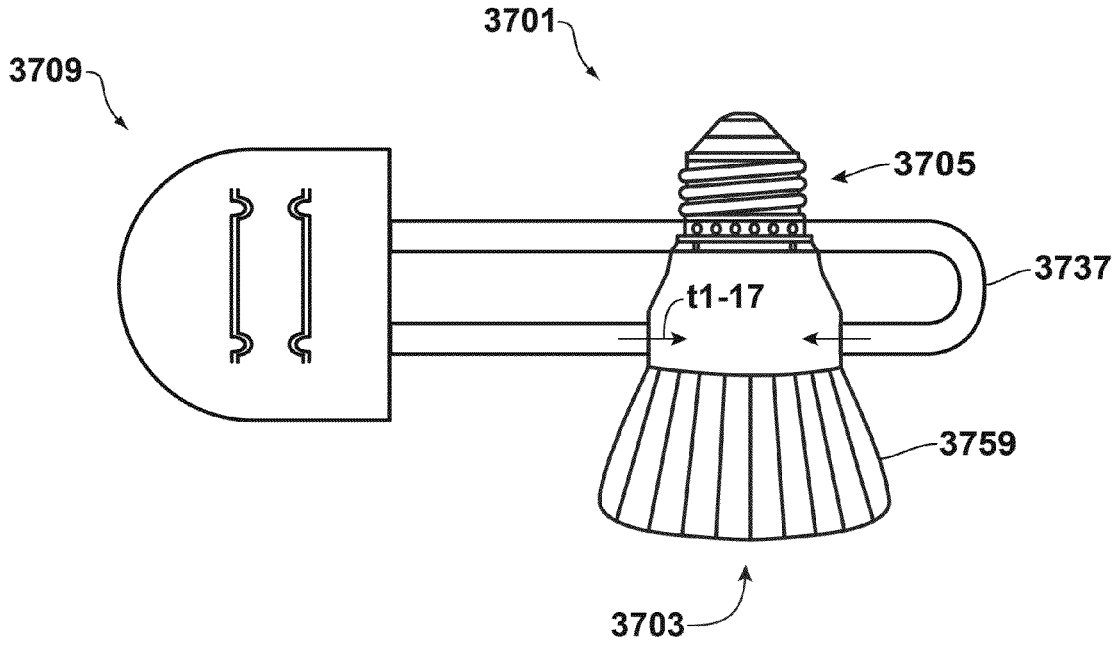
FIG. 46 is an illustration of an illumination device in accordance with the teachings herein in which elements of the thermal management solution are built into different components of the final device.

FIGS. 45 and 46 illustrate further particular, non-limiting embodiments of illumination devices in which elements of the thermal management solution are built into different components of the final device. In particular, these embodiments illustrate examples in which the synthetic jet actuator is built into a light fixture, and in which the heat sink and parts of the fluidic flow path for the synthetic jet ejectors are built into the bulb which fits into the fixture. These approaches provide additional flexibility for applications where such flexibility is required by the form factor of the bulb or the matching electronics, LEDs, wiring, thermal management constraints, or cost considerations.

With respect to FIG. 45, the embodiment depicted therein features a light fixture 3693 that comprises an illumination device 3601 and a host light socket 3697. The host light socket 3697 is powered by a power cord 3695, and has a synthetic jet ejector 3607 housed therein which is in fluidic communication with a plurality of apertures 3620 defined in the surface of the light socket 3697 adjacent to the illumination device 3601. The illumination device 3601 is equipped with an electrical connector module 3605 which rotatingly engages a complimentary shaped threaded receptacle in the light fixture 3693. The illumination device 3601 is further equipped with a heat sink 3659 and a light emitting portion 3603. In addition, the illumination device 3601 is equipped with a series of apertures that align with the apertures 3620 in the light fixture 3693.

When the illumination device 3601 is installed in the light socket 3697, the synthetic jet actuator resident in the light socket 3697 creates a fluidic flow into the light emitting device 3601 as indicated by synthetic jets 3617. This fluidic flow dissipates heat from the heat sink 3659 and to the ambient environment.

The embodiment depicted in FIG. 46 is similar in many respects to the embodiment of FIG. 45. However, in this embodiment, the synthetic jet actuator 3709 is separate from the light fixture (not shown) and is fluidically connected to the illumination device 3701 by way of tubing 3737.

In the embodiments of FIGS. 45 and 46, various interfaces may be utilized to establish a connection between the flow path provided by the synthetic jet actuators and the flow path within the illumination device. For example, in some embodiments, ports or other such features may be provided in the light fixture that form a (preferably air-tight) fluidic connection to ports or other such features in the illumination device.

Figure 42:
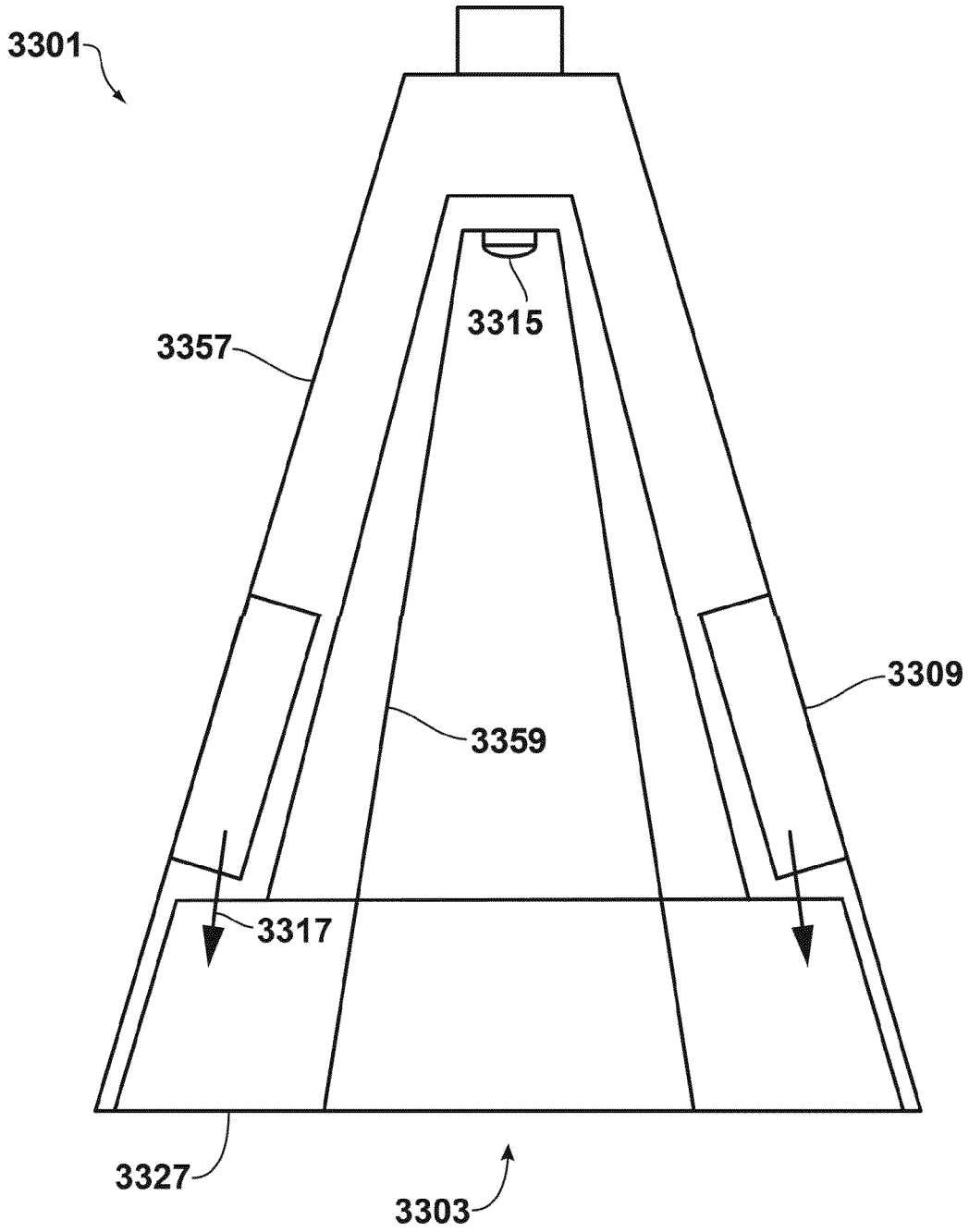
FIG. 42 is an illustration of an illumination device in accordance with the teachings herein.

The foregoing principles of incorporating synthetic jet ejectors and their components into the structure of host devices allows illumination devices to be produced which may feature a variety of arrangements for synthetic jet modules. This is illustrated by FIG. 42, which depicts another particular, non-limiting embodiment of an LED-based illumination device in accordance with the teachings herein. The illumination device 3301 depicted therein is of the general PAR/R 38 form factor and features an LED 3315 disposed on, and within, a heat sink 3359. The heat sink 3359 is disposed within a housing 3357 that is generally conical in shape and that terminates in a light emitting portion 3303 on the end opposite of the LED 3315.

The synthetic jet ejectors 3309 in this embodiment are placed on the sides of the housing 3357 and preferably parallel to the sides thereof. This arrangement not only allows the synthetic jet ejectors to be positioned so as to dissipate heat from the heat sink, but also allows the length of the optical element to be significantly longer than would be the case if the synthetic jet ejectors 3309 were centrally disposed within the housing 3357, thus improving light output distribution. It also leaves space available for electronics and attachment structures in the upper area of the housing 3357.

In operation, heat flows from the base of the heat sink 3359 (where the LED 3359 is mounted) to the heat fins 3327, where the turbulent air flow created by the synthetic jets 3317 emitted by the synthetic jet ejectors 3309 reject the heat to the environment.

Figure 43:
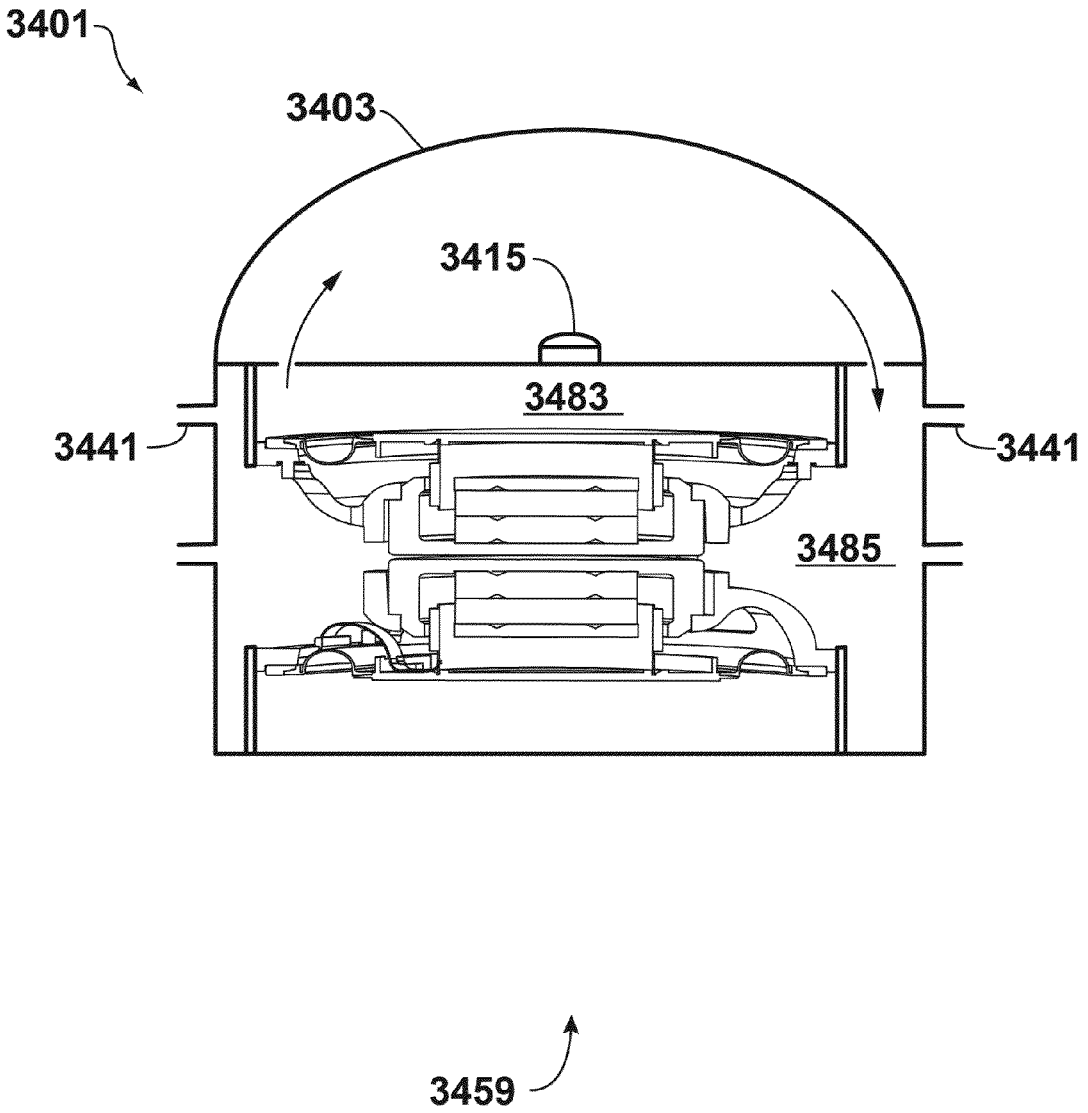
FIG. 43 is an illustration of an illumination device in accordance with the teachings herein.

Synthetic jet ejectors may be utilized in the embodiments described herein to induce air flow within an otherwise externally sealed chamber. This principle is demonstrated in FIG. 43, which depicts another particular, non-limiting embodiment of an LED-based illumination device in accordance with the teachings herein. The illumination device 3401 depicted therein uses a synthetic jet actuator to create a first fluidic flow in the optical dome that forms the light emitting portion 3403 of an A-lamp LED light bulb. The light emitting portion 3403 is fed by one or more apertures or nozzles that are in fluidic communication with the diaphragm 3483 and motor 3485 chambers ("diaphragm" and "motor") inside the illumination device. The first fluidic flow causes fluid to be moved back and forth between the diaphragm 3483 and motor 3485 chambers via the light emitting portion, thus dissipating heat in the light emitting portion 3403.

In some embodiments, a second fluidic flow may occur at apertures or nozzles 3441. In these embodiments, the second fluidic flow may be utilized, for example, to disperse the heated fluid generated by the first fluidic flow to the ambient environment, or to cool or thermally manage another heat source or device.

Figure 44:
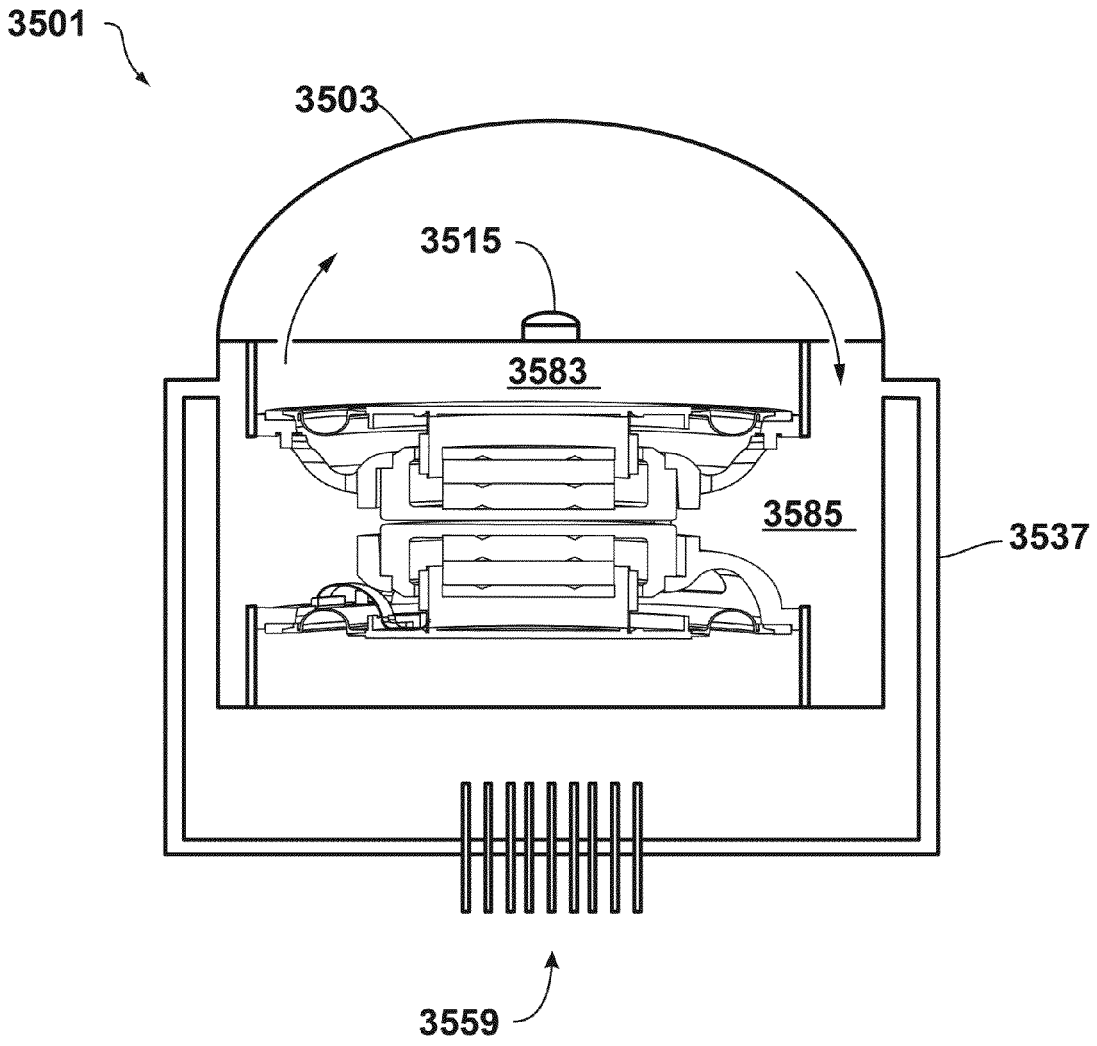
FIG. 44 is an illustration of an illumination device in accordance with the teachings herein.

FIG. 44 depicts another particular, non-limiting embodiment of an LED-based illumination device in accordance with the teachings herein. This device is similar in many respects to the device of FIG. 43, but is further equipped with a tubing 3537 or other suitable conduit which is equipped with a heat sink 3559.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

APPENDIX A

Parts List

01: Illumination device
03: Light Emitting Portion
05: Electrical Connector Module
07: Synthetic Jet Actuator
09: Synthetic Jet Ejector
11: Actuator Housing
13: Diaphragm
15: LED
17: Synthetic Jet
19: Internal Aperture
20: Aperture in Actuator Housing
21: External Aperture
23: External Vent
25: Pedestal
27: Heat Fin
29: Synthetic Jet Ejector/Heat Sink Combination
31: LED Support Structure
32: Heat Sink Support Structure
33: Active Diaphragm
35: Passive Diaphragm
37: Channel
39: Externally Mounted LED
41: Nozzle
43: Synthetic Jet Actuator Support Structure
45: Reflective Material
47: Porous Medium
49: Heat Pipe
51: Internal Chamber
53: Region
55: Internal Housing Element
57: External Housing Element
59: Heat Sink
63: Arrow
65: Heat Spreader
67: Voice Coils
69: Diaphragm
71: $1^{st}$ Channel
73: $2^{nd}$ Channel
75: Upper Wall
76: Lower Wall
77: Heat Sink Cover
79: Base
81: Magnet
83: $1^{st}$ Compartment
85: $2^{nd}$ Compartment
87: Piston
89: Surround
91: Gasket
93: Light Fixture
95: Power Cable
97: Light Socket

What is claimed is:

1. An illumination device, comprising:

a light emitting portion;

an LED disposed within said light emitting portion;

a threaded connector module adapted to rotatingly engage said illumination device to a source of electricity;

a heat sink disposed between said light emitting portion and said connector module; and a synthetic jet ejector disposed between said light emitting portion and said connector module.

2. The illumination device of claim 1, wherein said heat sink comprises a plurality of fins.

3. The illumination device of claim 1, wherein said heat sink is annular in shape.

4. The illumination device of claim 1, wherein said synthetic jet ejector is disposed within said heat sink.

5. The illumination device of claim 1, wherein said synthetic jet ejector is disposed between said connector module and said heat sink.

6. The illumination device of claim 1, wherein said light emitting portion comprises an optically transmissive housing, and wherein said LED is disposed within said optically transmissive housing.

7. The illumination device of claim 6, wherein said optically transmissive housing is diffusively transmissive.

8. The illumination device of claim 6, wherein said optically transmissive housing is bulbous.

9. The illumination device of claim 6, wherein said optically transmissive housing is dome-shaped.

10. The illumination device of claim 1, wherein said heat sink comprises a plurality of fins, and wherein said synthetic jet ejector is adapted to direct a synthetic jet into a channel formed by a pair of adjacent fins.

11. The illumination device of claim 1, wherein said synthetic jet ejector comprises first and second diaphragms.

12. The illumination device of claim 1, wherein said first and second diaphragms are arranged in parallel.

13. The illumination device of claim 1, wherein each of said first and second diaphragms has a major planar surface which is parallel to a longitudinal axis of said illumination device.

14. The illumination device of claim 1, wherein each of said first and second diaphragms has a major planar surface which is perpendicular to a longitudinal axis of said illumination device.

15. The illumination device of claim 1, wherein said synthetic jet ejector comprises a voice coil.

16. The illumination device of claim 1, wherein said synthetic jet ejector comprises a piezoelectric actuator.

17. The illumination device of claim 1, wherein said LED is disposed on said heat sink.

18. An illumination device, comprising:

a housing having an LED disposed therein, wherein said housing is transmissive to light generated by said LED;

a threaded connector module which rotatingly engages a complimentary shaped electrical socket;

a heat sink disposed between said housing and said connector module, wherein said heat sink comprises a plurality of fins; and a synthetic jet ejector which directs a synthetic jet into a channel formed by a pair of adjacent fins, wherein said synthetic jet ejector is disposed between said housing and said connector module.

19. The illumination device of claim 18, wherein said synthetic jet ejector is disposed within said heat sink.

20. The illumination device of claim 18, wherein said synthetic jet ejector is disposed between said connector module and said heat sink.

21. The illumination device of claim 18, wherein said housing is diffusely transmissive to light generated by said LED.

* * * * *